US011759084B2

(12) United States Patent
Harrington et al.

(10) Patent No.: US 11,759,084 B2
(45) Date of Patent: Sep. 19, 2023

(54) HARD SURFACE CLEANING AND CONDITIONING ASSEMBLIES

(71) Applicant: Unger Marketing International, LLC, Bridgeport, CT (US)

(72) Inventors: William Harrington, Charlestown, RI (US); John A. Triunfo, Jr., Fairfield, CT (US); Paul H. Adams, Monroe, CT (US); Robert F. Smith, Waterbury, CT (US); Joseph K. Patterson, Monroe, CT (US)

(73) Assignee: Unger Marketing International, LLC, Bridgeport, CT (US)

( * ) Notice: Subject to any disclaimer, the term of this patent is extended or adjusted under 35 U.S.C. 154(b) by 166 days.

(21) Appl. No.: 17/230,408

(22) Filed: Apr. 14, 2021

(65) Prior Publication Data

US 2021/0228052 A1 Jul. 29, 2021

Related U.S. Application Data

(63) Continuation of application No. 15/238,217, filed on Aug. 16, 2016, now Pat. No. 11,122,956.
(Continued)

(51) Int. Cl.
*A47L 13/22* (2006.01)
*B25G 1/04* (2006.01)
(Continued)

(52) U.S. Cl.
CPC ..... *A47L 13/22* (2013.01); *A47L 13/256* (2013.01); *A47L 13/258* (2013.01);
(Continued)

(58) Field of Classification Search
CPC ..... A47L 13/254; A47L 13/24; A47L 9/32; A47L 11/4075; A47L 11/34;
(Continued)

(56) References Cited

U.S. PATENT DOCUMENTS 359,605 A 3/1887 Harry
388,934 A 9/1888 Trapp
(Continued)

FOREIGN PATENT DOCUMENTS

CN 3544694 7/2006
CN 202060407 A 6/2013
(Continued)

OTHER PUBLICATIONS

Amazon.com: Unger NCAN ErgoTec OptiLoc Tele-Pole Locking Cone, reviews 2016, https://www.amazon.com/Unger-NCAN-ErgoTec-OptiLoc-Tele-Pole/dp/B000FJH5SQ/ref. . . site visited Jun. 18, 2019.

(Continued)

*Primary Examiner* — Vishal Pancholi
*Assistant Examiner* — Robert K Nichols, II
(74) *Attorney, Agent, or Firm* — McCarter & English, LLP; Dave S. Christensen

(57) ABSTRACT

A hard surface cleaning and conditioning assembly is provided that includes a pole having a lower section and an upper section; an adjusting device securing the upper and lower sections to one another in a telescoping manner; a tool depending from the lower section; a conditioning agent dispensing device depending from the lower section; a trigger depending from the upper section; and a telescoping trigger assembly operatively connecting the dispensing device to the trigger.

9 Claims, 32 Drawing Sheets

Related U.S. Application Data

(60) Provisional application No. 62/298,155, filed on Feb. 22, 2016, provisional application No. 62/206,072, filed on Aug. 17, 2015.

(51) Int. Cl.

| | |
|---|---|
| ***B25G 1/10*** | (2006.01) |
| ***B05B 9/08*** | (2006.01) |
| ***B05B 12/00*** | (2018.01) |
| ***B65D 47/20*** | (2006.01) |
| ***B65D 47/06*** | (2006.01) |
| ***A47L 13/258*** | (2006.01) |
| ***A47L 13/256*** | (2006.01) |

(52) U.S. Cl.
CPC ..... *B05B 9/0888* (2013.01); *B05B 12/002* (2013.01); *B25G 1/04* (2013.01); *B25G 1/102* (2013.01); *B65D 47/06* (2013.01); *B65D 47/20* (2013.01)

(58) Field of Classification Search
CPC .... A47L 11/408; A47L 11/4083; A47L 13/26; A47L 11/4058; A47L 13/253; A47L 13/258; A47L 13/22; B05B 9/0888; B05B 12/002; B65D 47/20; B65D 47/06; B25G 1/102; B25G 1/04
See application file for complete search history.

(56) References Cited

U.S. PATENT DOCUMENTS

| | | | |
|---|---|---|---|
| 411,673 | A | 9/1889 | Newman |
| D31,801 | S | 11/1899 | Gardner |
| 836,115 | A | 11/1906 | Johnson |
| D43,038 | S | 9/1912 | Gurski |
| 1,112,906 | A | 10/1914 | Hewett |
| 1,315,194 | A | 9/1919 | Yamamoto |
| 1,426,440 | A | 8/1922 | Zieschang |
| 2,073,170 | A | 3/1937 | Pieper |
| D114,601 | S | 5/1939 | Hulsh |
| 2,187,671 | A | 1/1940 | Suddarth |
| 2,228,573 | A | 1/1941 | Lowe |
| 2,228,574 | A | 1/1941 | Lowe |
| 2,237,969 | A | 4/1941 | Olsen |
| 2,340,530 | A | 2/1944 | Hefner |
| 2,426,373 | A | 8/1947 | Ogawa et al. |
| 2,518,984 | A | 8/1950 | William |
| 2,575,124 | A | 11/1951 | Pollitt |
| 2,815,522 | A | 12/1957 | Hexter |
| D186,360 | S | 10/1959 | Lathrop et al. |
| 2,923,018 | A | 2/1960 | Matthay |
| 3,039,126 | A | 6/1962 | Kessler |
| 3,238,822 | A | 3/1966 | Zuracki |
| 3,436,772 | A | 4/1969 | Stebbins |
| 3,457,016 | A | 7/1969 | Gotberg |
| 3,510,028 | A | 5/1970 | Batistelli |
| 4,088,252 | A | 5/1978 | Grunberger |
| D262,936 | S | 2/1982 | Nishiyama |
| 4,324,012 | A | 4/1982 | Cannaday |
| D268,447 | S | 3/1983 | Sudduth |
| D274,565 | S | 7/1984 | Smith et al. |
| 4,704,758 | A | 11/1987 | Hoffman |
| 4,733,812 | A | 3/1988 | Lewis et al. |
| 4,769,869 | A | 9/1988 | Benitez |
| 4,809,388 | A | 3/1989 | Dietrich |
| D300,506 | S | 4/1989 | Pedone |
| 4,863,299 | A | 9/1989 | Osberghaus |
| D306,924 | S | 3/1990 | Shapton |
| D307,657 | S | 5/1990 | Li |
| D311,254 | S | 10/1990 | Clair |
| D317,108 | S | 5/1991 | Cochran |
| D321,422 | S | 11/1991 | Smith |
| 5,133,101 | A | 7/1992 | Hauser et al. |
| D334,694 | S | 4/1993 | McCoy |
| D339,918 | S | 10/1993 | Chamberlain |
| D341,234 | S | 11/1993 | Blessing |
| D341,941 | S | 12/1993 | Stokes |
| D346,543 | S | 5/1994 | Berti |
| 5,368,549 | A | 11/1994 | McVicker |
| 5,375,286 | A | 12/1994 | Harrah |
| 5,553,759 | A | 9/1996 | McMaster |
| 5,581,839 | A | 12/1996 | Ferrell, Jr. |
| 5,632,429 | A | 5/1997 | Cantwell |
| 5,671,872 | A | 9/1997 | Daniels, Jr. |
| D387,208 | S | 12/1997 | Collett |
| 5,720,071 | A | 2/1998 | Hall |
| 5,771,535 | A | 6/1998 | Blessing |
| 5,791,006 | A | 8/1998 | Anctil |
| 5,823,414 | A | 10/1998 | Gal |
| D401,703 | S | 11/1998 | Beechuk |
| D403,447 | S | 12/1998 | Parsons |
| D404,282 | S | 1/1999 | Hsu |
| 5,888,006 | A | 3/1999 | Ping |
| D411,673 | S | 6/1999 | Biggs et al. |
| 5,920,944 | A | 7/1999 | Biggs |
| 5,927,058 | A | 7/1999 | Hsu |
| D412,783 | S | 8/1999 | You |
| 5,954,253 | A | 9/1999 | Swetish |
| 5,954,420 | A | 9/1999 | Smith |
| D416,389 | S | 11/1999 | Frazier |
| D420,561 | S | 2/2000 | Kunkler |
| 6,023,924 | A | 2/2000 | Babineau |
| 6,105,194 | A | 8/2000 | Rudolph |
| 6,170,112 | B1 | 1/2001 | Mayfield |
| D438,113 | S | 2/2001 | Wadsworth |
| 6,199,245 | B1 | 3/2001 | Blessing |
| D440,837 | S | 4/2001 | Hart |
| 6,378,922 | B1 | 4/2002 | Troudt |
| D458,427 | S | 6/2002 | Kunkler et al. |
| D458,721 | S | 6/2002 | Clarke |
| 6,397,427 | B1 | 6/2002 | Bryngelsson |
| 6,449,803 | B1 | 9/2002 | McConchie |
| 6,487,747 | B2 | 12/2002 | Cavalheiro |
| 6,497,525 | B1 | 12/2002 | Huang |
| 6,540,424 | B1 | 4/2003 | Hall |
| 6,550,998 | B1 | 4/2003 | Fernschild |
| 6,551,001 | B2 | 4/2003 | Aberegg |
| 6,579,023 | B2 | 6/2003 | Kunkler |
| D480,188 | S | 9/2003 | Blouse' |
| 6,612,768 | B2 | 9/2003 | Zorzo |
| D481,290 | S | 10/2003 | Thompson |
| D482,829 | S | 11/2003 | Vosbikian et al. |
| 6,651,853 | B2 | 11/2003 | Higgins |
| 6,655,866 | B1 | 12/2003 | Morad |
| 6,659,670 | B1 | 12/2003 | Blouse |
| 6,663,306 | B2 | 12/2003 | Policicchio |
| 6,669,391 | B2 | 12/2003 | Policicchio |
| D485,954 | S | 1/2004 | Hall et al. |
| 6,695,516 | B2 | 2/2004 | Defields |
| 6,722,806 | B2 | 4/2004 | Kunkler |
| 6,726,388 | B1 | 4/2004 | Monahan |
| D490,561 | S | 5/2004 | Angeletta |
| 6,799,916 | B2 | 10/2004 | Fernschild |
| 6,814,466 | B2 | 11/2004 | Parsons et al. |
| 6,854,911 | B2 | 2/2005 | Policicchio |
| 6,854,912 | B2 | 2/2005 | Dyer |
| D505,762 | S | 5/2005 | Lalanne |
| 6,889,917 | B2 | 5/2005 | Fahy |
| 6,892,915 | B2 | 5/2005 | Mares |
| 6,893,180 | B2 | 5/2005 | Hall |
| 6,899,485 | B2 | 5/2005 | Hall |
| 6,951,430 | B2 | 10/2005 | Fernschild |
| 6,953,299 | B2 | 10/2005 | Wang |
| 6,955,490 | B2 | 10/2005 | Chase |
| 6,960,042 | B1 | 11/2005 | Hsiao |
| 6,964,535 | B2 | 11/2005 | Bell |
| D514,267 | S | 1/2006 | Tsai |
| 6,981,533 | B2 | 1/2006 | Zorzo |
| 6,986,618 | B2 | 1/2006 | Hall |
| 6,986,619 | B2 | 1/2006 | Hall |
| 7,004,658 | B2 | 2/2006 | Hall |
| 7,040,510 | B1 | 5/2006 | Hester |
| 7,048,458 | B2 | 5/2006 | Hall |

(56) References Cited

U.S. PATENT DOCUMENTS 7,048,804 B2 5/2006 Kisela
7,056,050 B2 6/2006 Sacks
7,121,598 B2 10/2006 Pourtier et al.
7,160,044 B2 1/2007 Dyer
7,163,349 B2 1/2007 Policicchio
D536,850 S 2/2007 Sacks
7,172,099 B2 2/2007 Hofte
7,191,486 B1 3/2007 Michelson
D542,492 S 5/2007 Chang
D542,493 S 5/2007 Berti
D547,508 S 7/2007 Thomas
D547,554 S 7/2007 Ajluni et al.
D548,909 S 8/2007 Murray
D552,314 S 10/2007 Harper et al.
7,341,389 B2 3/2008 Chase
D568,567 S 5/2008 Baumkirchner et al.
7,373,708 B2 5/2008 Stable et al.
D574,741 S 8/2008 Gadsden
7,431,524 B2 10/2008 Sacks
D583,118 S 12/2008 Snyder
D586,514 S 2/2009 Perelli
D590,117 S 4/2009 Crawford
D592,819 S 5/2009 Crawford
D597,269 S 7/2009 McNeil et al.
D602,664 S 10/2009 Crawford
D604,610 S 11/2009 Ames et al.
7,618,206 B2 11/2009 Sacks
7,621,686 B2 11/2009 Fernschild
D607,165 S 12/2009 Libman et al.
D608,885 S 1/2010 Sneddon et al.
7,653,958 B2 2/2010 Rosenzweig
D611,668 S 3/2010 Wessel
7,670,073 B2 3/2010 Fernschild
D614,824 S 4/2010 Heidel et al.
7,699,551 B2 4/2010 Suda
7,708,485 B2 5/2010 Tanaka
7,722,273 B2 5/2010 Tanaka
D618,411 S 6/2010 Crawford
D623,071 S 9/2010 Driskell et al.
7,794,165 B2 9/2010 Balz
D628,352 S 11/2010 Libman et al.
D629,984 S 12/2010 Carlson
7,850,384 B2 12/2010 Sacks
D634,497 S 3/2011 Robertson et al.
D636,262 S 4/2011 Michitsuji et al.
D639,661 S 6/2011 Llerena
7,992,258 B1 8/2011 Stitser
D648,466 S 11/2011 Hickman
8,069,520 B2 12/2011 Mattucci
8,079,770 B2 12/2011 Widmer
8,162,194 B2 4/2012 Gleason
D660,533 S 5/2012 Hill
D660,667 S 5/2012 Miyazaki
D661,036 S 5/2012 Raven
8,186,898 B2 5/2012 Bradbury
D661,442 S 6/2012 Kandasamy
8,205,293 B2 6/2012 Rosenzweig
8,241,427 B1 8/2012 Crawford et al.
8,267,607 B2 9/2012 Harris
8,375,499 B1 2/2013 Marino
D680,701 S 4/2013 Carlson
8,425,137 B1 4/2013 Sampaio
8,449,212 B2 5/2013 Crawford
D685,968 S 7/2013 Smith
D694,483 S 11/2013 Hines
8,596,896 B2 12/2013 Kimura
D699,412 S 2/2014 Smith
8,641,309 B2 2/2014 Perry
D700,521 S 3/2014 Finlay
8,662,778 B2 3/2014 Crawford
8,667,637 B2 3/2014 Vrdoljak
8,672,203 B2 3/2014 Staudecker
8,807,858 B2 8/2014 Fitzpatrick
8,834,053 B2 9/2014 Van Landingham, Jr
8,844,088 B2 9/2014 Garcia Castillo
D718,011 S 11/2014 Lentine
8,894,315 B2 11/2014 Dingert
8,927,480 B2 1/2015 Williams
D722,857 S 2/2015 Huang
8,973,200 B2 3/2015 Mallett
9,004,563 B2 4/2015 Buzby
D731,244 S 6/2015 Kohl
D731,321 S 6/2015 Farrell et al.
9,044,132 B2 6/2015 Kaminer
D739,484 S 9/2015 Kaye
9,131,824 B2 9/2015 Crawford
D741,655 S 10/2015 Whelan et al.
D742,609 S 11/2015 Irwin
D746,009 S 12/2015 Berti
D747,054 S 1/2016 Seifts et al.
D758,878 S 6/2016 Hoeke et al.
D764,129 S 8/2016 Kindler
9,420,933 B1 8/2016 Kellis
D770,848 S 11/2016 Wilson et al.
D775,893 S 1/2017 Buckley et al.
D784,085 S 4/2017 Langston
D790,279 S 6/2017 Izen
D790,342 S 6/2017 Farrell et al.
D792,044 S 7/2017 Harrington
D794,890 S 8/2017 Hoyle
D795,694 S 8/2017 Yefrernow
9,743,819 B2 8/2017 Davidshofer
D796,366 S 9/2017 Talamo
9,795,268 B2 10/2017 Hoyle
D806,338 S 12/2017 Metzel et al.
D835,871 S 12/2018 Breit et al.
D858,020 S 8/2019 Gooden
2002/0144369 A1 10/2002 Biggs
2002/0174641 A1 11/2002 Biggs
2003/0000036 A1 1/2003 Fan
2003/0009839 A1* 1/2003 Streutker ..... A47L 13/42 15/228
2003/0052204 A1 3/2003 Aberegg
2003/0089383 A1 5/2003 Biggs
2003/0103795 A1 6/2003 Hollars et al.
2003/0126710 A1 7/2003 Policicchio
2003/0150478 A1 8/2003 Biggs
2003/0200631 A1 10/2003 Clarke
2004/0046628 A1 3/2004 Hofte et al.
2004/0047670 A1 3/2004 Martin
2004/0055099 A1 3/2004 Greenberg
2004/0071490 A1 4/2004 Vosbikian
2004/0134016 A1 7/2004 Kisela
2004/0134955 A1 7/2004 Williams
2004/0141797 A1 7/2004 Garabedian
2004/0141798 A1 7/2004 Garabedian et al.
2004/0146333 A1 7/2004 Fu
2004/0173656 A1 9/2004 Seong
2004/0178224 A1 9/2004 Fahy et al.
2004/0223803 A1 11/2004 Fahy
2005/0050689 A1 3/2005 Biggs
2005/0058500 A1 3/2005 Hall et al.
2005/0089360 A1 4/2005 Garabedian, Jr.
2005/0095053 A1 5/2005 Harris
2005/0191116 A1 9/2005 Flanery
2005/0205634 A1 9/2005 Han
2005/0251943 A1 11/2005 Van Landingham
2005/0274766 A1 12/2005 Cheng
2006/0008317 A1 1/2006 Livingstone
2006/0039743 A1 2/2006 Mensink
2006/0110207 A1 5/2006 Augustinus Hofte et al.
2006/0151558 A1 7/2006 Higgins
2006/0200924 A1 9/2006 Hampton
2006/0207042 A1 9/2006 Di Paolo
2006/0213017 A1 9/2006 Bele
2006/0222441 A1 10/2006 Tanaka
2006/0245820 A1 11/2006 Kresse et al.
2006/0280546 A1 12/2006 Dyer
2007/0020040 A1 1/2007 Sacks
2007/0140774 A1 6/2007 Dyer
2007/0231046 A1 10/2007 Whiffen
2007/0295758 A1 12/2007 Foster et al.
2008/0038045 A1 2/2008 Hofte et al.
2008/0107471 A1 5/2008 Fitzpatrick et al.

(56) References Cited

U.S. PATENT DOCUMENTS

| | | | |
|---|---|---|---|
| 2009/0176683 | A1 | 7/2009 | Choe et al. |
| 2009/0183591 | A1 | 7/2009 | Jesse |
| 2010/0116861 | A1 | 5/2010 | Burrowes |
| 2011/0064513 | A1 | 3/2011 | Van Landingham |
| 2011/0158740 | A1 | 6/2011 | Kandasamy |
| 2011/0247157 | A1 | 10/2011 | Caillou |
| 2011/0309124 | A1 | 12/2011 | Dubois |
| 2012/0133161 | A1 | 5/2012 | Mitchell |
| 2012/0227763 | A1 | 9/2012 | Hayes |
| 2012/0255138 | A1 | 10/2012 | Dingert |
| 2012/0304408 | A1 | 12/2012 | Crawford et al. |
| 2013/0056467 | A1 | 3/2013 | Shepard et al. |
| 2013/0263398 | A1 | 10/2013 | Irwin et al. |
| 2013/0291893 | A1 | 11/2013 | Stokes |
| 2014/0317868 | A1 | 10/2014 | Fitzpatrick |
| 2015/0082570 | A1 | 3/2015 | Davidshofer |
| 2015/0101140 | A1 | 4/2015 | Pierce |
| 2015/0246440 | A1 | 9/2015 | Balestrieri |
| 2016/0001442 | A1 | 1/2016 | Buzby |
| 2016/0198925 | A1 | 7/2016 | Hoyle |
| 2016/0345793 | A1 | 12/2016 | Hansen |
| 2016/0374256 | A1 | 12/2016 | Chou |
| 2016/0374532 | A1 | 12/2016 | Patterson et al. |
| 2017/0014986 | A1 | 1/2017 | Chou |
| 2017/0049291 | A1 | 2/2017 | Harrington et al. |
| 2017/0049292 | A1 | 2/2017 | Harrington et al. |
| 2017/0157762 | A1 | 6/2017 | Monahan et al. |
| 2017/0296024 | A1 | 10/2017 | Zhu |
| 2018/0103819 | A1 | 4/2018 | Hoyle |
| 2019/0001480 | A1 | 1/2019 | Harrington et al. |
| 2019/0090715 | A1 | 3/2019 | Wildeman et al. |
| 2020/0009715 | A1 | 1/2020 | Moreau et al. |

FOREIGN PATENT DOCUMENTS

| | | | |
|---|---|---|---|
| CN | 202960407 | U | 6/2013 |
| CN | 204158328 | U | 2/2015 |
| CN | 303214007 | | 5/2015 |
| CN | 105266731 | A | 1/2016 |
| EP | 1761155 | B1 | 3/2007 |
| GB | 2381230 | A | 4/2003 |
| JP | D1400629 | A | 10/2010 |
| JP | D1524718 | A | 4/2015 |
| JP | D1545354 | | 3/2016 |
| KR | 3004899850000 | | 5/2008 |
| KR | 3006913060000 | | 5/2013 |
| WO | WO199823385 | A1 | 6/1998 |
| WO | 2006002655 | A1 | 1/2006 |
| WO | 2008137414 | A2 | 11/2008 |
| WO | D098967003 | | 12/2017 |
| WO | D098967005 | | 12/2017 |
| WO | D098967006 | | 12/2017 |

OTHER PUBLICATIONS

AmazonSmile: Spray Mops for Floor Cleaning—New Leader, website 2017, https://smile.amazon.com/Cleaning-New-Leader-Professional-Degree-Hardwood/dp/B077N . . . site visited Jan. 5, 2018.

Bell® Pump™ 300 Blue BMX, website 2018, site visited Aug. 29, 2018, https://www.walmart.com/. . . Fnul&athznid=tic&athieid=v0&athstid=CS020&ATHGUID=4660015-F02e92b6-c338c201a4714605&athena=true.

Pole Part—Unger—TelepPlus, ABC Window Cleaning website2018, https://www.window-cleaning-supply.com/pole-part-unger-teleplus-plus-4-grip/,site visited Sep. 4, 2018.

Staples download, Excella Floor Cleaning Kit, 2018 article reference, https://www.quill.com/unger-excella-microfiber-floor-cleaning-kit-18-holder-efkt1/cbs/55135444.html, site visited Aug. 27, 2019.

Telescopic Pole—4-8' H-1920—Uline, website 2019, https://www.uline.com/Product/Detail/H-1920/Mops-Squeegees-and-Carts/Telescopic-Pole-4-8?keywords=telescopic+pole+-+4-8%27, sited visited Jun. 18, 2019.

Unger erGO! Clean Floor Cleaning Kit Flap Mop, Unger Germany website 2016, https://www.ungerglobal.com/en/ergo-clean-floor-cleaning-kit-flat-mop, site visited Aug. 27, 2019.

Unger erGO! clean floor cleaning kit, website 2016, https://www.ungerglobal.com/en/ergo-clean-floor-cleaning-kit-pocketmop, site visited Jan. 18, 2018.

Unger erGO! Clean Mopping Kit PRO-BCHS website 2019, https://www.bunzlchs.com/Janitorial/Flat-Mopping/Other-Flat-Mopping-Systems/Unger-erGO-Clean-Mopping-Kit-PRO-p-018404, site visited Aug. 27, 2019.

Unger mop video, video date Sep. 19, 2017, site visited Jan. 18, 2018, https://www.youtube.com/watch?v=G42VJEfJTrs.

* cited by examiner

HARD SURFACE CLEANING AND CONDITIONING ASSEMBLIES

CROSS REFERENCE TO RELATED APPLICATIONS

This application is a continuation of U.S. Non-Provisional application Ser. No. 15/238,217 filed on Aug. 16, 2016 which claims the benefit of U.S. Provisional Application No. 62/298,155 filed on Feb. 22, 2016 and claims the benefit of U.S. Provisional Application No. 62/206,072 filed on Aug. 17, 2015, the entire contents of both of which are incorporated by reference herein.

BACKGROUND OF THE INVENTION

1. Field of the Invention

The present disclosure is related to cleaning and conditioning assemblies for hard surfaces. More particularly, the present disclosure is related to cleaning and conditioning assemblies configured to apply one or more conditioning agents to the hard surface with improved ease of use.

2. Description of Related Art

The cleaning and conditioning assemblies for cleaning hard surfaces are known and are used in many commercial and/or residential settings. As used herein, the term "hard surface" shall include surfaces such as, but not limited to, floors, counters, tables, glass, windows, and other hard surfaces.

These assemblies can be used to clean the hard surface by, for example, applying a conditioning agent directly or indirectly to the hard surface. As used herein, the term "conditioning agent" shall include agents such as, but not limited to, water, chemical cleaner, wax, floor finish, sealant, coating (e.g., polyurethane), stripping agent, or any other agent that can condition the surface.

The assemblies can apply the conditioning agent directly to the hard surface or indirectly to a cleaning and/or conditioning tool depending from the assembly or combinations thereof. The tool can include devices such as, but not limited to, a flat or string mop (e.g., cotton, microfiber), a squeegee, a roller, a brush, or any other cleaning and/or conditioning tool.

In some settings, it can be desired to use the assembly to dispense the conditioning agent from a variety of different types of containers. Unfortunately, the prior art assemblies that can be used to dispense conditioning agents from different types of containers have proven difficult to use.

The ease of movement of the assembly, or lack thereof, can be magnified in instances where the total surface area of the surface being conditioned is large—either by virtue of there being a single large surface or multiple smaller surfaces. Stated another way, reducing fatigue by improving the efficiency of motion by increasing the use of larger muscle groups when cleaning is desired when cleaning and conditioning hard surfaces.

Accordingly, it has been determined by the present disclosure that there is a need for hard surface cleaning and conditioning assemblies that overcome, alleviate, and/or mitigate one or more of the aforementioned and other deleterious effects of prior art assemblies.

SUMMARY

Hard surface cleaning and conditioning assemblies are provided that allow the user to use conditioning agent from either a container or a backpack without any conditioning agent being in fluid communication with the dispensing assembly of the assembly. Thus, the cleaning and conditioning assemblies of the present disclosure can prevent cross contamination of conditioning agents and can allow for easy conversion between different conditioning agents without having to purge or empty the assembly.

Hard surface cleaning and conditioning assemblies are provided that increase the ease of movement of the assembly, which can reduce fatigue by improving the efficiency of motion.

A hard surface cleaning and conditioning assembly is provided for use with a removable container having a dispensing valve that moves between a closed state and an open state. The assembly includes a pole; a trigger that moves between a normal position and an activated position; a tool depending from the pole remote from the trigger; and an agent dispensing device depending from the pole. The agent dispensing device has an activation arm operatively coupled to the trigger. The activation arm moving between a first position when the trigger is in the normal position and a second position when the trigger is in the activated position. The agent dispensing device has a housing into which at least a portion of the dispensing valve can be removably positioned to be activated by the activation arm.

In some embodiments either alone or together with the afore or aft mentioned embodiments, the assembly, the first position of the activation arm is not sufficient to move the dispensing valve from the closed state to the open state when the dispensing valve is received in the housing, but the second position of the activation arm is sufficient to move the dispensing valve from the closed state to the open state when the dispensing valve is received in the housing.

In some embodiments either alone or together with the afore or aft mentioned embodiments, the assembly, the agent dispensing device lacks any internal volume that can fluidly communicate with the container when the dispensing valve is received in the housing and is in either the open state or the closed state.

In some embodiments either alone or together with the afore or aft mentioned embodiments, the assembly, the agent dispensing device lacks any valve.

A hard surface cleaning and conditioning assembly for dispensing a conditioning agent is also provided that includes a pole; a trigger depending from the pole for movement between a normal position and an activated position; a tool depending from the pole remote from the trigger; a cap having a valve that moves between a closed state and an open state, the valve being in selective fluid communication with the conditioning agent; and an agent dispensing device depending from the pole proximate the mop head, the agent dispensing device having an arm operatively coupled to the trigger and a housing into which at least a portion of the valve can be received. The activation arm moves between a first position when the trigger is in the normal position and a second position when the trigger is in the activated position. The valve remains in the closed state when the valve is inserted into the dispensing device unless the activation arm is moved to the second position.

In some embodiments either alone or together with the afore or aft mentioned embodiments, the cap is removably connectable directly to a container to place the valve in selective fluid communication with the conditioning agent stored in the container.

In some embodiments either alone or together with the afore or aft mentioned embodiments, the container is a rigid or flexible container.

In some embodiments either alone or together with the afore or aft mentioned embodiments, the cap is removably connectable directly to an adapter that is in fluid communication with a container to place the valve in selective fluid communication with the conditioning agent stored in the container.

In some embodiments either alone or together with the afore or aft mentioned embodiments, the container is a rigid or flexible container.

In some embodiments either alone or together with the afore or aft mentioned embodiments, the agent dispensing device lacks any internal volume that can fluidly communicate with the valve in either the open state or the closed state.

In some embodiments either alone or together with the afore or aft mentioned embodiments, the agent dispensing device lacks any valve.

In some embodiments either alone or together with the afore or aft mentioned embodiments, the conditioning agent is selected from the group consisting of water, chemical cleaner, wax, disinfectant, sanitizer, sealant, stripping agent, a conditioning agent, a conditioning agent, and any combinations thereof.

In some embodiments either alone or together with the afore or aft mentioned embodiments, the conditioning agent is dispensed under the force of gravity.

In some embodiments either alone or together with the afore or aft mentioned embodiments, the pole has an adjusting device that adjusts a length of the pole.

In some embodiments either alone or together with the afore or aft mentioned embodiments, the adjusting device is between the trigger and the agent dispensing device.

In some embodiments either alone or together with the afore or aft mentioned embodiments, the assembly can include a top-hand grip having a portion with the trigger disposed thereon.

In some embodiments either alone or together with the afore or aft mentioned embodiments, the portion of the top-hand grip that includes the trigger is rotatable with respect to the pole.

In some embodiments either alone or together with the afore or aft mentioned embodiments, the assembly includes a bottom-hand grip that is rotatable with respect to the pole.

In some embodiments either alone or together with the afore or aft mentioned embodiments, the activation arm rotates between the first and second positions or moves linearly between the first and second positions.

A method of applying a conditioning agent to a hard surface is also provided. The method includes: placing a cap having a dispensing valve directly on a container having the conditioning agent stored therein or onto an adapter that is in fluid communication with a container having the conditioning agent stored therein; installing the cap into an agent dispensing device depending from a hard surface cleaning and conditioning assembly, the agent dispensing device lacking any internal volume or valve that can fluidly communicate with the conditioning agent; and moving a trigger of the hard surface cleaning and conditioning assembly, the trigger being operatively connected to an arm so as to move the arm into contact with the dispensing valve so as to open the dispensing valve and dispense the conditioning agent.

A hard surface cleaning and conditioning assembly is provided that includes a pole having a lower section and an upper section; an adjusting device securing the upper and lower sections to one another in a telescoping manner; a tool depending from the lower section; a conditioning agent dispensing device depending from the lower section; a trigger depending from the upper section; and a telescoping trigger assembly operatively connecting the dispensing device to the trigger.

In some embodiments either alone or together with the afore or aft mentioned embodiments, the pole includes a bent portion joining the lower and upper sections to one another. The lower section defines a primary axis and the upper section defines a secondary axis. The primary and secondary axes are substantially parallel to one another and offset from one another.

In some embodiments either alone or together with the afore or aft mentioned embodiments, the agent dispensing device defines a tertiary axis, with the primary, secondary, and tertiary axes being substantially parallel to one another and offset from one another.

In some embodiments either alone or together with the afore or aft mentioned embodiments, the primary axis is positioned between the secondary and tertiary axes.

In some embodiments either alone or together with the afore or aft mentioned embodiments, the assembly can include a bottom-hand grip on the lower section. The bottom-hand grip rotates about the primary axis.

In some embodiments either alone or together with the afore or aft mentioned embodiments, the bottom-hand grip rotates about the primary axis by less than 360 degrees.

In some embodiments either alone or together with the afore or aft mentioned embodiments, the assembly can include a top-hand grip on the upper section. The top-hand grip has a portion that includes the trigger, where the portion rotates about the secondary axis.

In some embodiments either alone or together with the afore or aft mentioned embodiments, the upper section and the bent region are formed of one unitary member and the upper and lower sections are secured to one another by the adjusting device.

In some embodiments either alone or together with the afore or aft mentioned embodiments, the agent dispensing device is connectable either directly to a container and/or directly to an adapter that is in fluid communication with a container.

In some embodiments either alone or together with the afore or aft mentioned embodiments, the dispensing device dispenses fluid from the container via gravity.

In some embodiments either alone or together with the afore or aft mentioned embodiments, the telescoping trigger assembly includes a shaft connected to the dispensing assembly and a pivot connected to the trigger. The pivot is biased out of engagement with the shaft but is movable, in response to movement of the trigger, into engagement with the shaft.

In some embodiments either alone or together with the afore or aft mentioned embodiments, the shaft lacks any teeth and is frictionally engaged by the pivot when the pivot is moved, in response to movement of the trigger, into engagement with the shaft.

In some embodiments either alone or together with the afore or aft mentioned embodiments, the shaft has teeth on at least one side that are engaged by the pivot when the pivot is moved, in response to movement of the trigger, into engagement with the shaft.

A hard surface cleaning and conditioning assembly is also provided that includes a pole, an adjusting device, a tool, a conditioning agent dispensing device, a trigger, and a top-hand grip. The pole has a lower section, an upper section, and a bent region. The lower section defines a primary axis and the upper section defines a secondary axis, where the primary and secondary axes are substantially parallel to one another and offset from one another. The adjusting device secures the upper and lower sections to one another in a telescoping manner. The tool depends from the lower section. The conditioning agent dispensing device depends from the lower section. The trigger depends from the upper section and is operatively connected to the agent dispensing device. The top-hand grip has a portion that rotates about the secondary axis.

In some embodiments either alone or together with the afore or aft mentioned embodiments, the assembly can include a bottom-hand grip on the lower section, where the bottom-hand grip that rotates about the primary axis.

In some embodiments either alone or together with the afore or aft mentioned embodiments, the bottom-hand grip rotates about the primary axis by between about 140 and 240 degrees.

In some embodiments either alone or together with the afore or aft mentioned embodiments, the agent dispensing device defines a tertiary axis, the primary, secondary, and tertiary axes that are substantially parallel to one another and offset from one another.

In some embodiments either alone or together with the afore or aft mentioned embodiments, the primary axis is between the secondary and tertiary axes.

In some embodiments either alone or together with the afore or aft mentioned embodiments, the agent dispensing device is connectable either directly to a container and/or directly to an adapter that is in fluid communication with a container.

In some embodiments either alone or together with the afore or aft mentioned embodiments, dispensing device dispenses fluid from the container via gravity.

In some embodiments either alone or together with the afore or aft mentioned embodiments, the trigger is on the portion of the top-hand grip that rotates about the secondary axis.

In some embodiments either alone or together with the afore or aft mentioned embodiments, the assembly can include a telescoping trigger assembly operatively connecting the dispensing device to the trigger, wherein the telescoping trigger assembly comprises a shaft connected to the dispensing assembly and a pivot connected to the trigger, wherein the pivot is biased out of engagement with the shaft but is movable, in response to movement of the trigger, into engagement with the shaft.

In some embodiments either alone or together with the afore or aft mentioned embodiments, the shaft either includes or lacks teeth.

A hard surface cleaning and conditioning assembly is also provided that includes a pole, a tool, and an agent dispensing device. The pole has a lower section and an upper section joined to one another by a bent portion. The lower section defines a primary axis and the upper section defines a secondary axis. The tool and the agent dispensing device depend from the lower section. The agent dispensing device defines a tertiary axis. The primary, secondary, and tertiary axes are substantially parallel to one another and offset from one another with the primary axis being positioned between the secondary and tertiary axes.

An assembly is also provided that includes a pole having a lower section and an upper section, an adjusting device securing the upper and lower sections to one another in a telescoping manner, a trigger depending from the upper section, an activatable assembly depending from the lower section, and a telescoping trigger assembly operatively connecting the trigger to the activatable assembly. The telescoping trigger assembly includes a smooth shaft connected to the activatable assembly and a pivot connected to the trigger. The pivot is biased out of engagement with the shaft but is movable, in response to movement of the trigger, into frictional engagement with the shaft.

The above-described and other features and advantages of the present disclosure will be appreciated and understood by those skilled in the art from the following detailed description, drawings, and appended claims.

DETAILED DESCRIPTION

Figure 1:
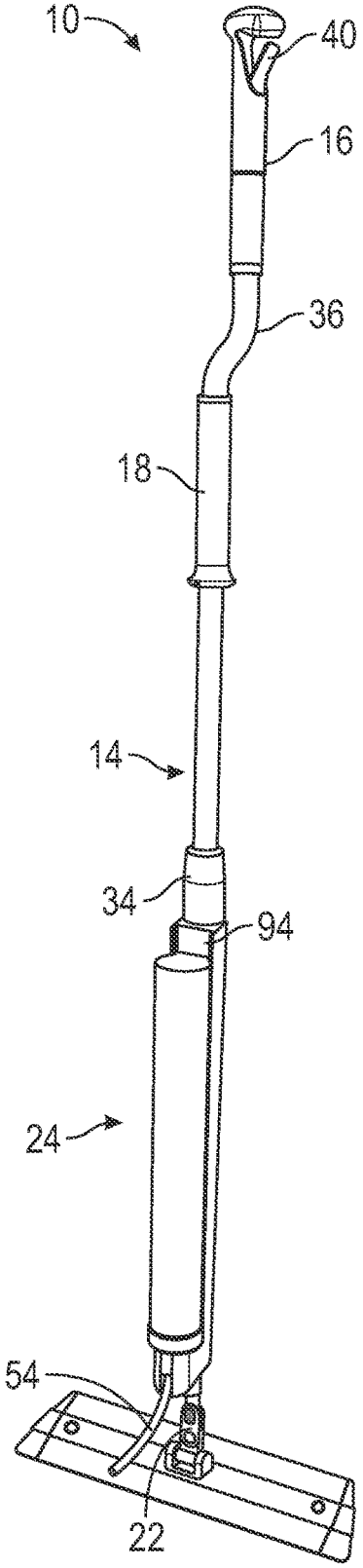
FIG. 1 is a perspective view of an exemplary embodiment of a hard surface cleaning and conditioning assembly according to the present disclosure—illustrated in use with a container for a conditioning agent.

Referring to the drawings and in particular to FIGS. 1-4, an exemplary embodiment of a hard surface cleaning and conditioning assembly according to the present disclosure is shown and is generally referred to by reference numeral 10.

Assembly 10 includes a cleaning and/or conditioning tool 12, a pole 14, a top-hand grip 16, a bottom-hand grip 18, and an agent dispensing device 20. Tool 12 is secured to pole 14 by a universal joint 22. Here, tool 12 is shown by way of example as a flat mop.

Figure 2:
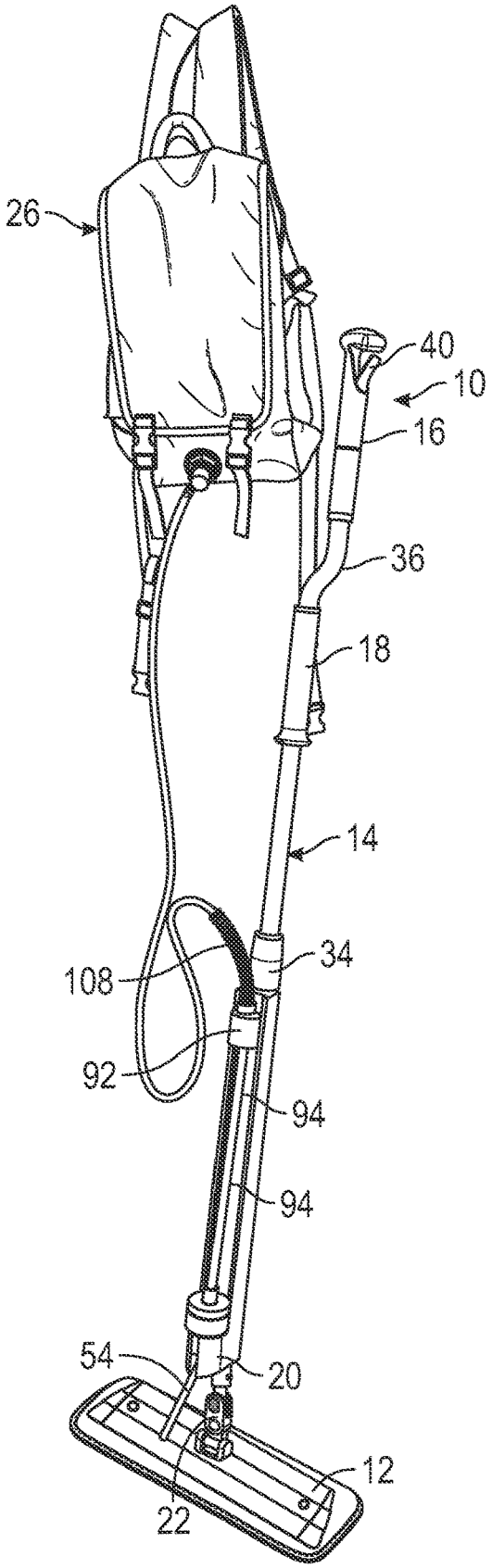
FIG. 2 is a perspective view of the assembly of FIG. 1—illustrated in use with a backpack for a conditioning agent.
Figure 3:
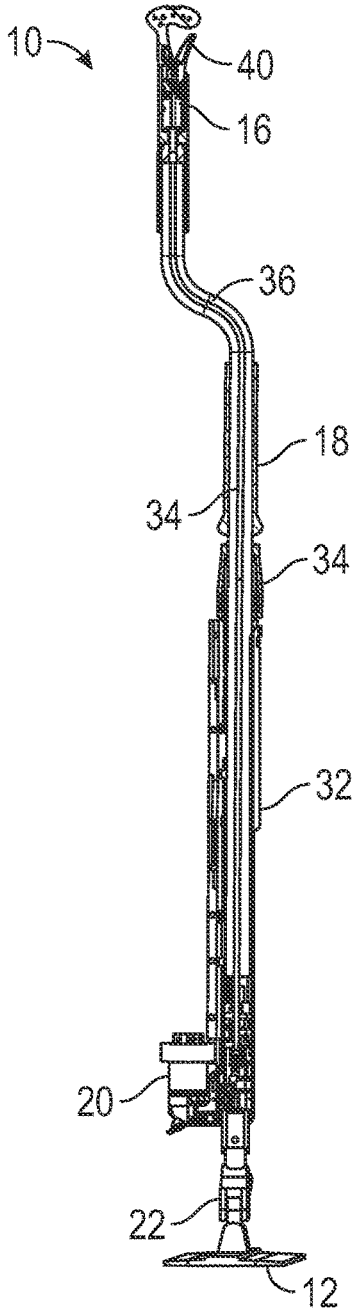
FIG. 3 is a side view of the assembly of FIGS. 1 and 2 before connection with any conditioning agent container and having the extension handle in a first or reduced length state.
Figure 4:
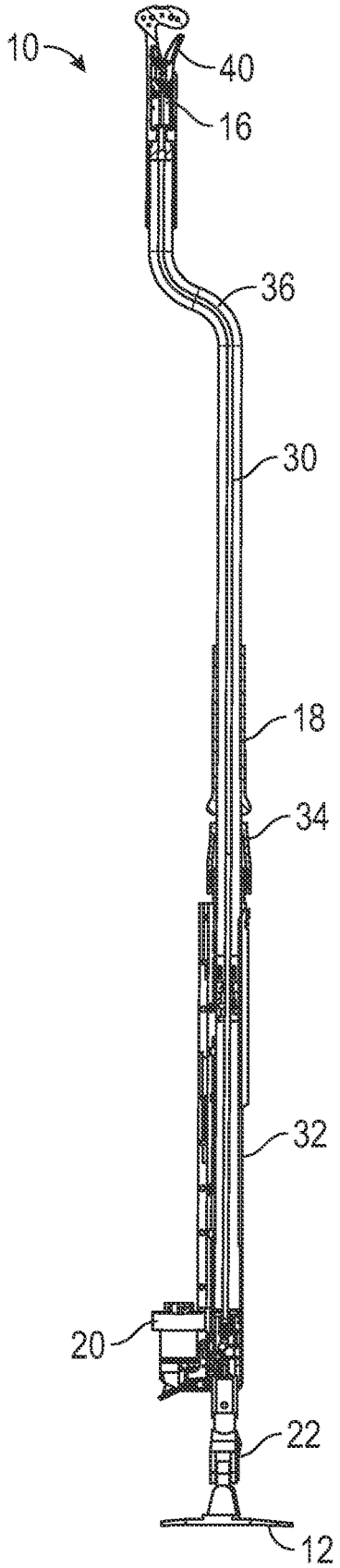
FIG. 4 is a side view of the assembly of FIG. 3 having the extension handle in a second or extended state.

Assembly 10 is configured to clean or condition a hard surface by applying one or more conditioning agents directly to the hard surface or indirectly to the hard surface by applying the conditioning agent to tool 12 or by applying the conditioning agent to a combination of the hard surface and the tool. Advantageously, assembly 10 is easily configurable to dispense the conditioning agent under the force of gravity from either a container 24 as in FIG. 1 that is directly secured to the assembly or from a container, illustrated as a backpack 26, as illustrated in FIG. 2 that is remove from the assembly as are described in more detail below.

Of course, it is contemplated by the present disclosure for assembly 10 to force the conditioning agent from container 24 and/or backpack 26 under pressure as a pump or spray in any desired form such as, but not limited to, a mist, a stream, a foam, and others.

Assembly 10 is configured, in some embodiments, such that pole 14 has an adjustable length. For example, pole 14 is illustrated have a top section 30 and a bottom section 32 that are slidably joined to one another in a known manner by an adjusting device 34. In this manner, the user can use adjusting device 34 to release top and bottom sections 30, 32 for sliding movement to any length between a first length shown in FIG. 3 and a second length shown in FIG. 4. Once pole 14 has been adjusted to the desired length, the user can use adjusting device 34 to secure top and bottom sections 30, 32 in position.

In the illustrated embodiment, top-hand grip 16 includes a dispensing trigger 40 operably connected to agent dispensing device 20. Here, it should be recognized that assembly 10 is configured to maintain the operable connection between dispensing device 20 and trigger 40 throughout the range of length adjustments of pole 14 as described in detail below.

Additionally, assembly 10 is configured so that top and bottom hand grips 16, 18 are secured to pole 14 in a rotatable manner, a non-rotatable manner, and/or rotatable along a predefined range of motion. In embodiments where top-hand grip 16 is rotatably connected to pole 14 and includes trigger 40, assembly 10 is further configured to maintain the operable connection between dispensing device 20 and the trigger 40 throughout the range of rotation of the top-hand grip and the pole as described in detail below.

Pole 14 can be configured, in some embodiments, so that at least one of top and bottom sections 30, 32 have a bent region 36 to assist the desired use of assembly 10. It should be recognized that pole 14 is illustrated by way of example only having bent region 36 in top section 30. Of course, it is contemplated by the present disclosure for only bottom section 32 to have bent region 36 or for both top and bottom sections 30, 32 to have the bent region 36. Additionally, it is contemplated by the present disclosure for pole 14 to have bent region 36, but to be non-telescopic (i.e., a fixed length). Further, it is contemplated by the present disclosure for pole 14 to be a straight pole—with or without telescoping sections 30, 32.

In some embodiments, bent region 36 is positioned proximate to top-hand grip 16 with both the top and bottom handgrips 16, 18 being rotatable about pole 14. In other embodiments, pole 14 is a straight pole—namely one that lacks bent region 36—and includes both top and bottom hand grips 16, 18 that are fixed, rotate, or combinations thereof.

Figure 5A:
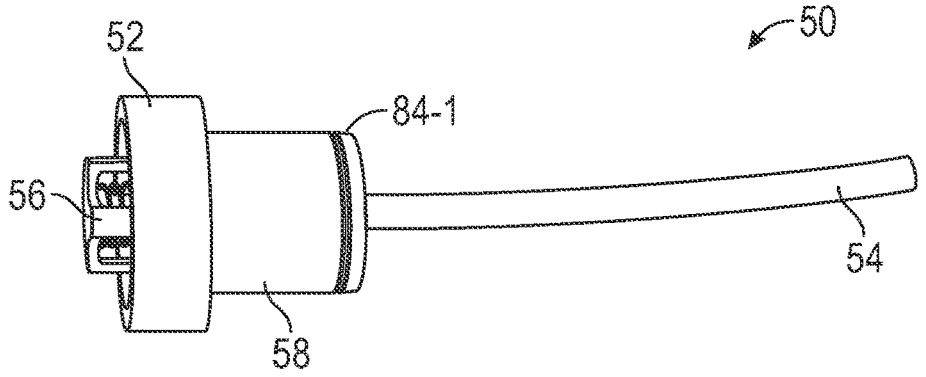
FIG. 5*a* is a perspective view of a dispensing cap for use with the assembly of FIGS. 1 and 2.
Figure 5B:
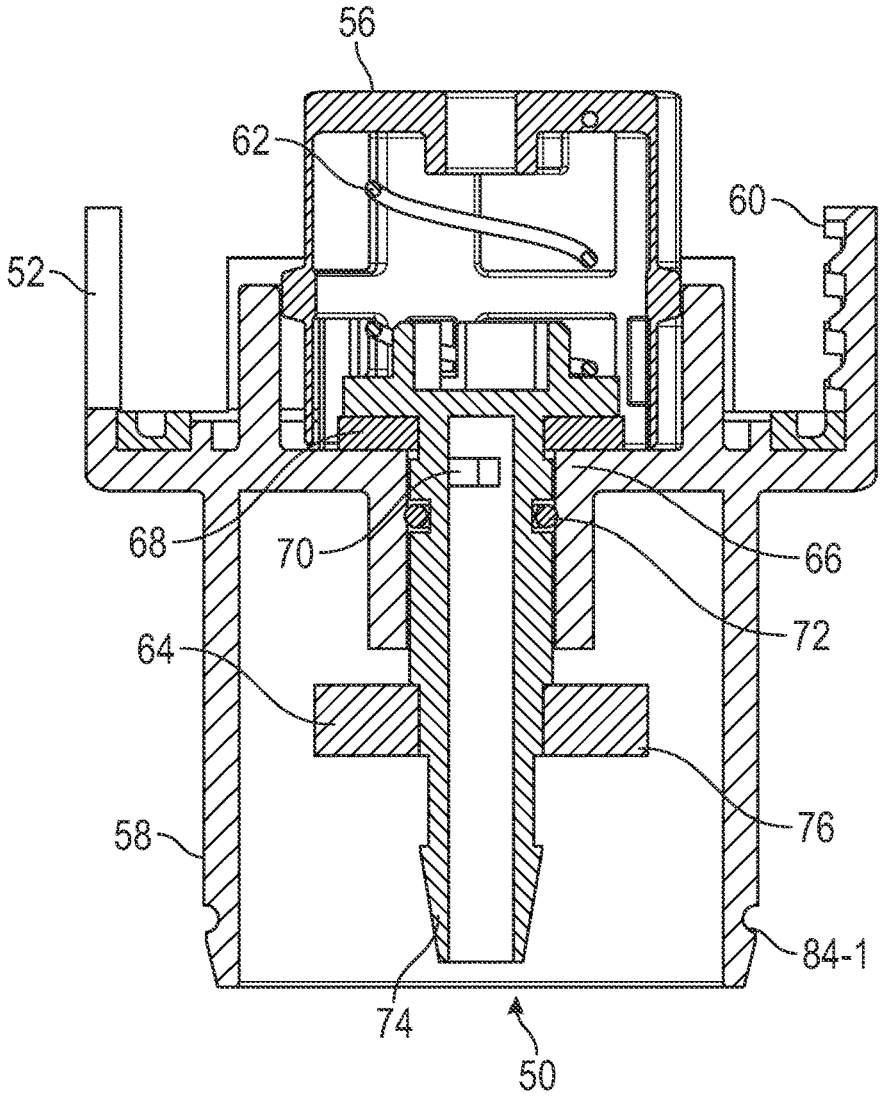
FIG. 5*b* is a partial sectional view of the dispensing cap of FIG. 5*a* in a closed position.
Figure 5C:
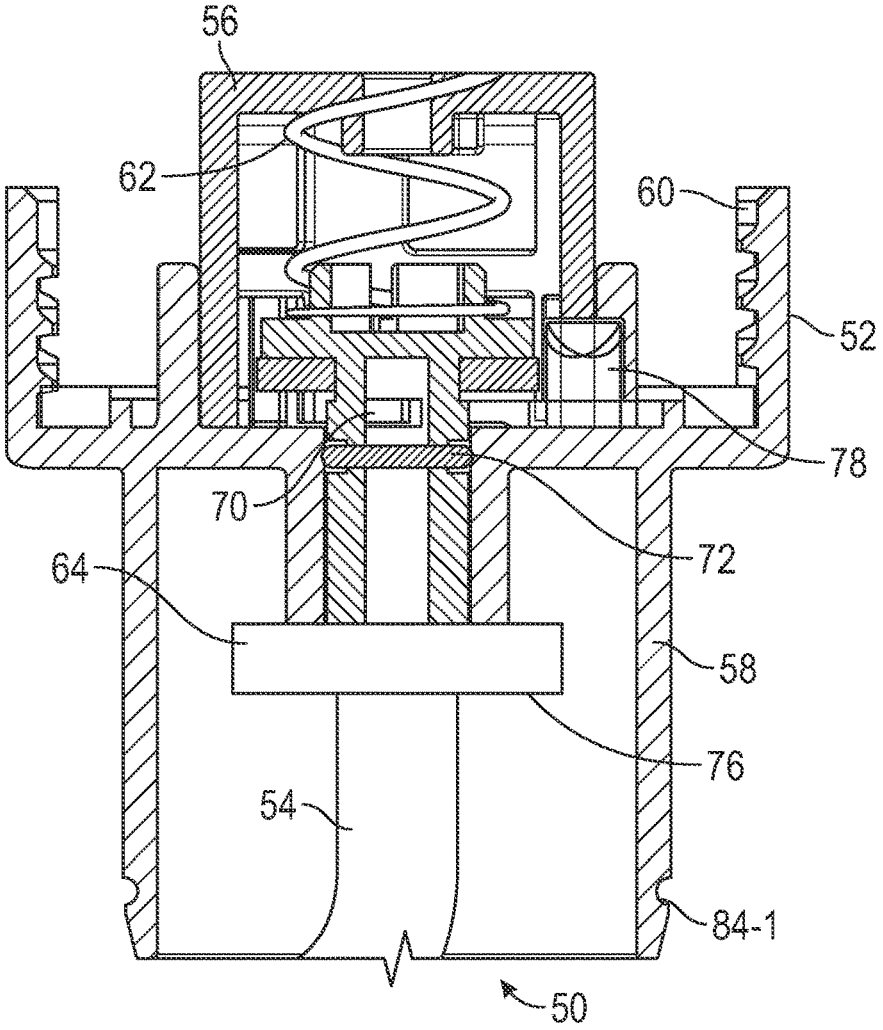
FIG. 5*c* is a partial sectional view of the dispensing cap of FIG. 5*a* in an open position.

Assembly 10 advantageously includes a dispensing cap 50 shown in FIGS. 5*a*, 5*b*, and 5*c* that is configured for operative connection between dispensing device 20 and either directly to container 24 or indirectly to backpack 26.

Dispensing cap 50 includes an upper shroud 52, a dispensing tube 54, a sealing valve 56, and, in some embodiments, a lower shroud 58.

Upper shroud 52 is configured to be releasably secured directly to container 24 or indirectly to backpack 26 in a fluid tight manner. In the illustrated embodiment, cap 50 includes a thread 60 on upper shroud 52 that is connectable to container 24 or backpack 26 as described in more detail below.

Valve 56 is biased to a normally closed position by, for example, a compression spring 62. Spring 62 biases a valve stem 64 against a valve face 66 to prevent fluid from passing through valve 56. In some embodiments, valve 56 further includes a seal or gasket 68 between valve stem 64 and valve face 66 to prevent or mitigate leakage. In a preferred embodiment, face 66 and seal 68 are configured to provide two states—no flow and full flow.

Valve stem 64 is slidably positioned in face 66 to move from the closed position (FIG. 5*b*) to an open position (5*c*) where an input opening 70 can receive the conditioning agent from container 24 or backpack 26. Valve stem 64 can, in some embodiments, include an o-ring seal 72 sealing the valve stem in the valve. Input opening 70 is in fluid communication with an outlet opening 74, illustrated as a hose barb, having dispensing tube 54 secured thereto.

Valve stem 64 further includes an activation surface 76, which mates with dispensing device 20 to allow the dispensing device to move the valve stem to the open position and, be returned to the closed position by spring 62 once pressure from the dispensing device is removed from the activation surface. In embodiments having lower shroud 58, the shroud can protect or otherwise protect valve stem 64 and/or surface 76 from inadvertent activation.

In some embodiments, dispensing cap 50 can include a vent valve 78—shown in FIG. 5*c*—that allows atmospheric air into the assembly when dispensing from container 24 or backpack 26.

The interconnection between agent dispensing device 20 and dispensing cap 50 in use with container 24, is described with simultaneous reference to FIGS. 5*a*-5*c*, 6, and 7*a*-7*d*, while the interconnection between agent dispensing device 20 and the dispensing cap in use with backpack 26 is described with simultaneous reference to FIGS. 5, 8*a*-*c*, and 9*a*-9*f*. Here, container 24 is illustrated by way of example as a rigid container having vent valve 78. Of course, it is contemplated by the present disclosure for container 24 to include a flexible inner pouch housed within a rigid outer member—where the inner pouch does not require any vent.

Figure 6:
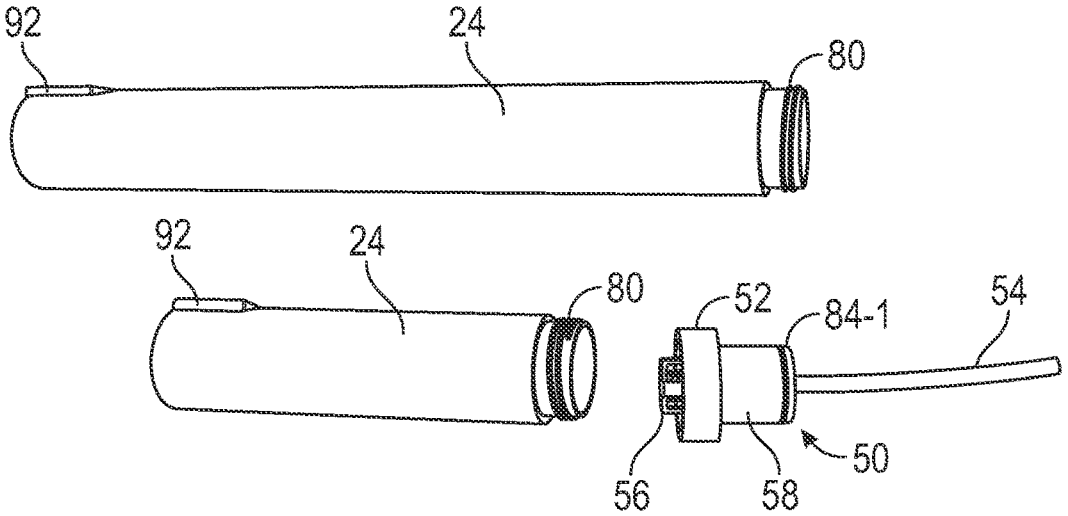
FIG. 6 is a disassembled view of two different sized containers configured for use with the assembly as shown in FIG. 1.

Beginning with the use of containers 24, dispensing cap 50 can be secured directly to containers of predetermined sizes as shown in FIG. 6. Dispensing cap 50, via upper shroud 52, is releasably securable directly to container 24 in a fluid tight manner with valve 56 housed within the container. In embodiment where cap 50 includes thread 60 on upper shroud 52, containers 24 include a similarly sized threaded opening 80.

Container 24 having dispensing cap 50 secured thereto can be releasably secured to dispensing device 20 of assembly 10 as shown in FIGS. 7*a*-7*d*.

Figure 7A:
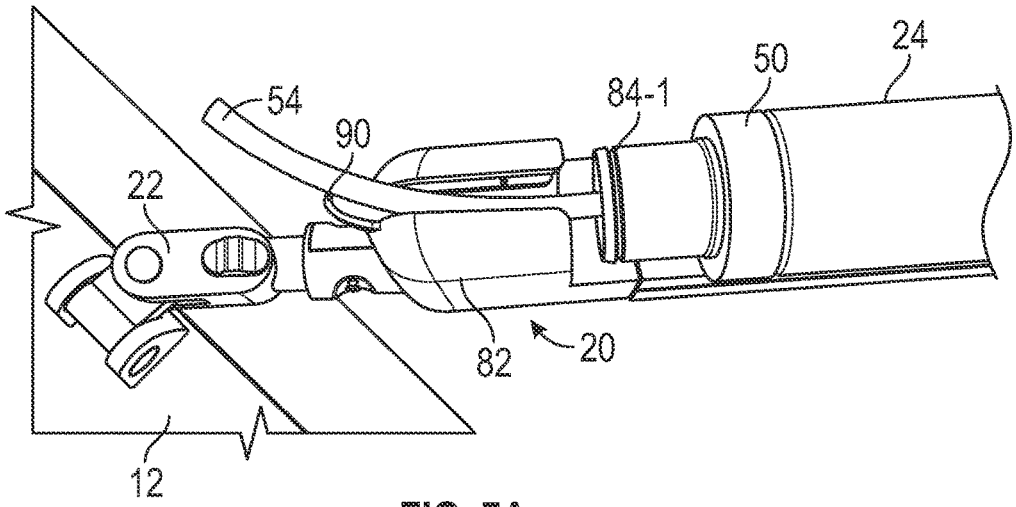
FIG. 7*a* illustrates the assembly of FIG. 1 before installation of a container.
Figure 7B:
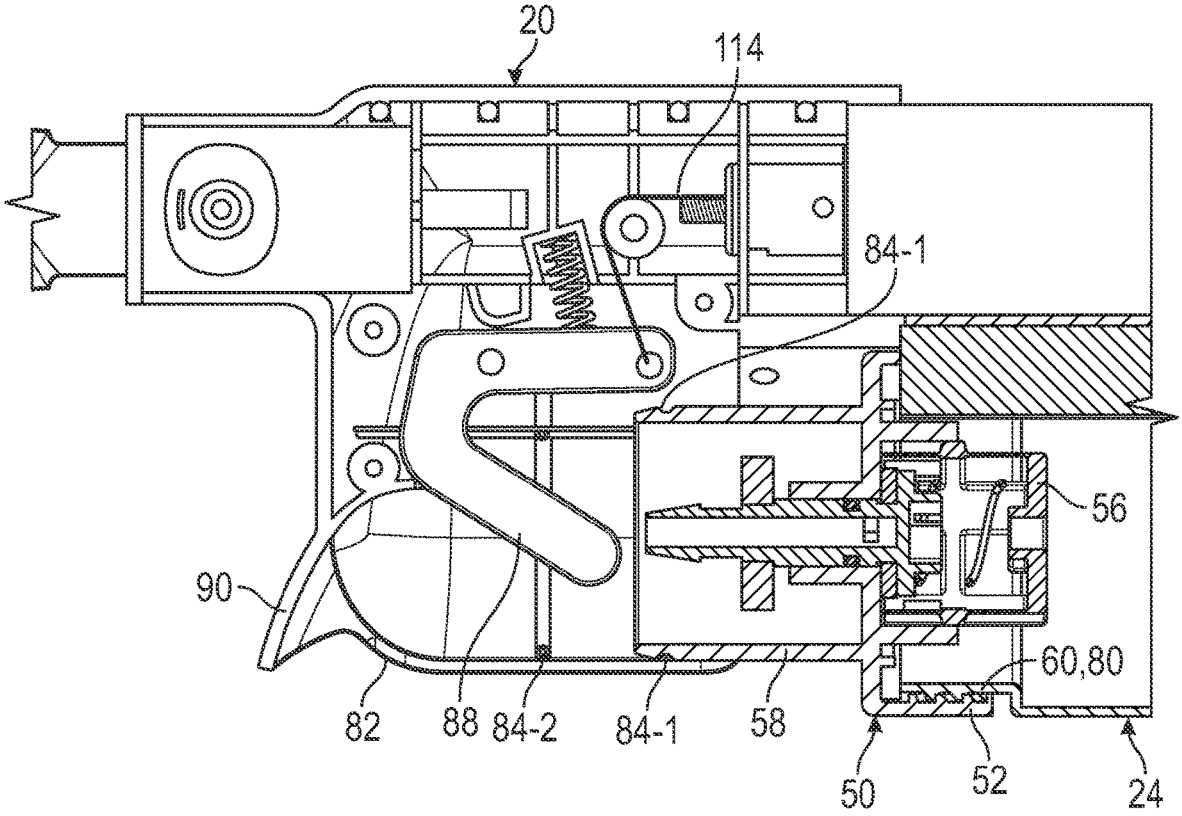
FIG. 7*b* is a partial sectional view of the assembly of FIG. 7*a;*
Figure 7C:
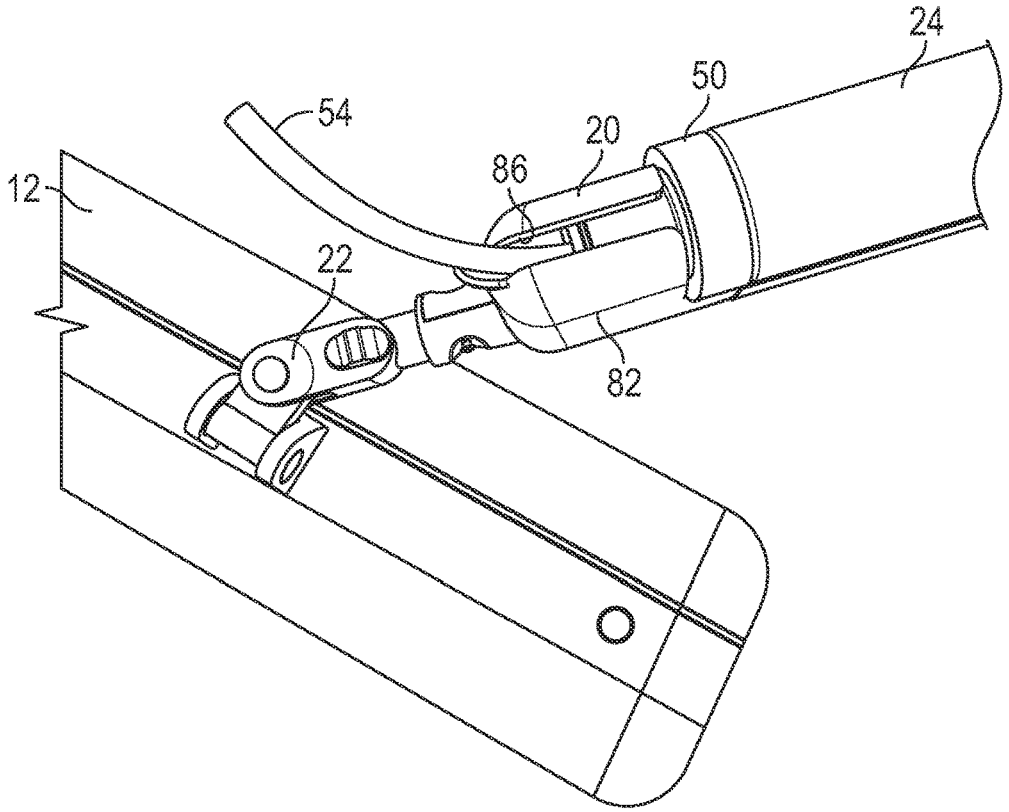
FIG. 7*c* illustrates the assembly of FIG. 1 after installation of the container.
Figure 7D:
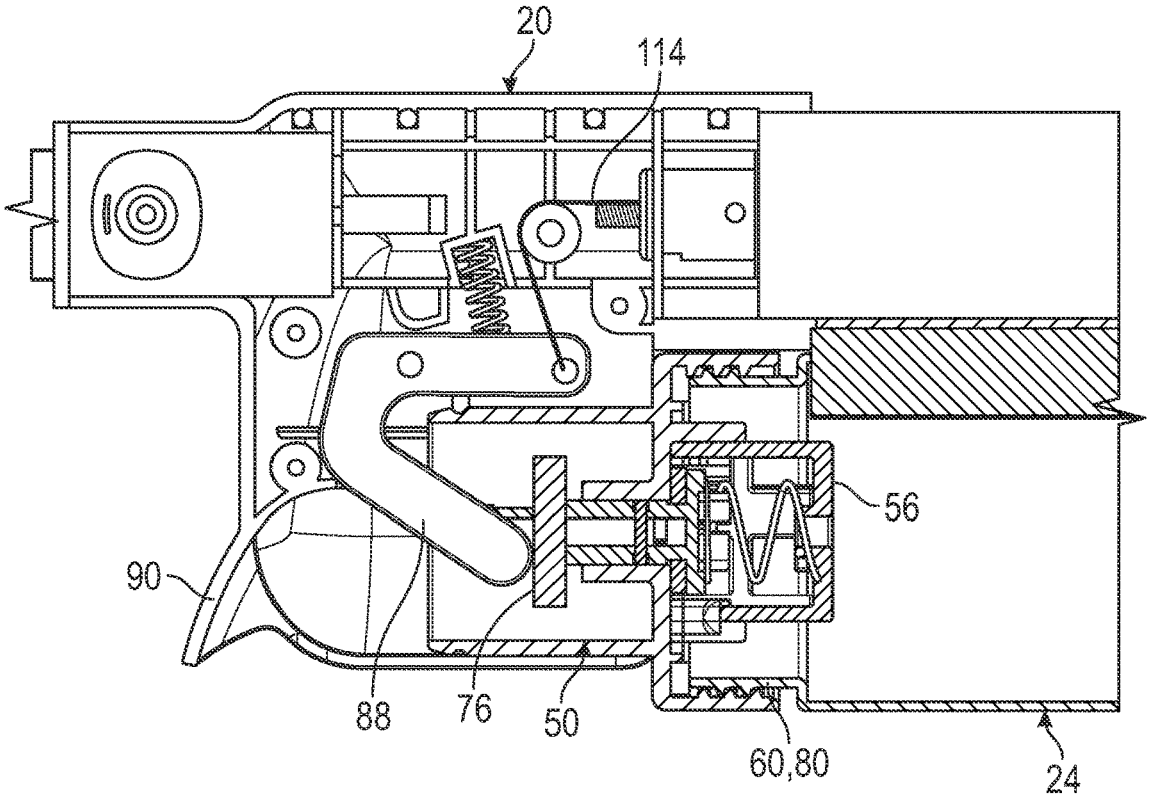
FIG. 7*d* is a partial sectional view of the assembly of FIG. 7*c;*

Dispensing device 20 includes a housing 82 into which lower shroud 58 of dispensing cap 50 is received. Shroud 58 and housing 82 can, in some embodiments, include matching interlocking features 84-1, 84-2 that form an interference fit once container 24 is seated within housing 82. The interference fit between features 84-1, 84-2 can provide an audible and/or tactile indicia to the user that container 24 is properly installed in housing 82. Once installed, activation surface 76 of dispensing cap 50 is positioned adjacent to an activation arm 88 of dispensing device 20 as shown in FIG. 7*d*. Preferably, features 84-1, 84-2 provide sufficient holding force to cap 50 to prevent inadvertent withdrawal of the cap from dispensing device 20 during activation by arm 88 on surface 76.

In the illustrated embodiment, feature 84-1 is shown as an indentation on cap 50, while feature 84-2 is shown as a rib on dispensing device 20—where the features form a releasable interference fit with one another when assembled. Of course, it is contemplated by the present disclosure for features 84-1, 84-2 to be any interacting features that removably secure cap 50 and dispensing device 20 to one another including a mechanism that requires more than one interaction/application of force.

As used herein, the term activation arm 88 can mean and device or assembly of devices, such as, but not limited to rotating arms (e.g., levers), linkages, and the like that allow selective contact with activation surface 76 upon activation of trigger 40.

In some embodiments, housing 82 can include a slot 86 configured to receive dispensing tube 54. In this manner, installation of container 24 into dispensing device 20 simply requires aligning tube 54 with slot 86 and sliding the container into housing 82 until features 84-1, 84-2 engage one another. Conversely, removal of container 24 from dispensing device 20 simply requires withdrawing the container from housing 82 after features 84-1, 84-2 are disengaged from one another.

Additionally, housing 82 can include a guide 90 positioned to support dispensing tube 54 once container 24 is installed in dispensing device 20. Guide 90 can ensure that agent released from container 24 is guided from dispensing tube 54 in a desired location with respect to tool 12.

Advantageously, assembly 10 having easily connectable dispensing device 20 and dispensing cap 50 eliminates any residual agent from being present in the assembly after removal of container 24. Stated another way, all of the agent is retained by cap 50 within container 24. Stated another way, once cap 50 is removed from dispensing device 20 there is no agent remaining in assembly 10.

In some embodiments, the end of container 24 opposite threaded opening 80 can include a retaining feature 92, illustrated as a dovetail in FIG. 6. Assembly 10 can include a matching feature 92 positioned to slidably receive feature 92 as shown in FIG. 1. In this manner, container 24 is secured to assembly 10 at both ends—by feature 84-1 at cap 50 and by feature 92 at the end of the container opposite the cap. When assembly 10 is configured to receive containers 24 of different lengths, the assembly can include feature 92 as an elongated channel with reliefs 94 (FIG. 2) positioned at appropriate locations to minimize the travel of features 92 with respect to one another.

Of course, it should be recognized that features 92 are illustrated by way of example only as dovetails and corresponding grooves. Thus, it is contemplated by the present disclosure for features 92 to have any desired interlocking shapes or structures.

In embodiments where features 92 are dovetails and grooves, it is contemplated by the present disclosure for length of engagement of the features to be optimized to achieve the desired retention as well as minimize the insertion depth required during installation of cap 50 into dispensing device 20. It is also contemplated by the present disclosure for features 92 to be two dovetails spaced apart from one another—along with corresponding grooves—that increase the surface area of engagement but do not increase the stroke required to install cap 50 into dispensing device 20.

Figure 8A:
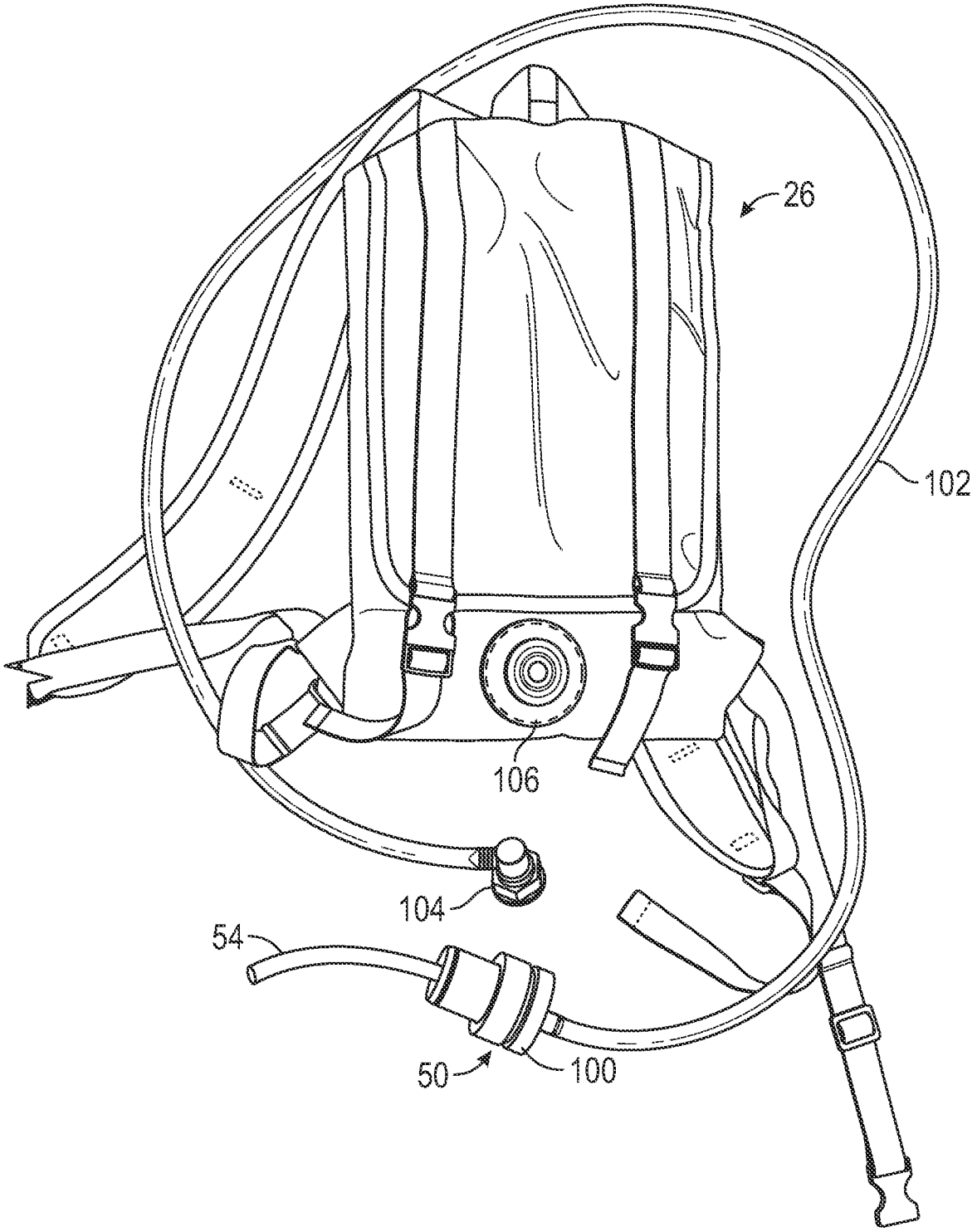
FIG. 8*a* is a disassembled view of a backpack configured for use with the assembly as shown in FIG. 2 and the dispensing cap.
Figure 8B:
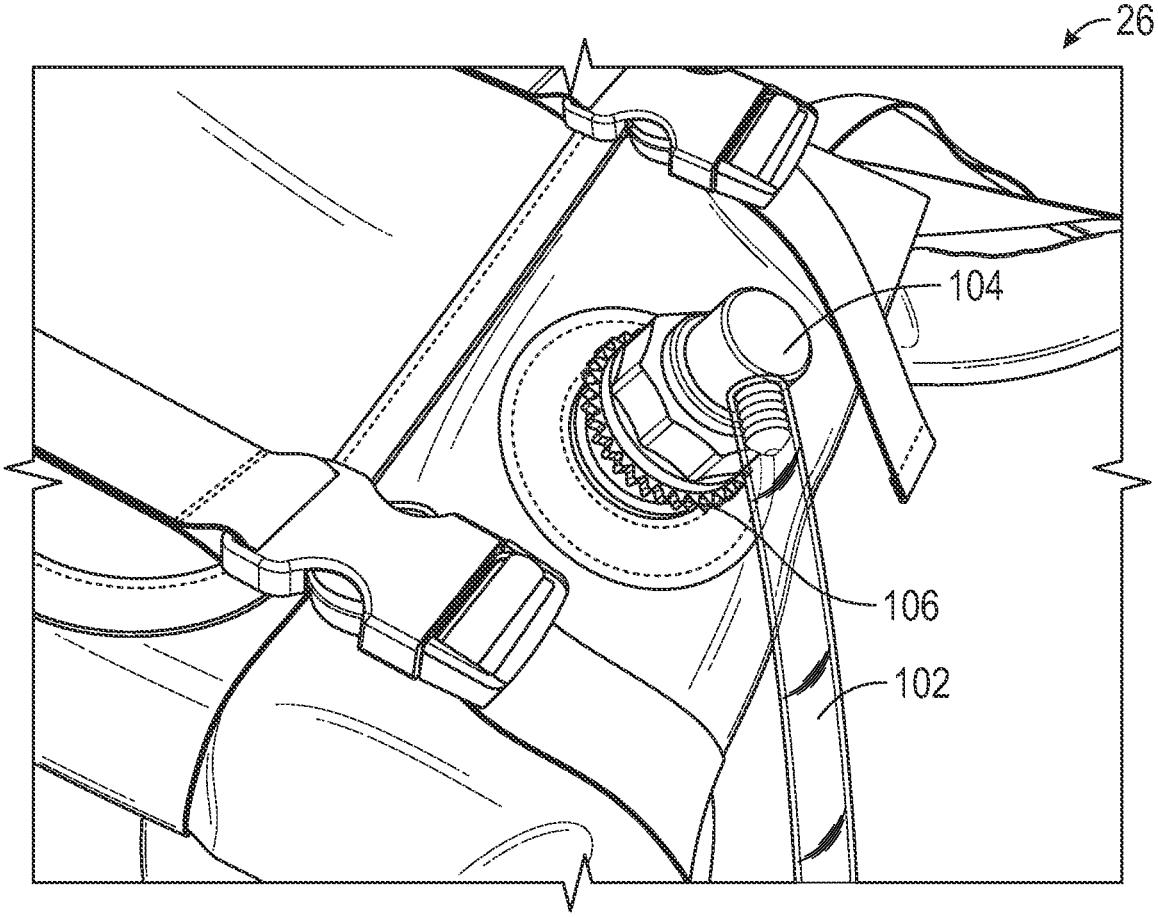
FIG. 8*b* is a magnified assembled view of a first portion of the backpack of FIG. 8*a;*
Figure 8C:
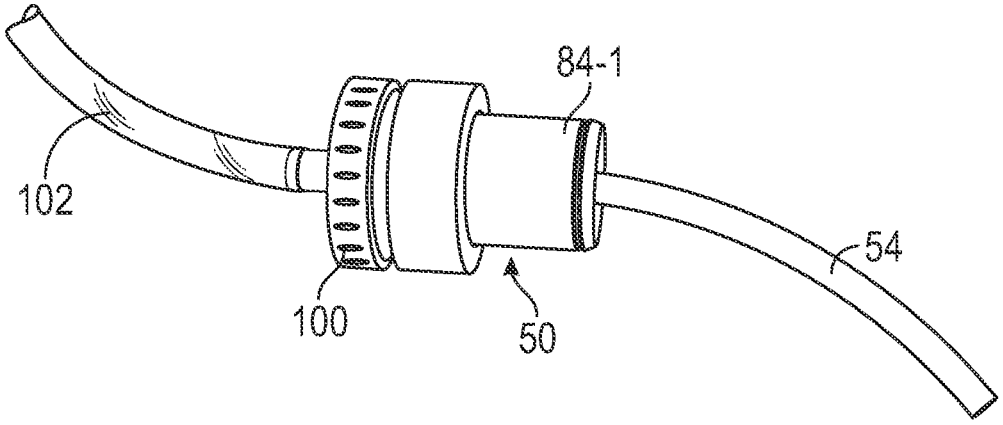
FIG. 8*c* is a magnified assembled view of a second portion of the backpack of FIG. 8*a;*

Turning now to the use of backpack 26, dispensing cap 50 can be indirectly secured to the backpack as shown in FIGS. 8*a*, 8*b*, and 8*c*. Here, dispensing cap 50, via upper shroud 52, is releasably securable to an adapter 100 in a fluid tight manner with valve 56 housed between the cap and the adapter. In embodiment where cap 50 includes thread 60 on upper shroud 52, adapter 100 includes a threaded end 80-1 a similarly sized to threaded end 80 of container 24. Of course, it is contemplated by the present disclosure for adapter 100 to be connected to cap 50 in any desired fluid tight manner.

Adapter 100 is configured to place cap 50 into fluid communication with backpack 26. Specifically, adapter 100 further includes a conduit 102 in communication with backpack 26. In some embodiments, adapter 100 can include a secondary cap 104 that removably mates with a port 106 on backpack 26. In this manner, backpack 26 can support the conditioning agent therein or can include a replaceable container (not shown) that is installed and removed from the backpack as needed. The replaceable container can be in rigid form with a vent valve or flexible form such as a flexible pouch that does not require venting. In some embodiments, port 106 can be a valved port, which is opened by connection of secondary cap 104 or by any other desired method.

Backpack 26 having dispensing cap 50 and adapter 100 is shown before and after being secured to dispensing device 20 of assembly 10 in FIGS. 9*a*-9*f*.

Figure 9A:
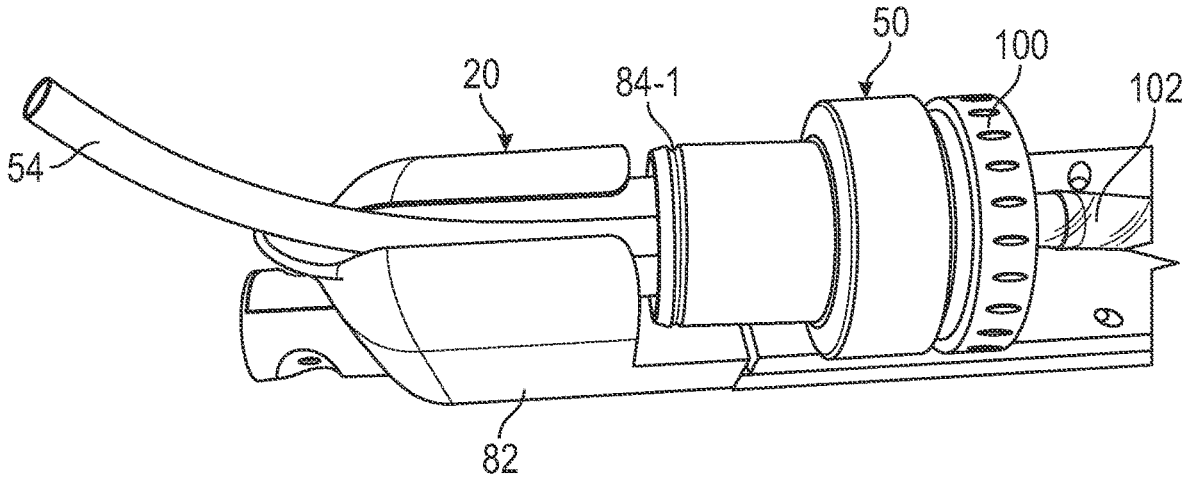
FIG. 9*a* illustrates the assembly of FIG. 2 before installation of the backpack adapter.
Figure 9B:
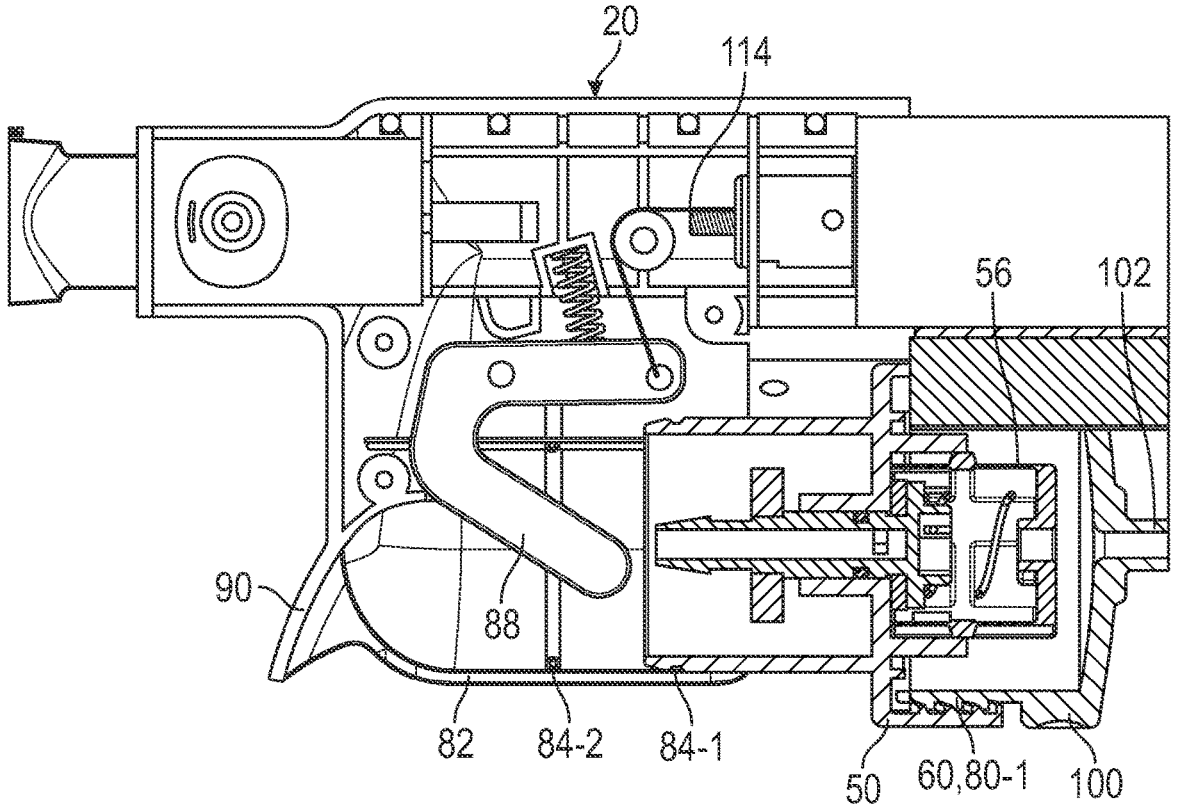
FIG. 9*b* is a partial sectional view of the assembly of FIG. 9*a;*
Figure 9C:
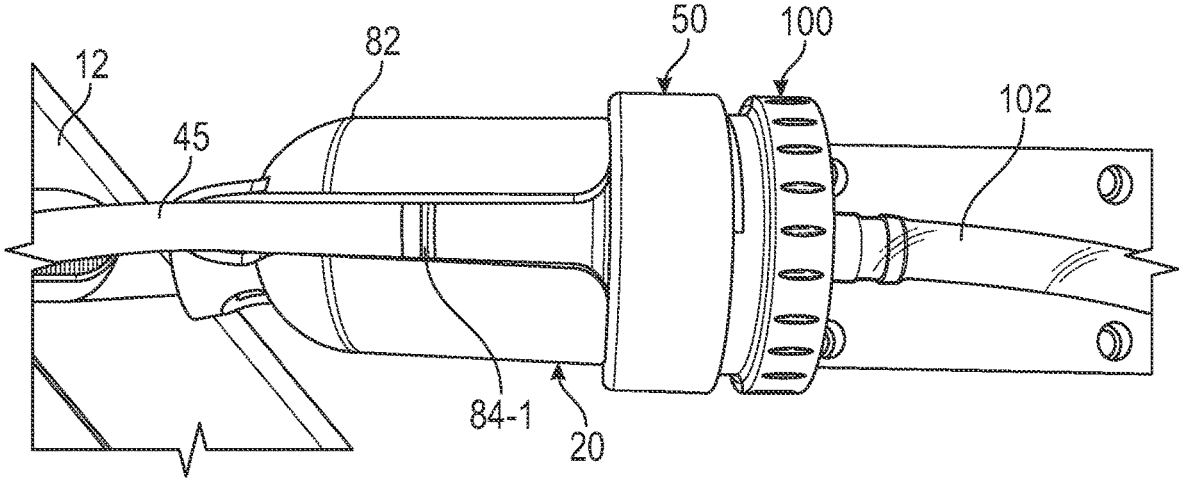
FIG. 9*c* illustrates the assembly of FIG. 2 after installation of the backpack.
Figure 9D:
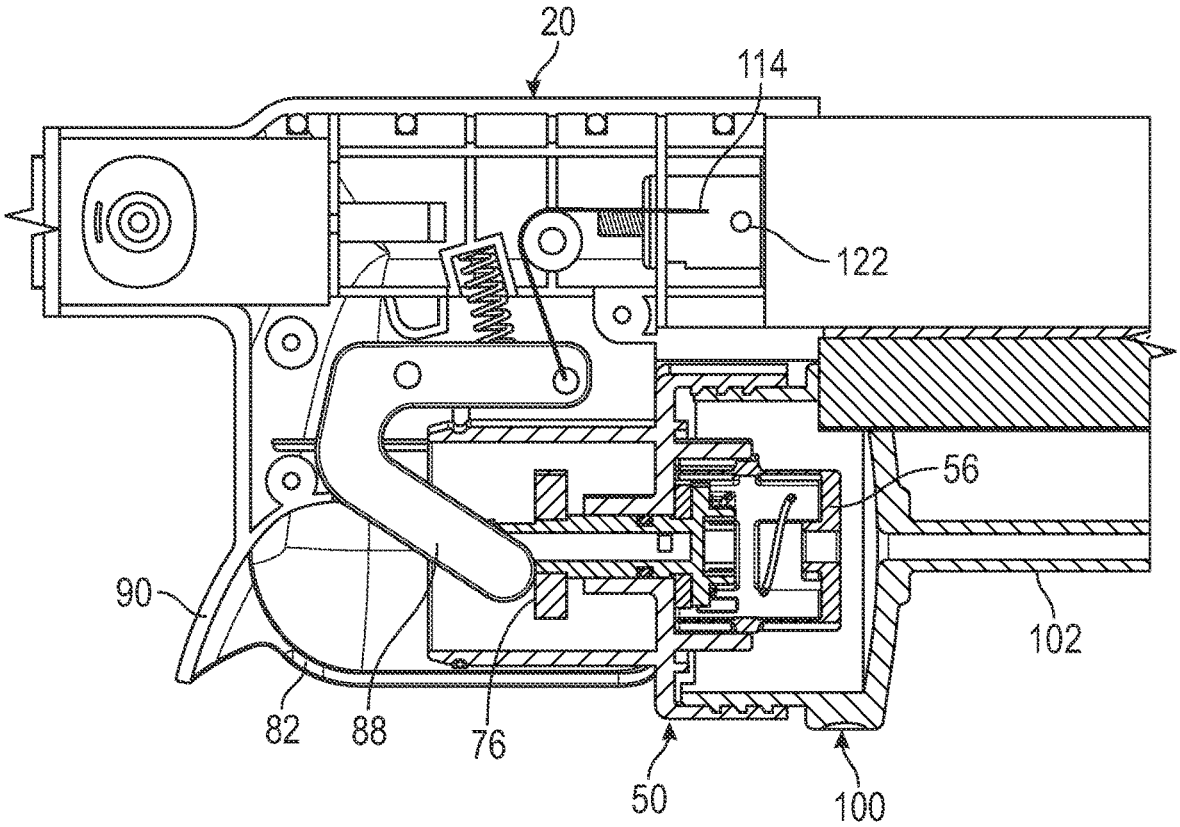
FIG. 9*d* is a partial sectional view of the assembly of FIG. 9*c;*

Dispensing device 20 includes housing 82 into which lower shroud 58 of dispensing cap 50—having adapter 100 secured thereto—is received. Shroud 58 and housing 82 can, in some embodiments, include matching interlocking features 84-1, 84-2 that form an interference fit once cap 50 is seated within housing 82. The interference fit between features 84-1, 84-2 can provide an audible and/or tactile indicia to the user that container 24 is properly installed in housing 82. Once installed, activation surface 76 of dispensing cap 50 is positioned adjacent to activation arm 88 of dispensing device 20 as shown in FIG. 9*d*.

In embodiments where housing 82 includes slot 86, installation of cap 50 and adapter 100 into dispensing device 20 simply requires aligning tube 54 with slot 86 and sliding the cap into housing 82 until features 84-1, 84-2 engage one another. Conversely, removal of cap 50 and adapter 100 from dispensing device 20 simply requires withdrawing the cap from housing 82 after features 84-1, 84-2 are disengaged from one another.

In embodiments where housing 82 includes guide 90, the guide 90 can ensure that agent released from backpack 26 is guided from dispensing tube 54 in a desired location with respect to tool 12.

Advantageously, assembly 10 having easily connectable dispensing device 20 and dispensing cap 50 eliminates any residual agent from being present in the assembly after removal of backpack 26. Stated another way, all of the agent is retained by cap 50 within backpack 26— via adapter 100, conduit 102, and cap 104. Stated another way, once cap 50 is removed from dispensing device 20 there is no agent remaining in assembly 10.

Figure 9E:
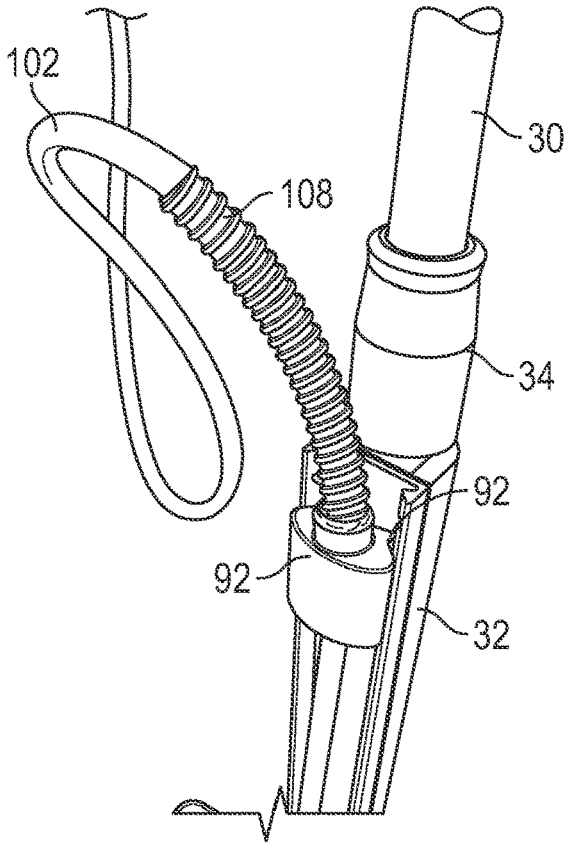
FIG. 9*e* is a perspective view of a strain relief portion of the backpack after installation in the assembly of FIG. 2.
Figure 9G:
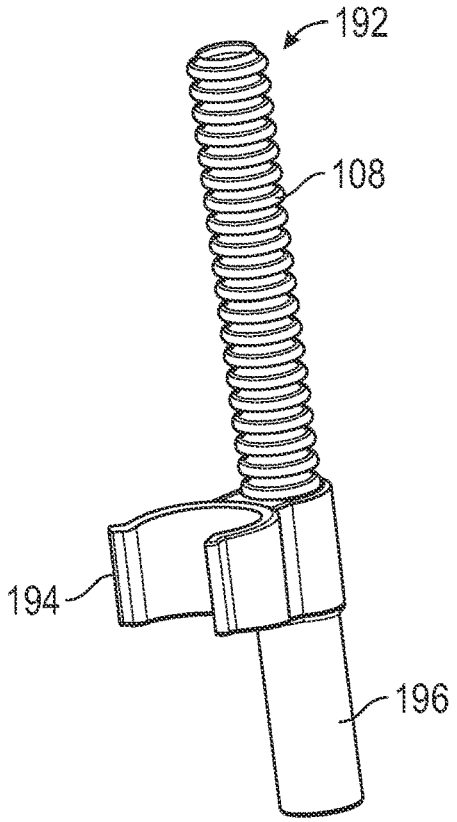
FIG. 9*g* is a perspective view of an alternate embodiment of a strain relief portion of the backpack before installation in the assembly of FIG. 2.
Figure 9F:
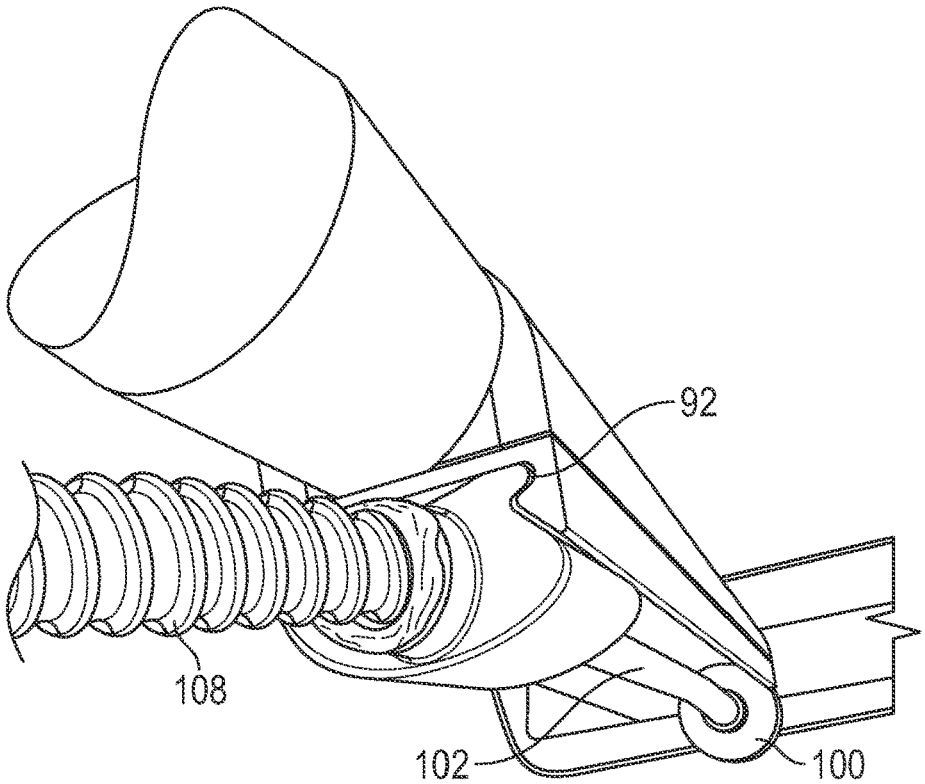
FIG. 9*f* is a perspective view of the strain relief portion of the backpack after installation in the assembly of FIG. 2.

In some embodiments, backpack 26 can include a retaining feature 92 disposed on conduit 102 as illustrated in FIGS. 9*e* and 9*f*. Assembly 10 can include a matching feature 92 positioned to slidably receive feature 92. In this manner, conduit 102 can be secured to assembly 10 at two points—by feature 84-1 at cap 50 and by feature 92 at the region remove from the cap. In some embodiments, retaining feature 92 can further include a strain relief 108 that protects conduit 102 during back and forth motions of assembly 10 during cleaning.

An alternate embodiment of a retaining feature 192 for backpack 26 is illustrated in FIG. 9*g*. Retaining feature 192 is shown having as a resilient clip member 194, which can be clipped onto or removed from assembly 10, and a body 196 through which the conduit (not shown) can be passed. In this manner, retaining feature 192 can be used to removably secure the conduit (not shown) to the upper and/or lower sections of the pole (not shown) or to any other portion of the assembly. In some embodiments, retaining feature 192 can further include a strain relief 108 that protects the conduit (not shown) during back and forth motions of assembly 10 during cleaning.

The flow of agent from container 24 or backpack 26 via gravity can be further enhanced by inclusion of a vent in the containers and/or any other portion of the fluid flow path, as desired.

Figure 10A:
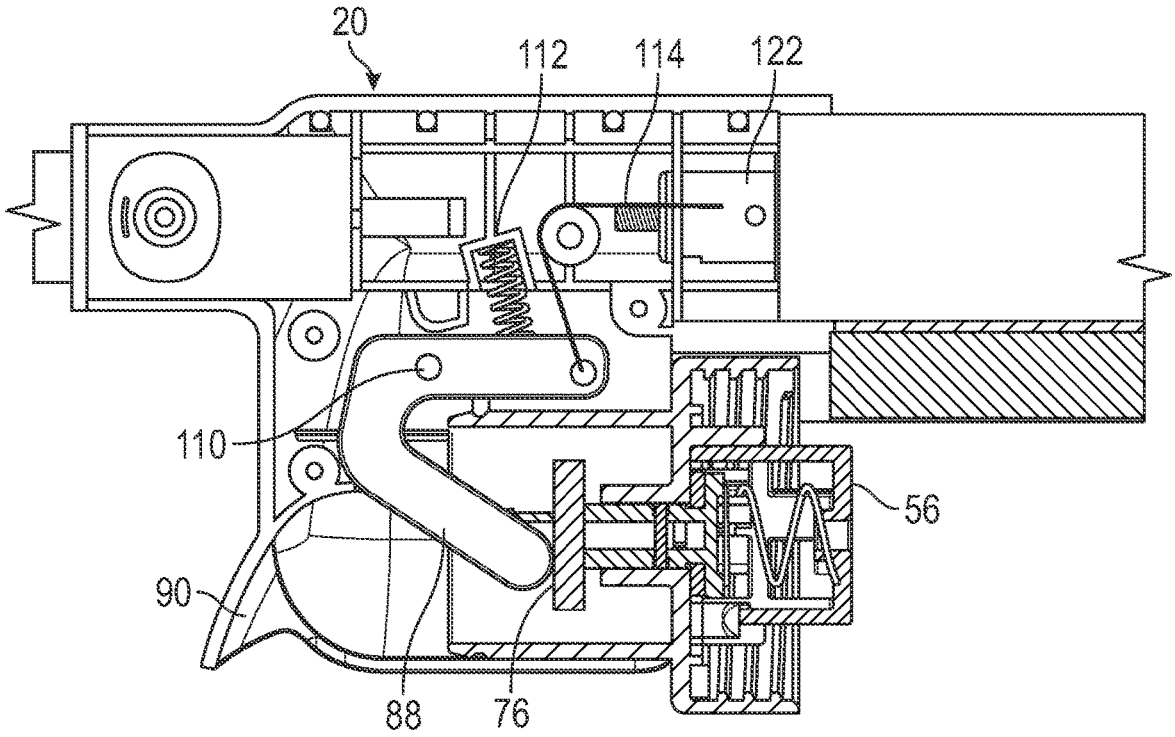
FIG. 10*a* is a partial sectional view of the dispensing cap in the assembly of FIGS. 1 and 2, with the dispensing cap in the closed position.

As discussed above, assembly 10 is configured for use with one or more size of containers 24 and backpack 26 by simply connecting dispensing cap 50 and dispensing assembly 20 to one another. The activation of valve 56 in cap 50 is the same regardless of what container is being used. Thus, the operation of valve 56 by assembly 10 is now described with reference to FIGS. 10*a*, 10*b*, and 10*c*.

Once cap 50 is installed in dispensing assembly 20, activation surface 76 of the dispensing cap is positioned adjacent to activation arm 88 of dispensing device 20.

Figure 10B:
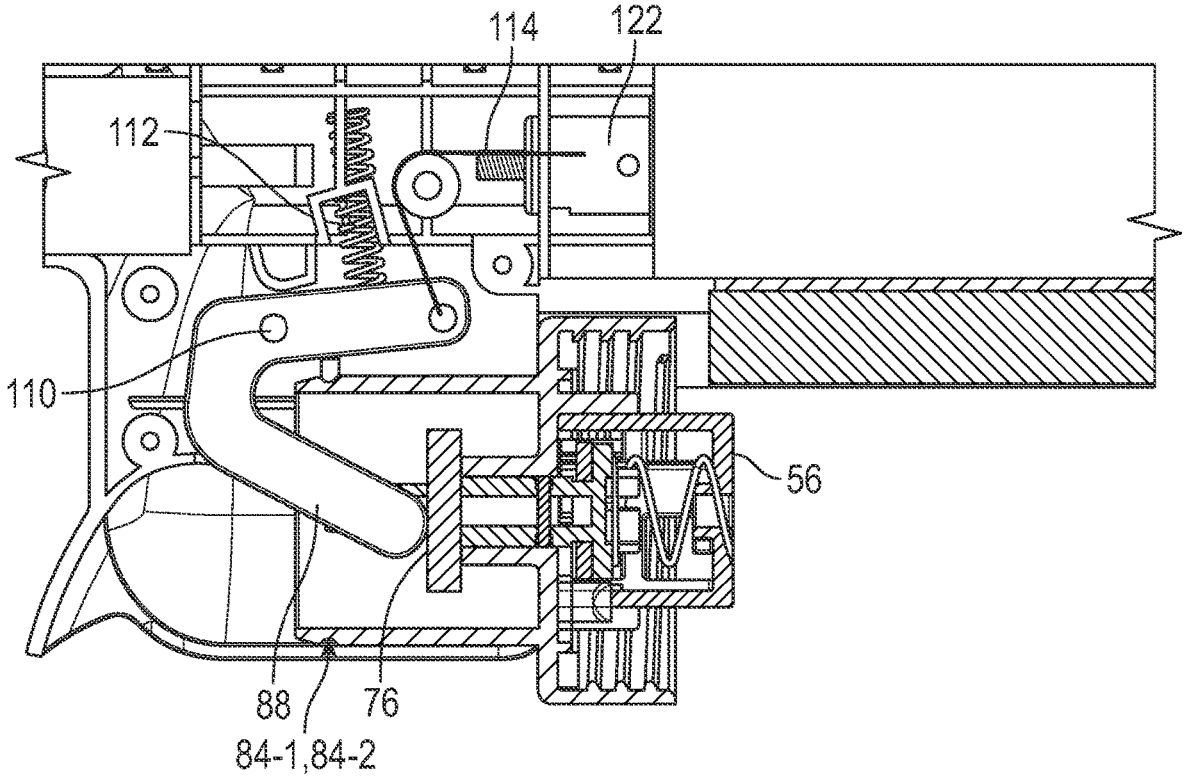
FIG. 10*b* is a sectional view of FIG. 10*a* with the dispensing cap in the open position.
Figure 10C:
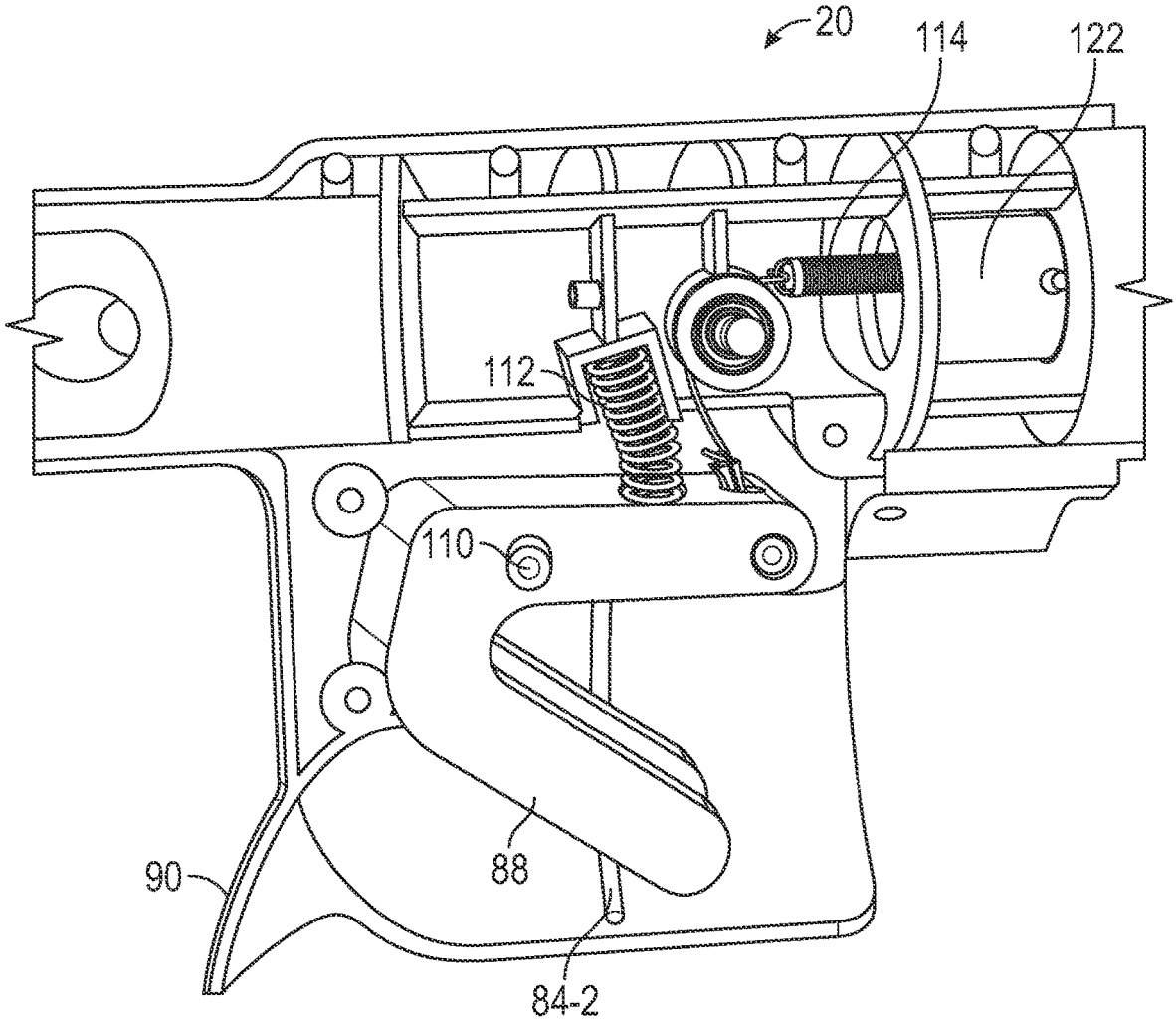
FIG. 10*c* is another sectional view of the assembly of FIG. 10*a* having the dispensing cap omitted for clarity.
Figure 11A:
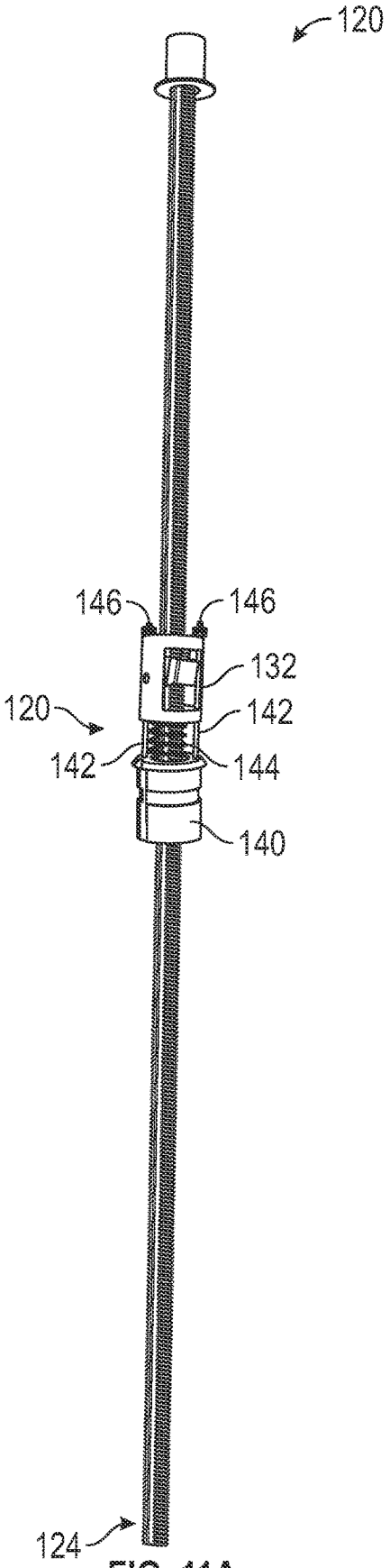
FIG. 11*a* illustrates an exemplary embodiment of a telescoping trigger assembly according to the present disclosure for use with the assemblies of FIGS. 1 and 2.
Figure 11B:
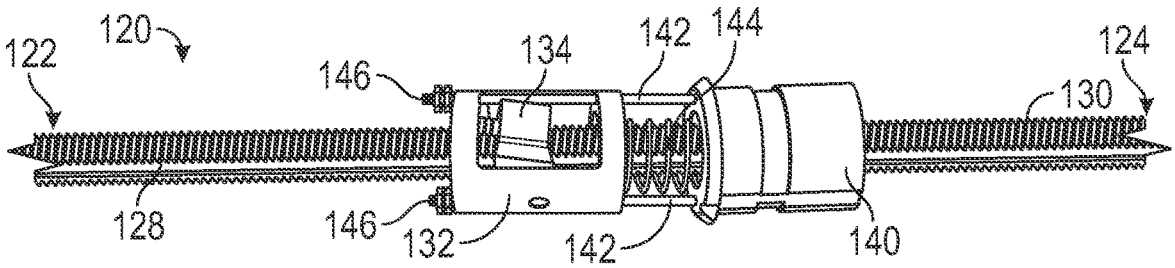
FIG. 11*b* is a magnified view of the telescoping trigger assembly of FIG. 11*a*, shown in a first or telescoping position.
Figure 11C:
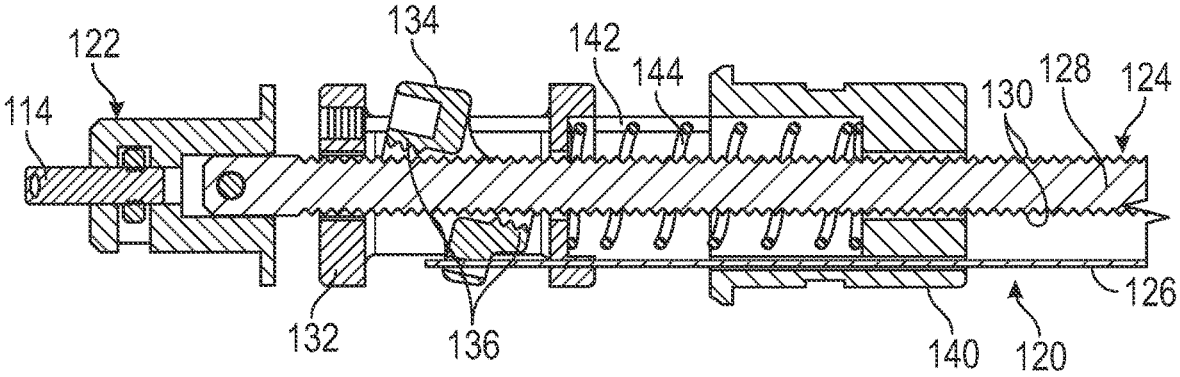
FIG. 11*c* is a sectional view of the telescoping trigger assembly of FIG. 11*a*, shown in the first or telescoping position.
Figure 11D:
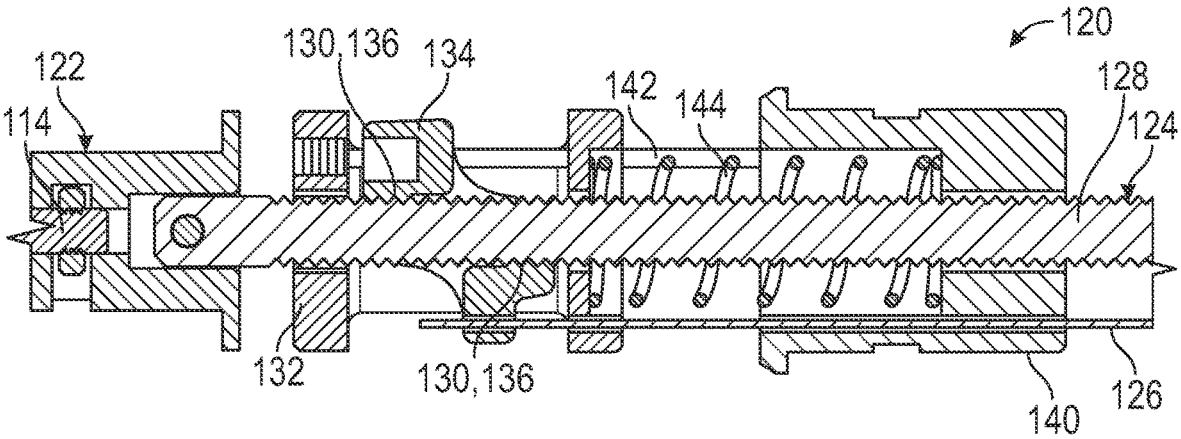
FIG. 11*d* is a sectional view of the telescoping trigger assembly of FIG. 11*a*, shown in a second or locked position.

Activation arm 88 secured in dispensing device 20 for rotation about a pivot point 110 and is maintained in a normal position (FIG. 10*a*) by a spring 112. Arm 88 is operatively connected to trigger 40 by a cable 114. Thus, movement of trigger 40 is translated into movement of arm 88 about pivot point 110 by cable 114 and spring 112 to a second position (FIG. 10*b*).

When arm 88 is in the second position, the arm acts on activation surface 76 of valve 56 to open the valve as discussed above.

As discussed briefly above, assembly 10 is configured to maintain the operable connection between dispensing device 20 and trigger 40 throughout the range of length adjustments of pole 14. The operable connection between dispensing device 20 and trigger 40 is now described in more detail with reference to FIGS. 11*a* through 11*d*.

Assembly 10 includes a telescoping trigger assembly 120 having a first end 122 facing in the direction of dispensing assembly 20 and a second, free end 124 facing the direction of trigger 40.

Assembly 120 includes a shaft 128 having teeth 130 on opposite sides, a first base 132, a toggle 134, a biasing member (not shown). Shaft 128 is connected to arm 88 of dispensing assembly 20 via cable 114. Toggle 134 is connected to trigger 40 via a second cable 126.

Toggle 134 includes teeth 136 on the two opposing edges that face teeth 130 of shaft 128. Toggle 134 is pivotally secured in first base 132 for movement between a first or unlocked position (FIG. 11*c*) and a second or locked position (FIG. 11*d*), with the biasing member biasing the toggle to the unlocked position.

Shaft 128 is illustrated as having a square cross section that mates with toggle 134 with teeth 134 that have a generally planar section. Of course, it is contemplated by the present disclosure for shaft 128 and teeth 134 to have any desired matching cross sectional shapes such as, but not limited to, circular or polygonal sections. Additionally, it is contemplated by the present disclosure for shaft 128 and teeth 134 to have non-matching cross sections.

Assembly 120 also includes, in some embodiments a second base 140 that is connected to first base 132 as described below in more detail. Second base 140 is secured in a desired position within top section 30 of pole 14, which in turn secures first base 132 in the pole. In this manner and with toggle 134 in the unlocked position of FIG. 11*c*, adjustment of the length of pole 14 by movement of top section 30 with respect to bottom section 32 results in shaft 128 sliding within first base 132 so that free end 124 of the shaft moves closer to or farther from trigger 40.

Once pole 14 is secured at the desired length, activation of trigger 40 pulls on second cable 126 in the direction of second end 124, resulting in a linear movement of the second cable. The linear movement second cable 126 overcomes the biasing member to pivot toggle 134 within first base 132 to the locked position of FIG. 11*d*.

When pivot toggle 134 is in the locked position with teeth 130, 136 engaged with one another, the linear movement of second cable 126 is translated into a linear movement of shaft 128. The linear movement of shaft 128 pulls on cable 114 to rotate arm 88 of dispensing assembly 20, which opens valve 56 in dispensing cap 50 as described above.

Teeth 130, 136 are illustrated as triangular crenulations. Of course, it is contemplated by the present disclosure for the teeth to have any desired shape sufficient to engage one another and result in the movement of arm 88 as a result of the movement of trigger 40.

Upon release of trigger 40, the biasing member of assembly 120 returns pivot toggle 134 to the normal position, which allows valve 56 in dispensing cap 50 to close as described above.

It has been determined by the present disclosure that slack within assembly 120 can adversely affect operable connection between trigger 40 and dispensing assembly 20. Thus, assembly 120 can, in some embodiments, include an adjustment device. In the illustrated embodiment, the adjustment of slack within assembly 120 is provided by a second base 140, one or more guide shafts 142, an adjuster spring 144, and an adjuster nut 146 on the guide shafts.

Second base 140 is secured in top section 30 at a desired location. First base 132 is slidably positioned on guide shafts 142, which extend from second base 140 so that the first base is biased by adjuster spring 144 away from the second base. Slack in second cable 126 can be removed by adjusting the distance between first and second bases 138, 140 using adjuster nut 146.

The operation of top-hand grip 16, trigger 40, and second cable 126 are described with reference to FIGS. 12*a*-12*d*.

Figure 12A:
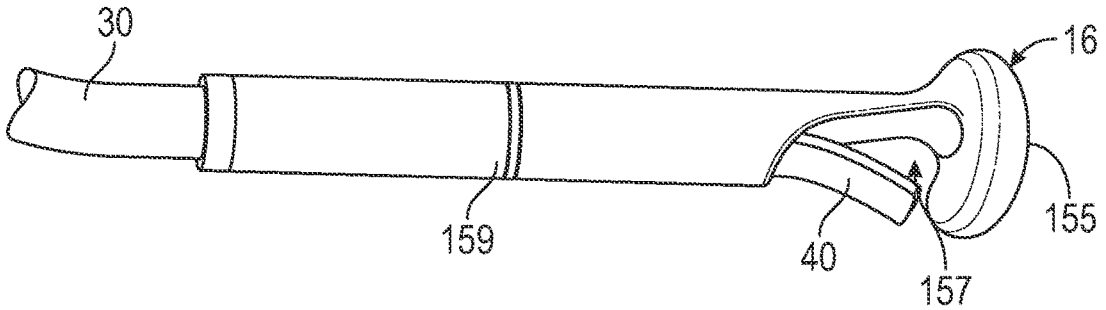
FIG. 12*a* is a perspective view of a top-hand grip of the assembly of FIGS. 1 and 2, shown in a normal or un-activated position.
Figure 12B:
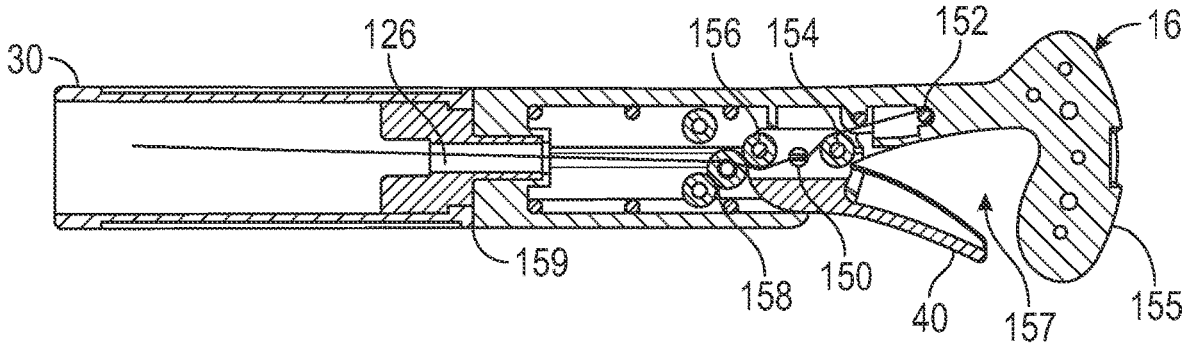
FIG. 12*b* is a sectional view of the top-hand grip of FIG. 12*a*, shown in the normal or un-activated position.
Figure 12C:
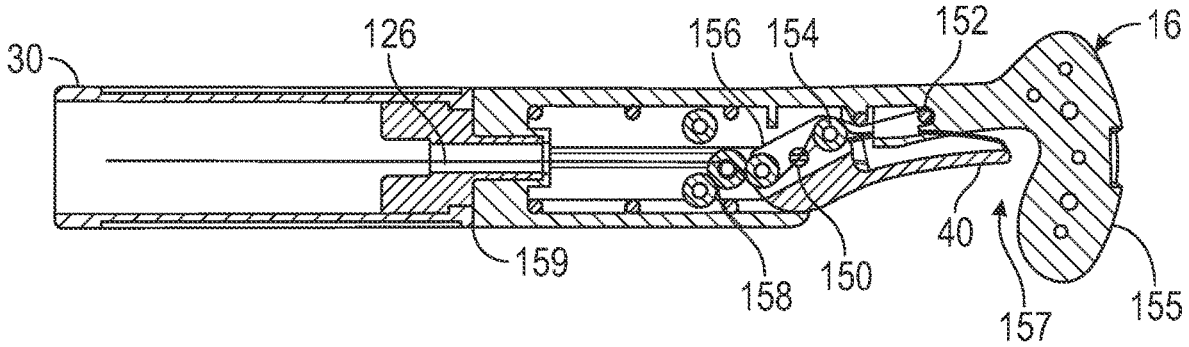
FIG. 12*c* is a sectional view of the top-hand grip of FIG. 12*a*, shown in an activated position.

Trigger 40 is configured for movement about a trigger pivot 150 between a normal or un-activated position as shown in FIGS. 12*a* and 12*b*, and an activated position as shown in FIG. 12*c*. Trigger 40 is biased to the normal or un-activated position of FIGS. 12*a* and 12*b* by a biasing member (not shown).

Advantageously, trigger 40 is configured in a manner that ensures minimal rotation about trigger pivot 150. In this manner and without wishing to be bound by any particular theory, assembly 10 is believed to be configured to allow operation of trigger 40 by the user's fingers while the palm of the user's hand rests over the upper side of top-hand grip 16. In some embodiments, trigger 40 rotates about trigger pivot 150 by about 25 degrees, yet provides at least 0.25 inches of linear travel to second cable 126 and more preferably more than 0.33 inches of linear travel.

In the illustrated embodiment, second cable 126 is secured to top-hand grip 16 at a stationary anchor point 152, passes between movable fulcrum points 154, 156 in trigger 40, and around stationary fulcrum point 158 in top section 30. Advantageously, trigger 40 includes three fulcrum points 154, 156, and 158 that convert same degrees of rotation of the trigger into large amounts of linear movement in second cable 126. In the normal position, movable fulcrum points 154, 156 are positioned on opposite sides of trigger pivot 150, which maximizes the linear movement.

Further and without wishing to be bound by any particular theory, it is believed that trigger 40 having movable fulcrum points 154, 156 positioned on opposite sides of trigger pivot 150, combined with stationary anchor point 152 and stationary fulcrum point 158 provides a mechanical advantage to the trigger that allows for easy operation of dispensing device 20.

Figure 12D:
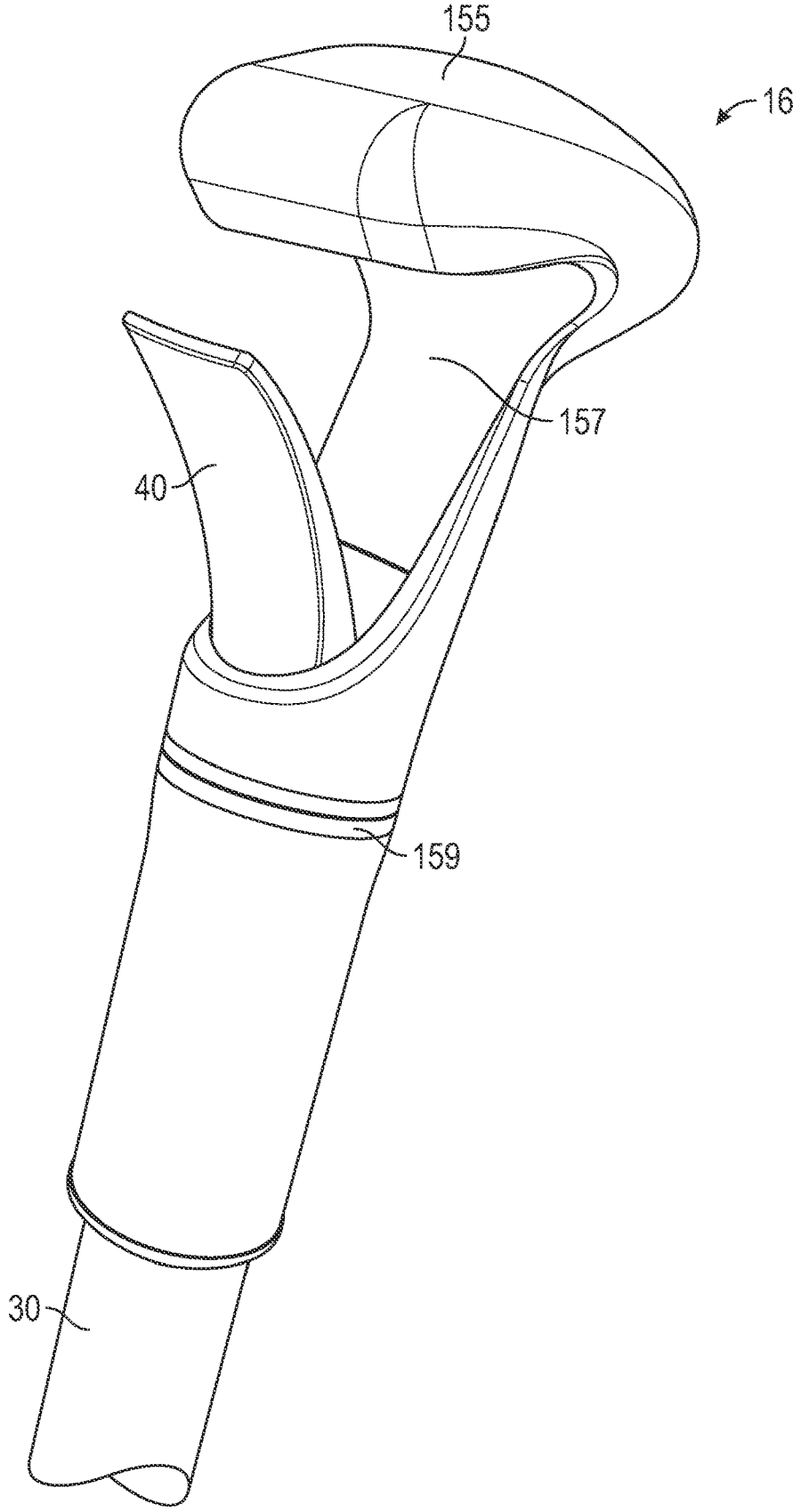
FIG. 12*d* is another perspective view of a top-hand grip of the assembly of FIGS. 1 and 2, shown in a normal or un-activated position.

In some embodiments, top-hand grip 16 can include a substantially rectangular upper end 155 and a finger gripping slot 157 shown in FIG. 12*d*. In this embodiment, grip 16 is configured to be secured to section 30 of pole 14 in a rotational manner via a rotational connection 159 to assist the user with orienting their grip on assembly 10. In this manner, grip 16 can be oriented so that slot 157 opens in any desired direction such as in a direction facing the leading edge ($L_E$) of tool 12, a direction facing the trailing edge of tool 12, a direction facing either side edge of tool 12, and any position between these defined positions. Specifically and without wishing to be bound by any particular theory, it has been determined by the present disclosure that different end users prefer holding grips 16, 18 in different positons and activating trigger 40 with different parts of their hands.

In some embodiments, slot 157 can also function as a hang hole/hook by which assembly 10 can be hung from a hook or other protrusion.

It some embodiments the operative engagement of dispensing device 20 and trigger 40 can include one or more swivels (not shown) connected to cables 114, 126 or other components, which reduce the torsion on the operative engagement during rotation of top-hand grip 16 and/or sections 30, 32 of pole 14. Additionally, it is contemplated by the present disclosure for sections 30, 32 of pole 14 to be configured to prevent rotation with respect to one another. For example, sections 30, 32 can have a non-circular cross section that prevents rotation.

An exemplary embodiment of universal joint 22 is described with reference to FIGS. 13*a*, 13*b*, 13*c*, and 13*d*. Joint 22 is, preferably, rotatable about two axes 160, 162 to improve the ease of use of tool 12. In some embodiments, joint 22 is configured so that at least one of the two axes 160, 162 is lockable to improve the ease of use of tool 12. Of course, it is contemplated by the present disclosure for joint 22 to have unrestrained movement and, thus, to lack any lock.

Figure 13A:
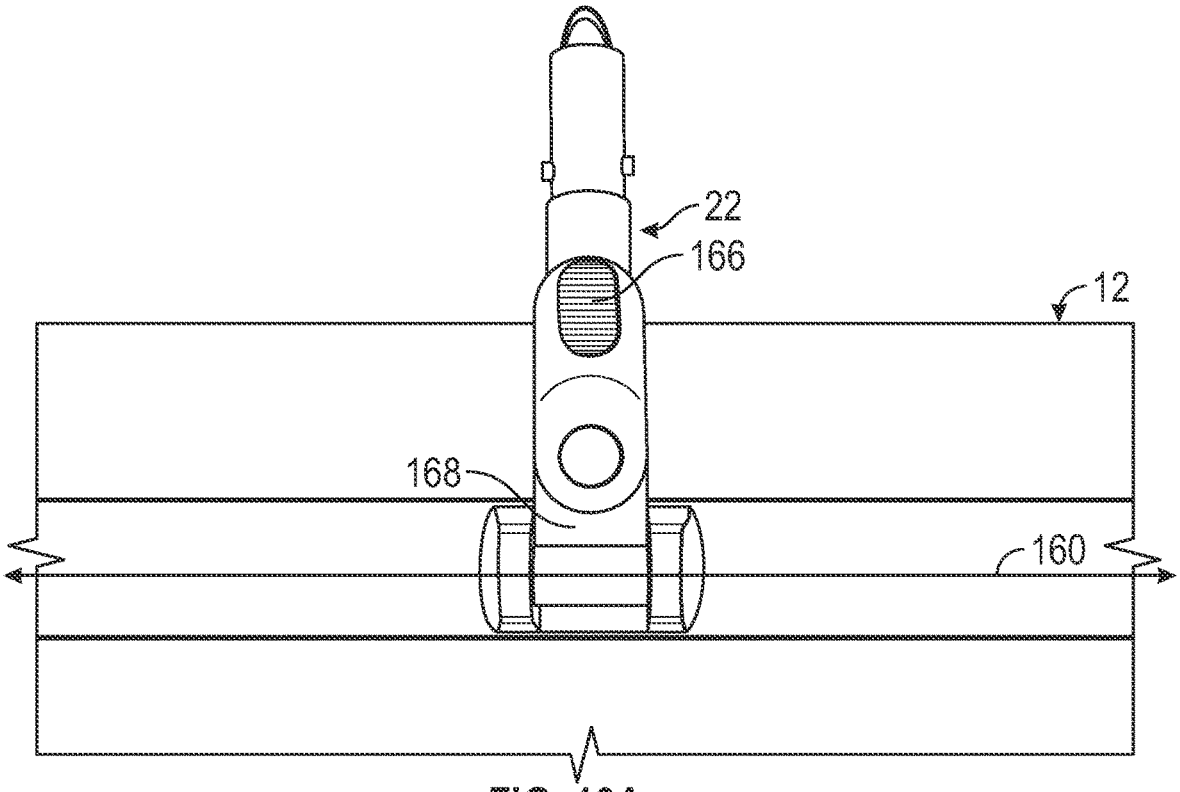
FIG. 13*a* is a top view of an exemplary embodiment of a cleaning head for use with the assembly of FIGS. 1 and 2, shown in a pivoted position.
Figure 13B:
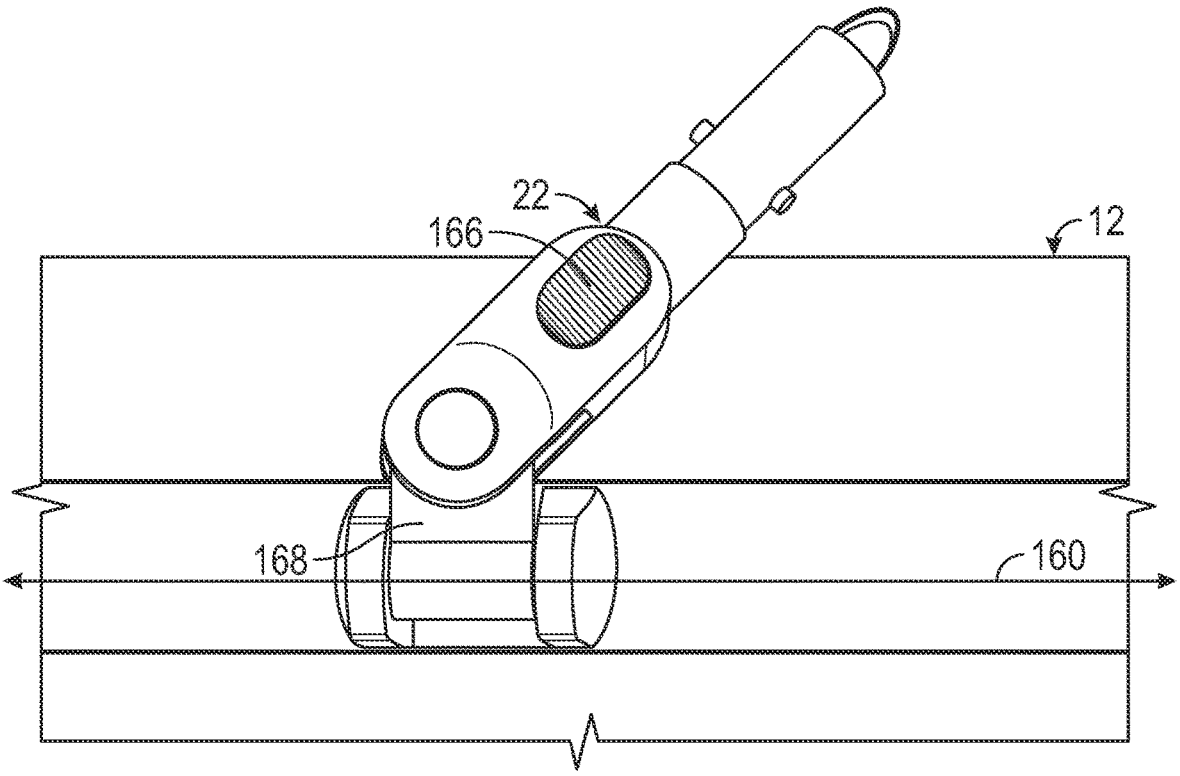
FIG. 13*b* is a top view of the cleaning head of FIG. 13*a* shown in a normal or unlocked position.
Figure 13C:
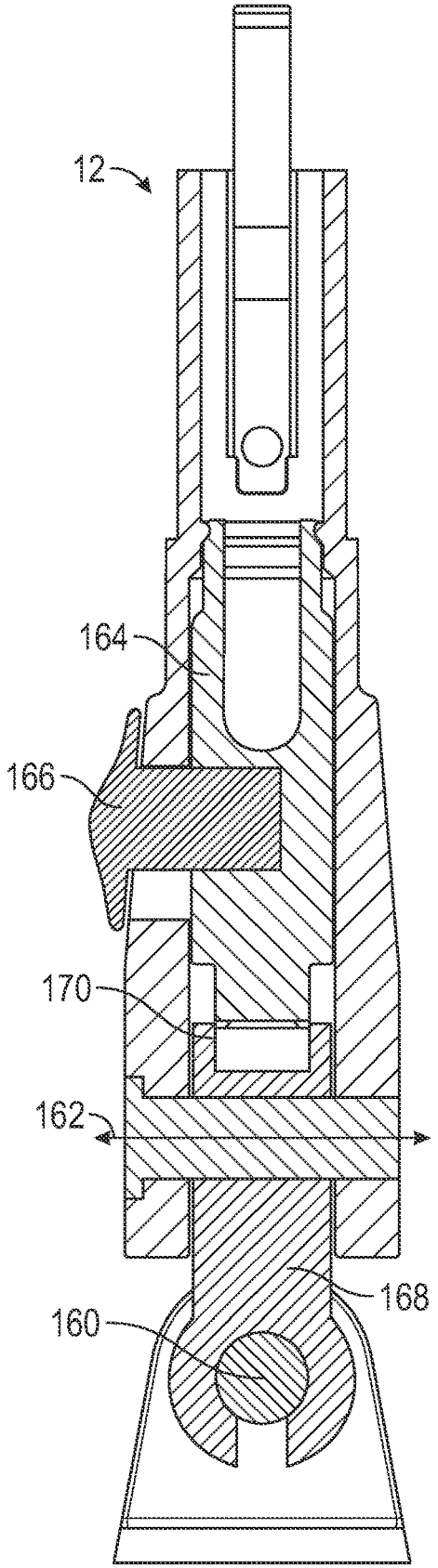
FIG. 13*c* is a sectional view of the cleaning head of FIG. 13*b* shown in the normal position and in an unlocked state.
Figure 13D:
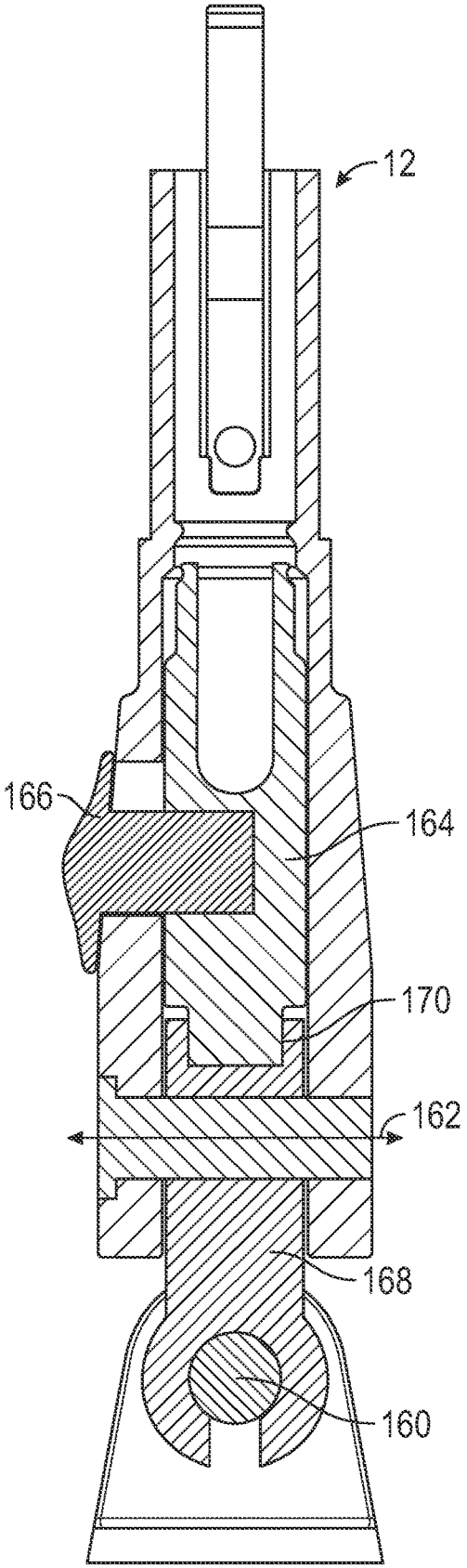
FIG. 13*d* is a sectional view of the cleaning head of FIG. 13*b* shown in the normal position and in a locked state.
Figure 14A:
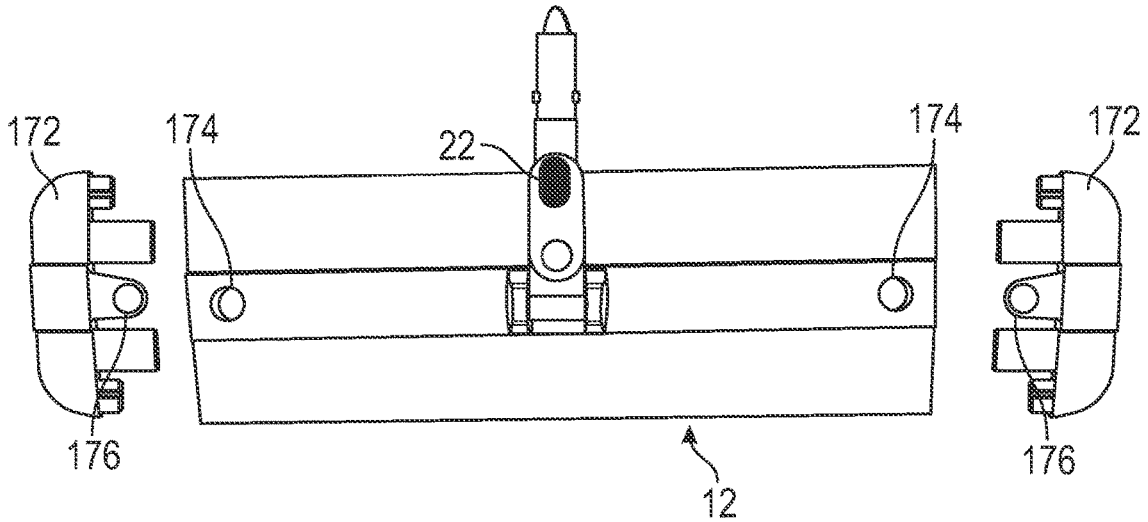
FIG. 14*a* illustrates the cleaning head of FIG. 13*a* in a partially disassembled state.
Figure 14B:
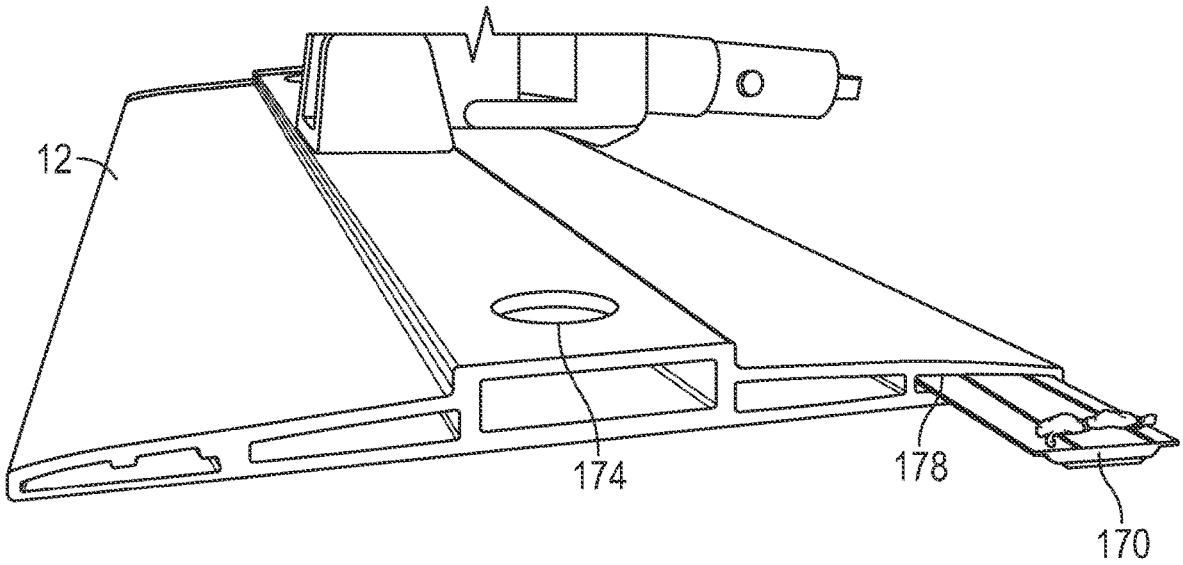
FIG. 14*b* is an end view of the partially disassembled cleaning head of FIG. 14*a;*
Figure 14C:
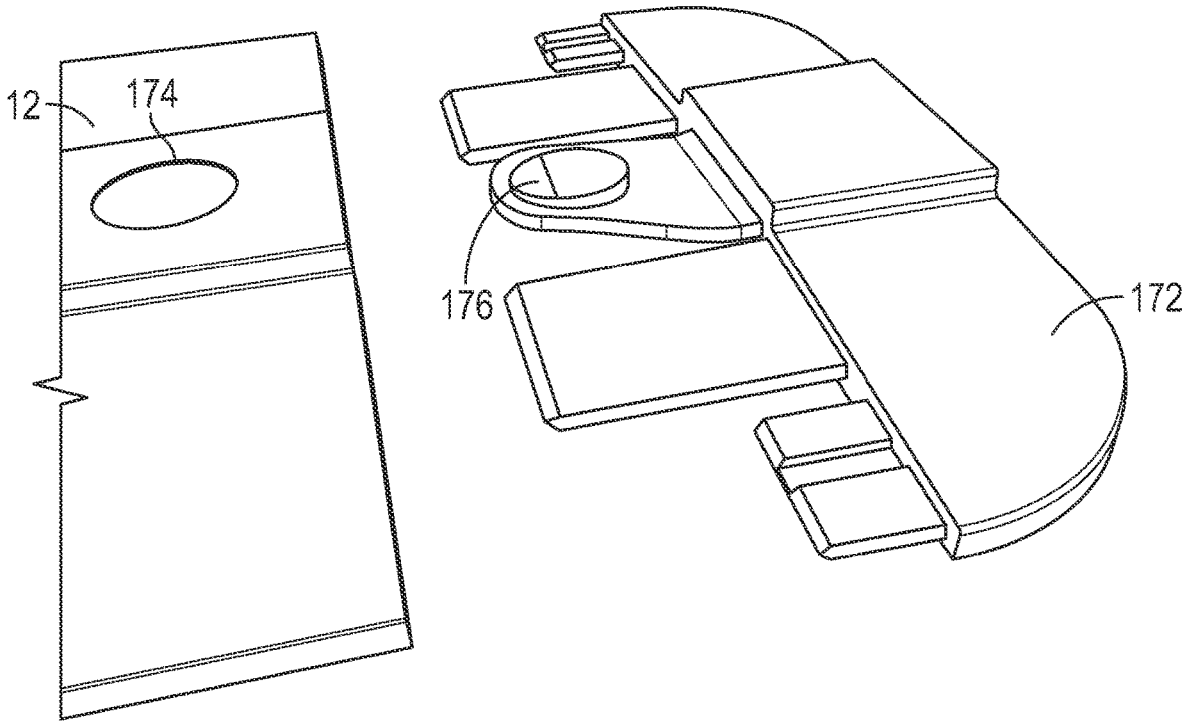
FIG. 14*c* is a perspective view of the partially disassembled cleaning head of FIG. 14*a;*
Figure 14D:
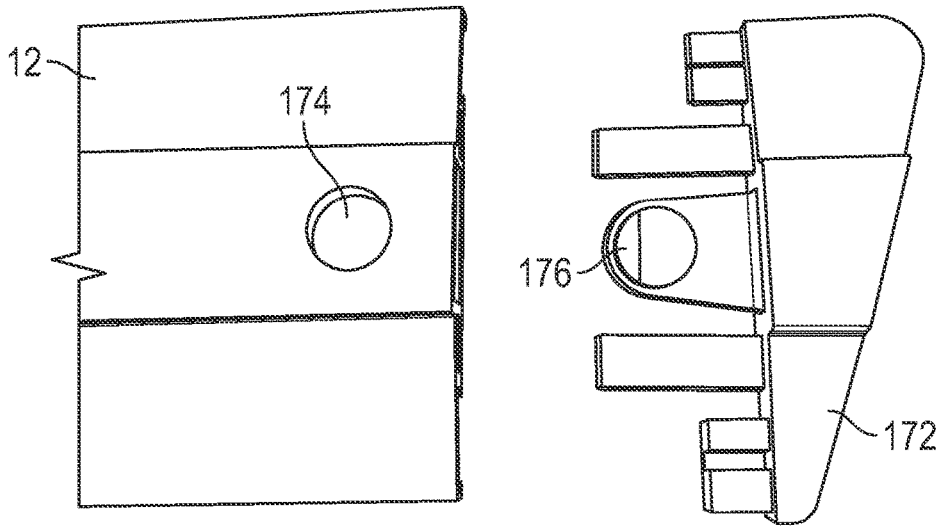
FIG. 14*d* is a perspective view of the partially disassembled cleaning head of FIG. 14*a* illustrated with another exemplary embodiment of an end cap.

Joint 22 is shown in FIG. 13*c* in an unlocked state and in FIG. 13*d* in a locked state. Joint 22 includes a locking arm 164, a locking button 166, and an intermediate member 168. Intermediate member 168 is positioned between axes 160, 162 and include a locking opening 170.

Locking arm 164 is slidable into operative engagement with opening 170 to lock joint 22 from rotating about axis 162, while allowing rotation about axis 160. Additionally, locking arm 164 is slidable out of operative engagement with opening 170 to unlock joint 22 to allow rotation about both axes 160, 162.

An exemplary embodiment of tool 12 is described with reference to FIGS. 14*a*, 14*b*, 14*c*, and 14*d*, which is illustrated as a flat mop. Tool 12 includes mop connecting members 170—such as hook-and-loop type fasteners—that are used to removably connect a flat mop cloth to the head. It has been determined by the present disclosure that connecting members 170 can, after prolonged and repeated use, require replacement. Advantageously, tool 12 is configured to allow for simple removal and replacement of members 170.

Head 12 is illustrated as an aluminum extrusion having removable end caps 172. End caps 172 can have any desired shape such as the shapes illustrated in FIGS. 14*c* and 14*d*. Here, head 12 includes a lock opening 174 and end caps 172 include locking arms 176 that extend into the opening to releasably secure the end cap to the head. In this manner, members 170 are configured to slide into slots 178 within head 12 after removal of cap 172.

Of course, it is contemplated by the present disclosure for head 12 to be made of any material having sufficient strength to perform the desired cleaning activity. For example, head 12 can be formed of molded plastic, extruded plastic, machined metals, cast metals, and others. In some embodiments where head 12 is formed of molded plastic, it is further contemplated by the present disclosure for connecting members to be molded as part of the head such as that described in U.S. Pat. No. 5,368,549, which is incorporated herein by reference.

Figure 15A:
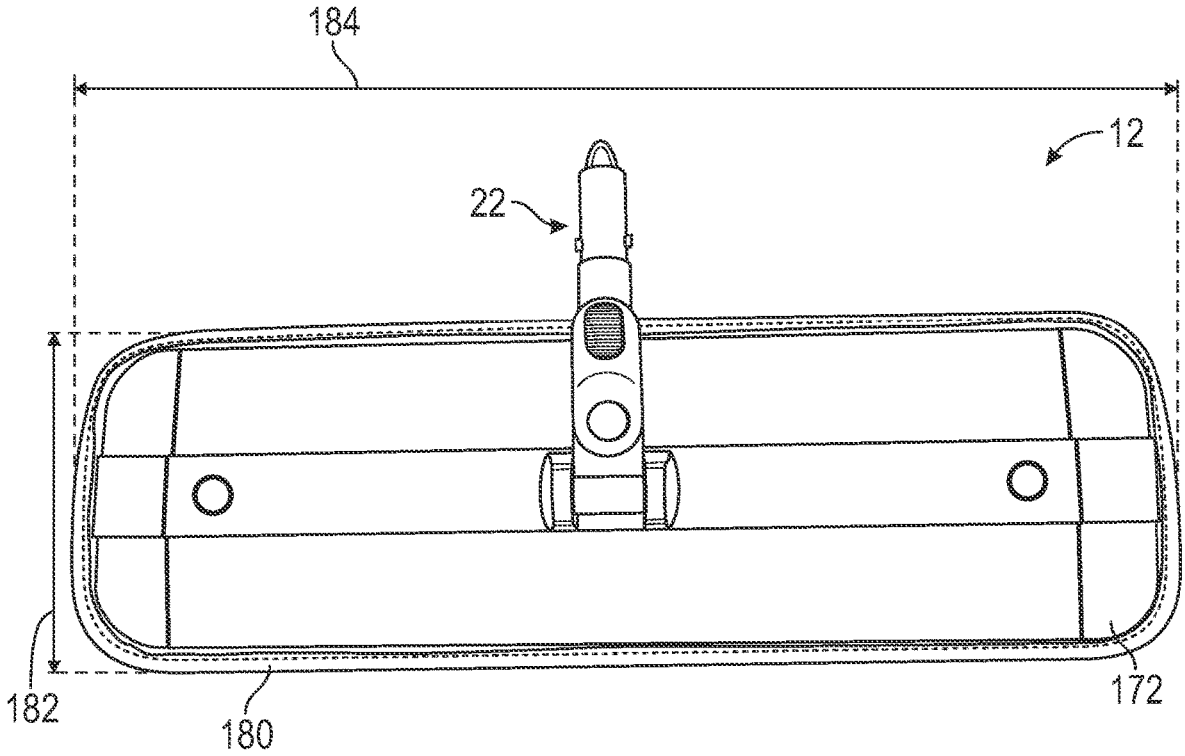
FIG. 15*a* is a perspective view of an exemplary embodiment of a cleaning and/or conditioning tool according to the present disclosure.
Figure 15B:
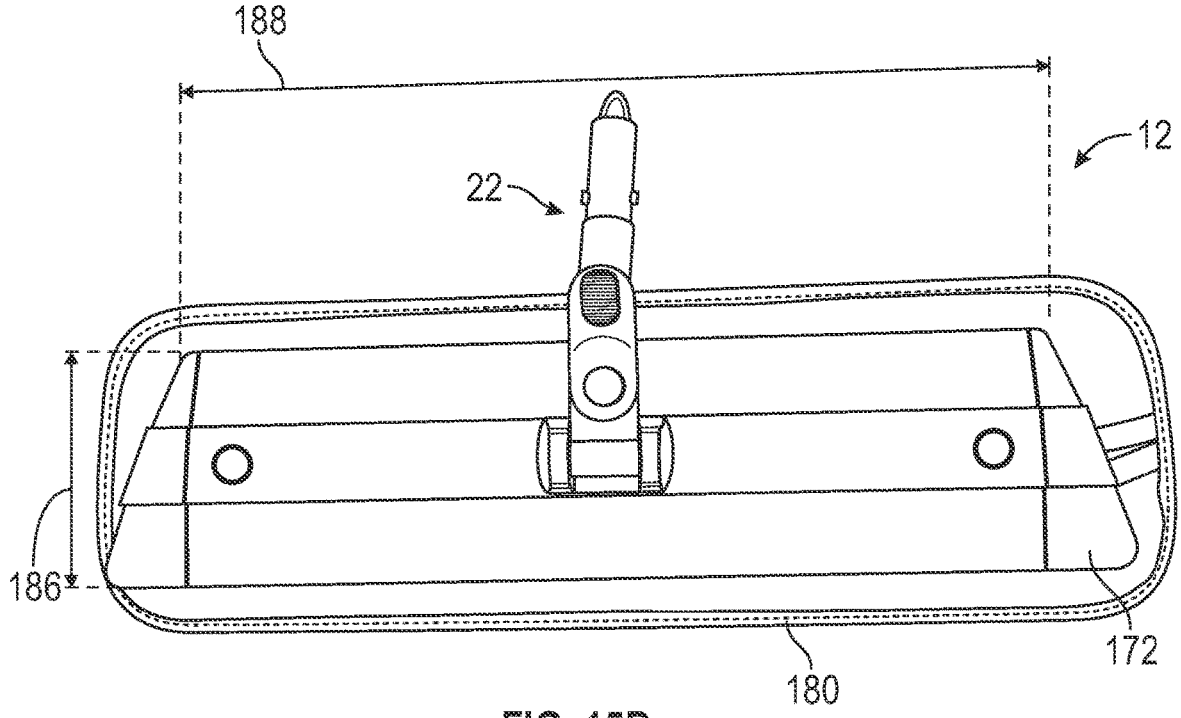
FIG. 15*b* is a perspective view of an alternate exemplary embodiment of a cleaning and/or conditioning tool according to the present disclosure.

Referring now to FIGS. 15*a* and 15*b*, exemplary alternate embodiments of tool 12 are shown. Tool 12 is shown in FIG. 15*a* having end caps 172 that are generally rectangular in shape, while the tool is shown in FIG. 15*b* having end caps 172 that are generally triangular in shape. In both embodiments, tool 12 is shown in use with an identical cleaning cloth 180.

It can be seen from FIG. 15*a* that tool 12 has a width 182 and a length 184—including rectangular end caps 172—that are substantially similar to those of mop 180. In this manner, tool 12 in FIG. 15*a* has a surface area that is substantially the same as that of cleaning cloth 180.

Conversely, it can be seen from FIG. 15*b* that tool 12 has a width 186 and a length 188—including rectangular end caps 172—that are less, at least in regions, to those of cloth 180. In this manner, tool 12 in FIG. 15*b* has a surface area that is less than that of cleaning cloth 180.

It has been determined by the present disclosure that each of tools 12 have uses depending upon the desired cleaning activity. Accordingly, tools 12 are configured to be removably connected to pole 14 in any desired manner. In this manner, the user can selectively place any combination of tools 12, cloths 180, and end caps 172 onto pole 14.

It is contemplated for the assemblies of the present disclosure to work together with one or more attributes of commonly owned and assigned U.S. application Ser. No. 14/983,883 and U.S. Application Ser. No. 62/206,072, the entire contents of both of which are incorporated by reference herein.

Figure 16:
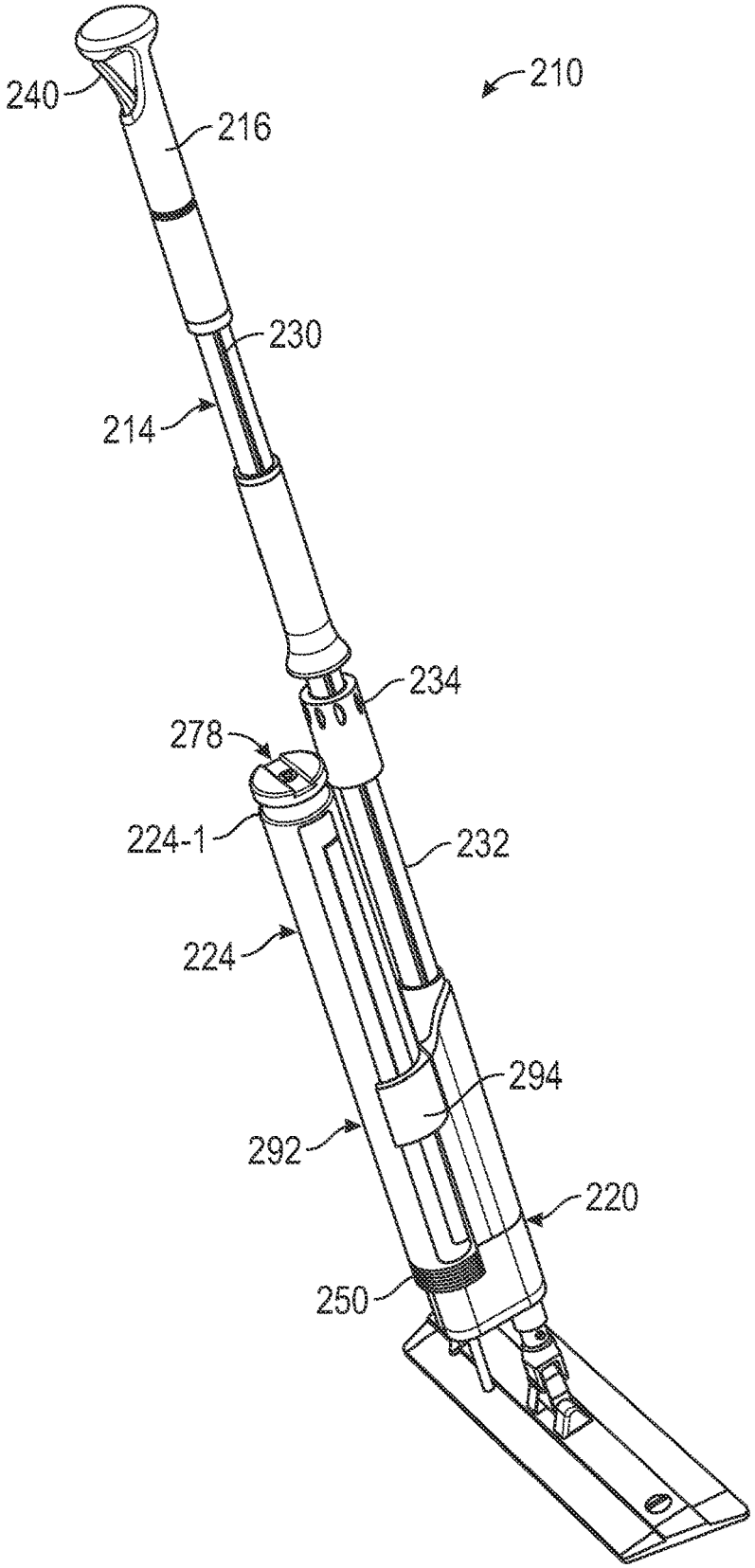
FIGS. 16 and 17 are perspective views of alternate exemplary embodiments of a hard surface cleaning and conditioning assembly according to the present disclosure—illustrated in use with a container for a conditioning agent.
Figure 17:
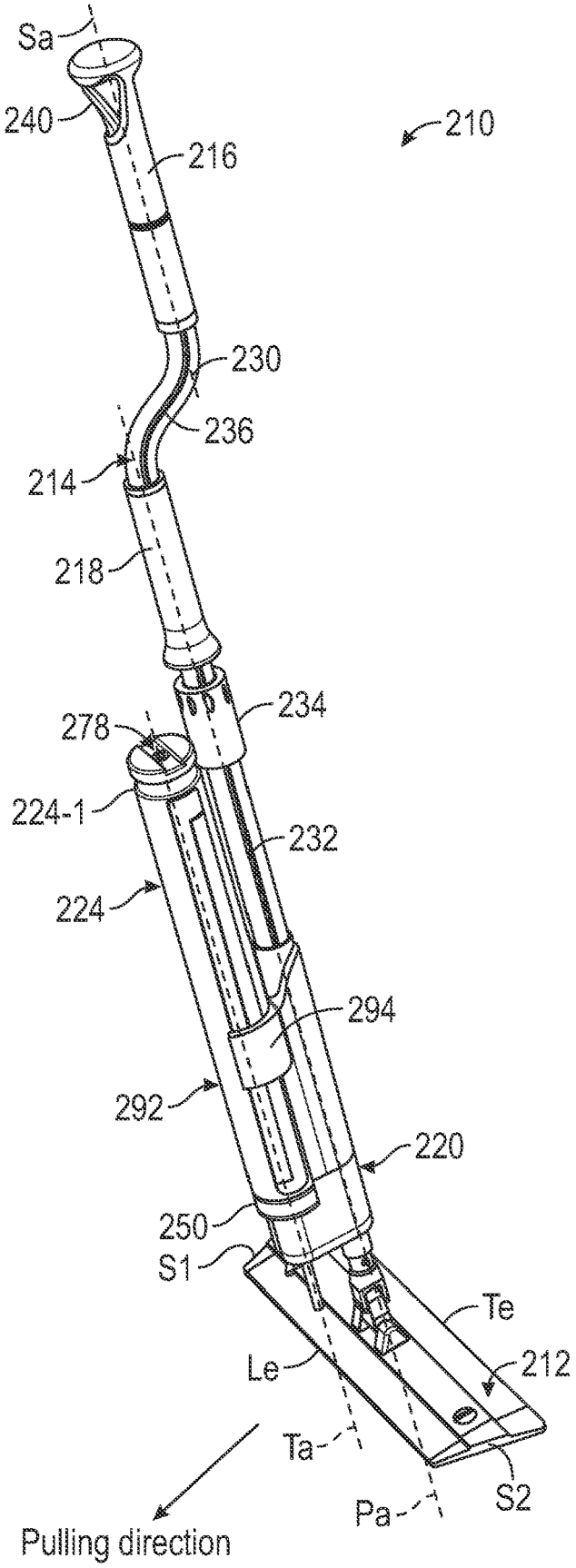

Referring to the drawings and in particular to FIGS. 16-17, alternate exemplary embodiments of hard surface cleaning and conditioning assemblies according to the present disclosure are shown and is generally referred to by reference numeral 210. Assembly 210 is illustrated in FIG. 16 having pole 214 with bent region 236, while assembly 210 is illustrated in FIG. 17 having pole 214 without the bent region (i.e., straight).

For ease of explanation, only those component parts of assemblies 210 that are distinguished from those discussed herein above will be described in detail.

Figure 18:
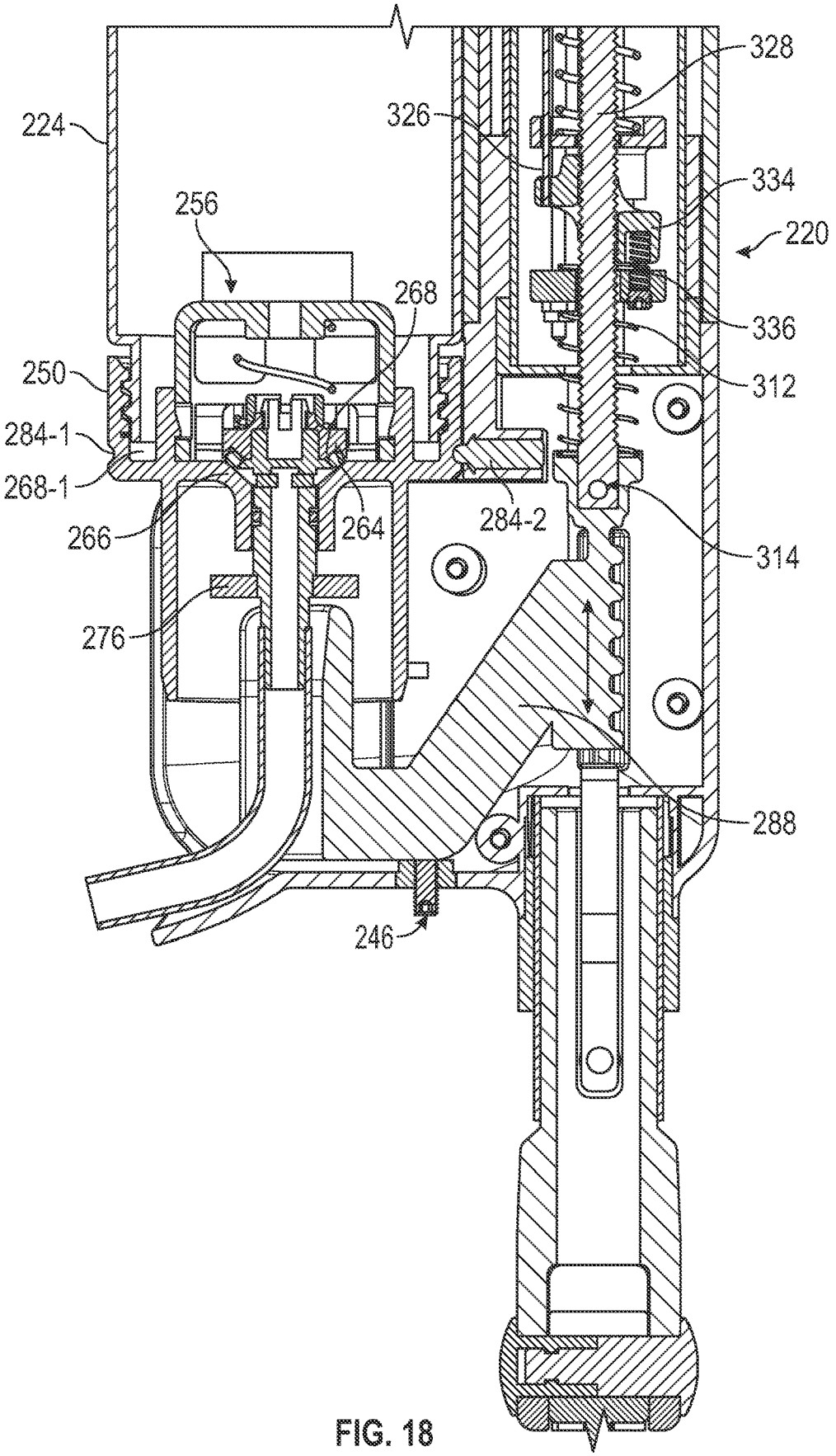
FIG. 18 is a partial sectional view illustrating the interconnection between the agent dispensing device and the dispensing cap in use with container of FIGS. 16 and 17.

The structure and method for connecting a container 224 to assembly 210 is described in detail with simultaneous reference to FIGS. 16-18.

Assembly 210 includes an agent dispensing device 220 that includes a retaining feature 292 in the form of resilient clips 294 into which container 224 can be releasably secured. Thus, container 224 and device 220 lack the dovetail retaining features described above, which allows the container to be inserted in any rotational orientation onto assembly 10. Alternately, it is contemplated by the present disclosure for resilient clips 294 to be formed on container 224. Container 224 can, in some embodiments, include a grip 224-1 or other feature that assists the user to install and remove the device from assembly 210.

Clips 294 can be formed of any material having sufficient resiliency to secure container 224 to assembly 210. For example, claims 294 can be formed from polyoxymethylene (POM), also known as acetal, polypropylene, metal, or other materials.

Additionally, container 224 is shown having a vent valve 278 at an upper end thereof. Vent valve 278, much like vent valve 78 discussed above with respect to dispensing cap 50, allows atmospheric air into container 224 when sufficient conditioning agent is dispensed to cause negative pressure in the container to open the vent valve.

Dispensing device 220 receives dispensing cap 250 in the manner discussed above. Here, device 220 and cap 250 include interlocking features 284-1, 284-2, respectively, that interact to secure container 224 within device 220. Interlocking feature 284-1 of cap 250 is illustrated as an indented rim and interlocking feature 284-2 of device 220 is illustrated as a biased detent. The interlocking of features 284-1 and/or 284-2 can provide an audible and/or tactile indicia to the user that container 224 is properly installed in device 220.

Cap 250 further includes valve 256 that is biased to a normally closed position. Valve 256 further includes a seal or gasket 268 between valve stem 264 and valve face 266 to prevent or mitigate leakage. In this embodiment, face 266 and stem 264 are tapered to improve flow from container 224 with seal 268 being formed on the taper. In some embodiments, cap 250 includes another seal or gasket 268-1 to assist in sealing between the cap and container 224.

Once installed container 224 with cap 250 are installed in dispensing device 220, activation surface 276 of dispensing cap 250 is positioned adjacent to an activation arm 288 of dispensing device 220. Activation arm 288 secured in dispensing device 220 for linear movement and is maintained in a normal position (FIG. 18) by a spring 312. Arm 288 is operatively connected to trigger 240 by a cable 326 so that movement of trigger 240 is translated into linear movement of arm 288. Linear movement of arm 288 causes the arm to act on activation surface 276 of valve 256 to open the valve as discussed above. Spring 312 returns the arm 288 to its normal position after release of trigger 240. Features 284-1, 284-2 provide sufficient holding force to cap 250 to prevent inadvertent withdrawal of the cap from dispensing device 220 during activation by arm 288 on activation surface 276.

Tolerances and/or slack in dispensing device 220 that prevents proper interaction between arm 288 and activation surface 276 can be adjusted or compensated using an adjuster nut 246.

Figure 19A:
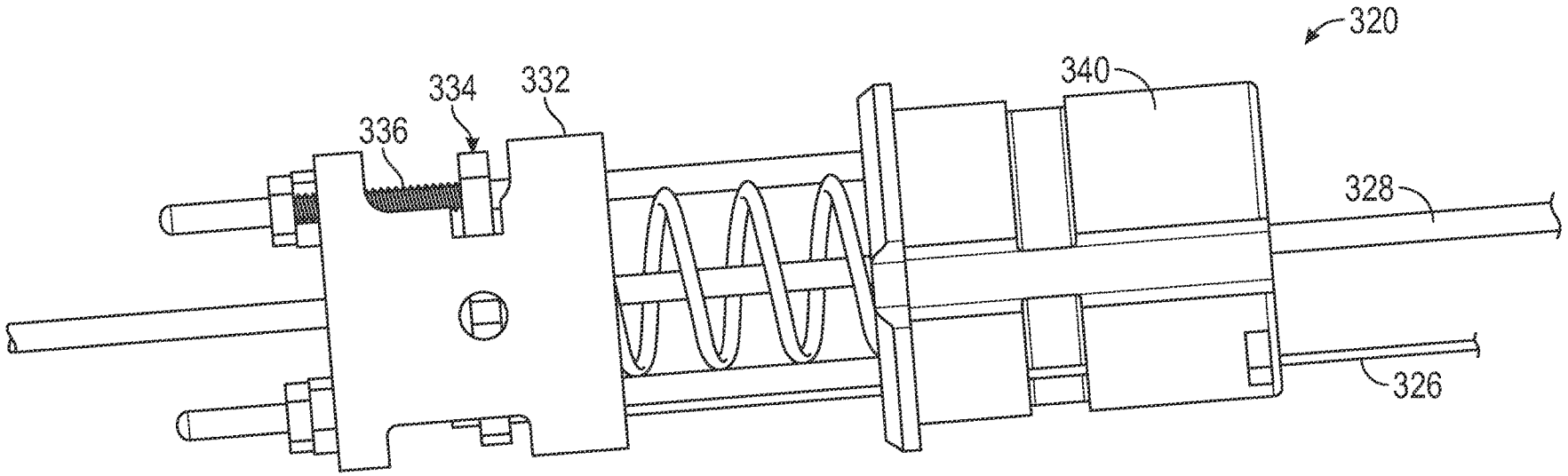
FIG. 19*a* illustrates an exemplary embodiment of a telescoping trigger assembly according to the present disclosure for use with the assemblies of FIGS. 16 and 17.
Figure 19B:
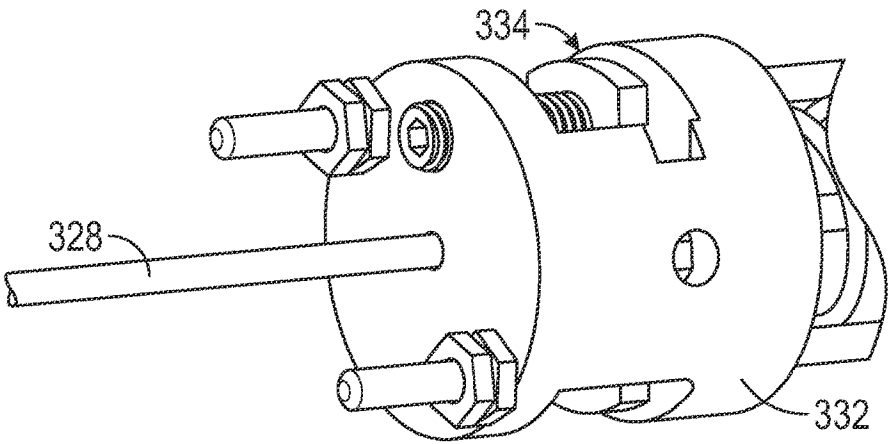
FIG. 19*b* is a magnified bottom view of the telescoping trigger assembly of FIG. 19*a* in a normal or unlocked position.
Figure 19C:
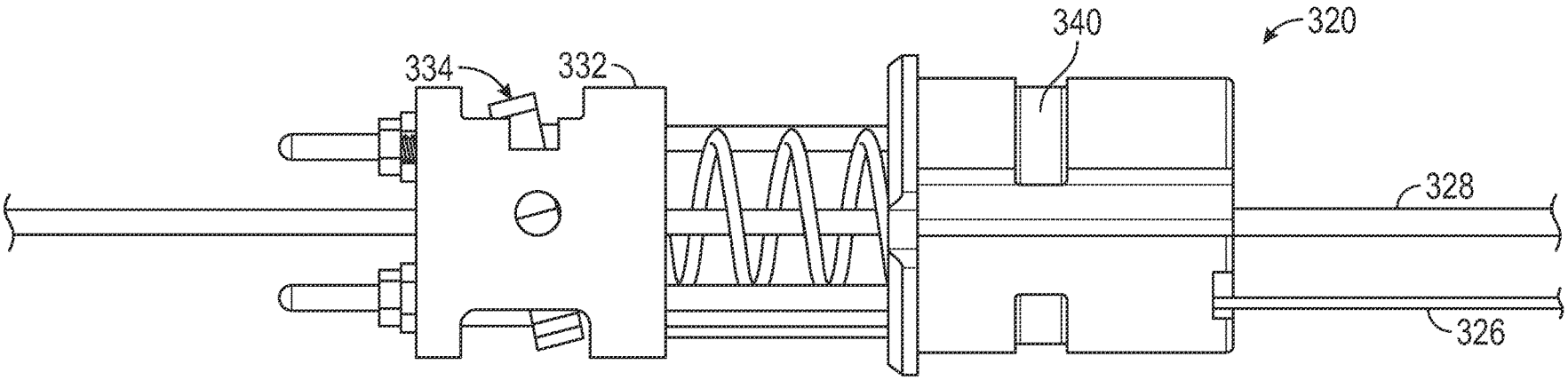
FIG. 19*c* is a perspective view of the telescoping trigger assembly of FIG. 19*a* in the locked or dispensing position.
Figure 19D:
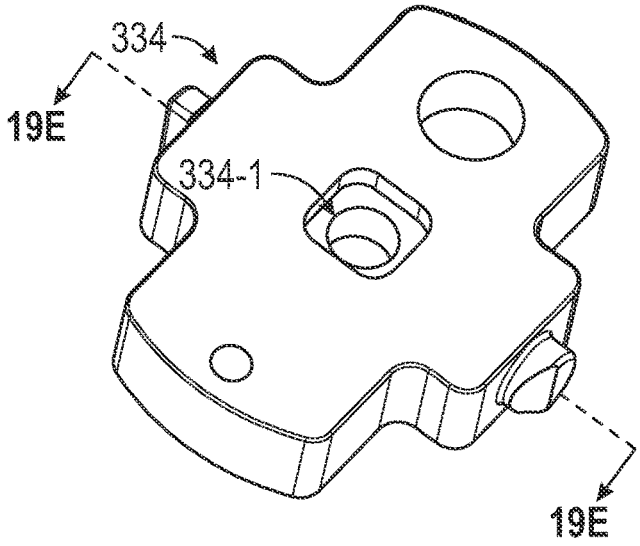
FIG. 19*d* is a perspective view of a toggle of FIG. 19*a;*
Figure 19E:
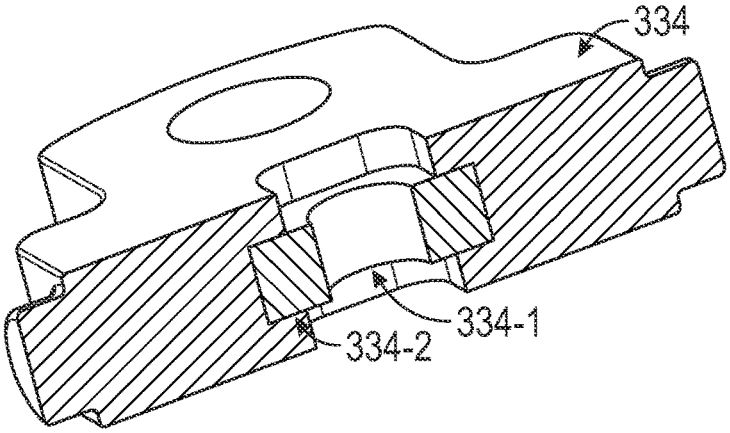
FIG. 19*e* is a sectional view of the toggle of FIG. 19*d* taken along line 19*d*-19*d;*
Figure 19F:
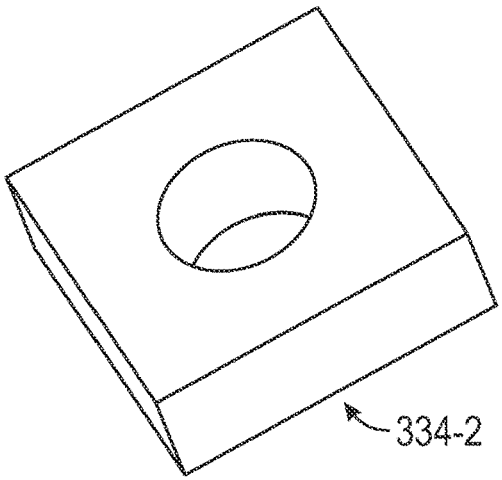
FIG. 19*f* is a perspective view of an insert for the toggle.

In embodiments where pole 214 includes an adjusting device 234 to provide an adjustable length to the pole, the linear movement of arm 288 is induced by trigger 240 via a telescoping trigger assembly 320, which is described with simultaneous reference to FIGS. 18-19*f*. Telescoping trigger assembly 320 is configured to maintain the operable connection between dispensing device 220 and trigger 240 throughout the range of length adjustments of pole 214 as described in detail below.

Telescoping trigger assembly 320 includes a smooth or toothless shaft 328, a first base 332, a toggle 334, and a biasing member 336. Shaft 328 is connected directly to arm 288 of dispensing assembly 220 via any desired connection such as, a pin 314. Of course, it is contemplated by the present disclosure for arm 288 and shaft 328 to connected by any other method such as, but not limited to adhesive, interlocking features, press-fit, and others as well as a combination of methods. Shaft 328 can be made of any material sufficient to withstand the tension and friction such as, but not limited to stainless steel or plated steel. Toggle 334 is connected to trigger 240 via a cable 326.

Toggle 334 includes an opening 334-1 through which shaft 328 passes. Toggle 334 is pivotally secured in first base 332 for movement between a first or unlocked position (FIGS. 18 and 19*a*) and a second or locked position (FIG. 19*c*), with the biasing member 336 biasing the toggle to the unlocked position.

Second base is secured in a desired position within top section 230 of pole 214 via a second base 340. In this manner and with toggle 334 in the unlocked position, adjustment of the length of pole 214 by movement of top section 230 with respect to bottom section 232 results in rack shaft 328 sliding within first base 332 closer to or farther from trigger 240.

Once pole 214 is secured at the desired length, activation of trigger 240 pulls on second cable 326, which overcomes the force of biasing member 336 to pivot toggle 334 within first base 332 to the locked position.

When pivot toggle 334 is in the locked position, opening 334-1 frictionally engages with rack shaft 328 so that the linear movement of second cable 326 is translated into a linear movement of rack shaft 328. The linear movement of rack shaft 328 in turn pulls on arm 288 of dispensing assembly 220, which opens valve 256 in dispensing cap 250.

In some embodiments, toggle 334 can include an insert region 334-2 integrally molded in to form opening 334-1. Here, insert region 334-2 can be configured to increase the frictional engagement between shaft 328 and toggle 334.

Toggle 334 and, when present insert 334-2 can be formed of any material having sufficient rigidity and/or capable of applying sufficient frictional forces to shaft 328. In some embodiments, insert 334-2 is made of steel such as stainless steel or plated steel and toggle 334 is made of a thermoplastic such as, but not limited to, polyoxymethylene (POM), also known as acetal, acrylonitrile butadiene styrene (ABS), and polypropylene (PP).

Shaft 328 is illustrated as having a circular cross section that mates with toggle 334 that has a generally planar section. Of course, it is contemplated by the present disclosure for shaft 328 and toggle 334 to have any desired non-matching cross sectional shapes such as, but not limited to, circular or polygonal sections. Additionally, it is contemplated by the present disclosure for shaft 328 and teeth 334 to have non-matching cross sections.

Upon release of trigger 240, the biasing member 336 of rack assembly 320 returns toggle 334 to the normal position and spring 312 returns arm 288 to its normal position, which allow valve 256 in dispensing cap 250 to close as described above.

Figure 20A:
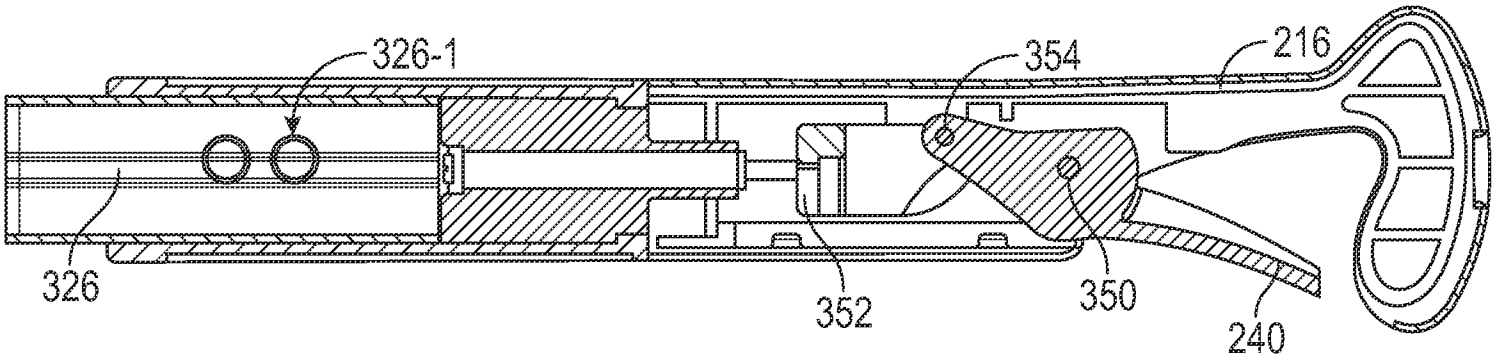
FIG. 20*a* is a sectional view of a trigger portion of the assemblies of FIGS. 16 and 17, shown in a normal or un-activated position.
Figure 20B:
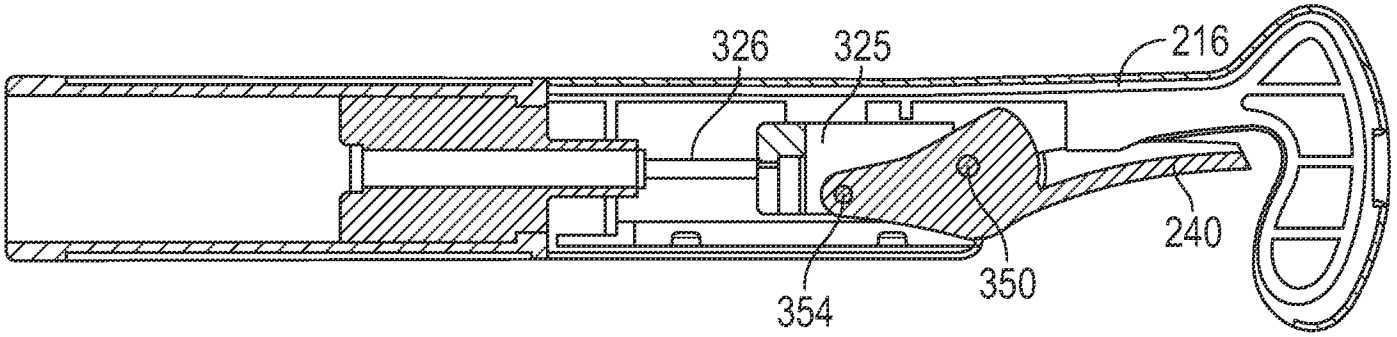
FIG. 20*b* is a sectional view of the trigger portion in an activated position.

The operation the trigger portion of assembly 210 is described in more detail with simultaneous reference to FIGS. 20*a* and 20*b*.

In embodiments where top-hand grip 216 is secured to pole 214 in a rotatable manner, cable 326 can include a swivel 326-1 between trigger 240 and telescoping trigger rack assembly 320, which reduces the torsion on the operative engagement during rotation of top-hand grip 216. Swivel 326-1 can be any swiveling connection for cable 326 such as, but not limited to, those commonly used in recreational fishing.

Additionally, it is contemplated by the present disclosure for sections 230, 232 of pole 214 to be configured to prevent rotation with respect to one another. For example, sections 230, 232 can have a non-circular cross section shown in FIGS. 16-17 as interlocking notches that prevent rotation of the sections with respect to one another while allowing the desired sliding telescoping movement.

Trigger 240 is configured for movement about a trigger pivot 350 between a normal or un-activated position as shown in FIG. 20*a* and an activated position as shown in FIG. 20*b*. Trigger 240 is biased to the normal or un-activated position by a biasing member (not shown). Second cable 326 is secured to a linear cam 352, which is slidably positioned in top-hand grip 216. Trigger 240 has a cam follower 354 engaged with linear cam 352. In this manner, rotary movement of trigger 240 is converted by the interaction of cam 352 and cam follower 354 into linear movement of cable 326.

Figure 21A:
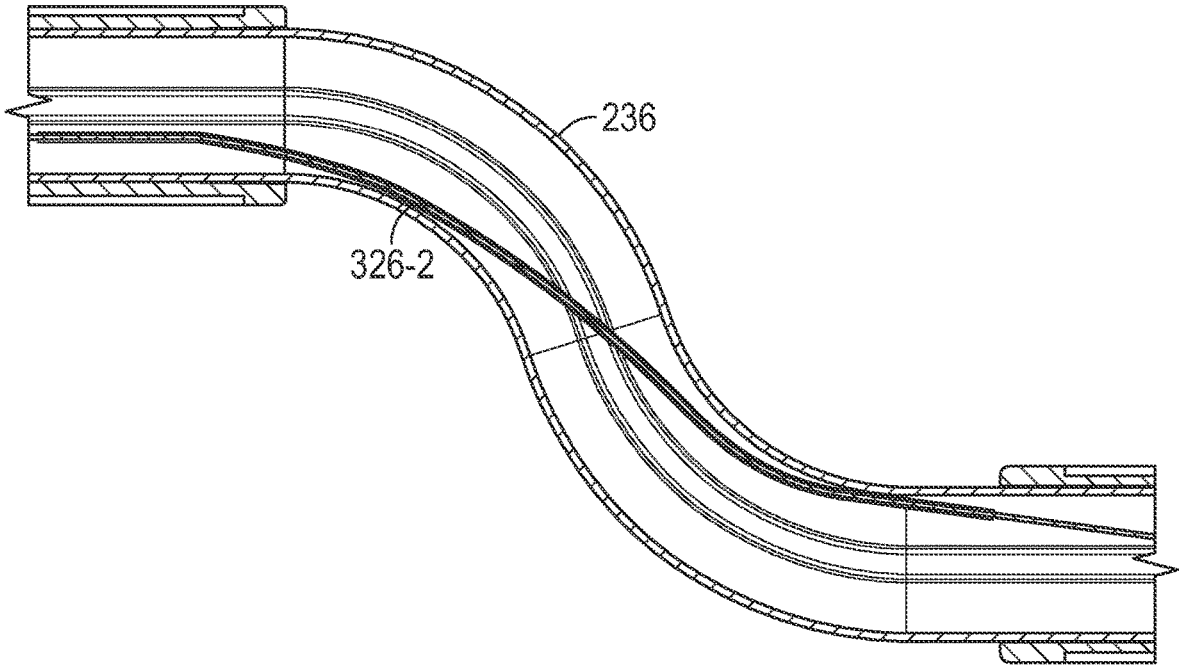
FIG. 21*a* is a sectional view of the bent portion of the assembly of FIG. 16.
Figure 21B:
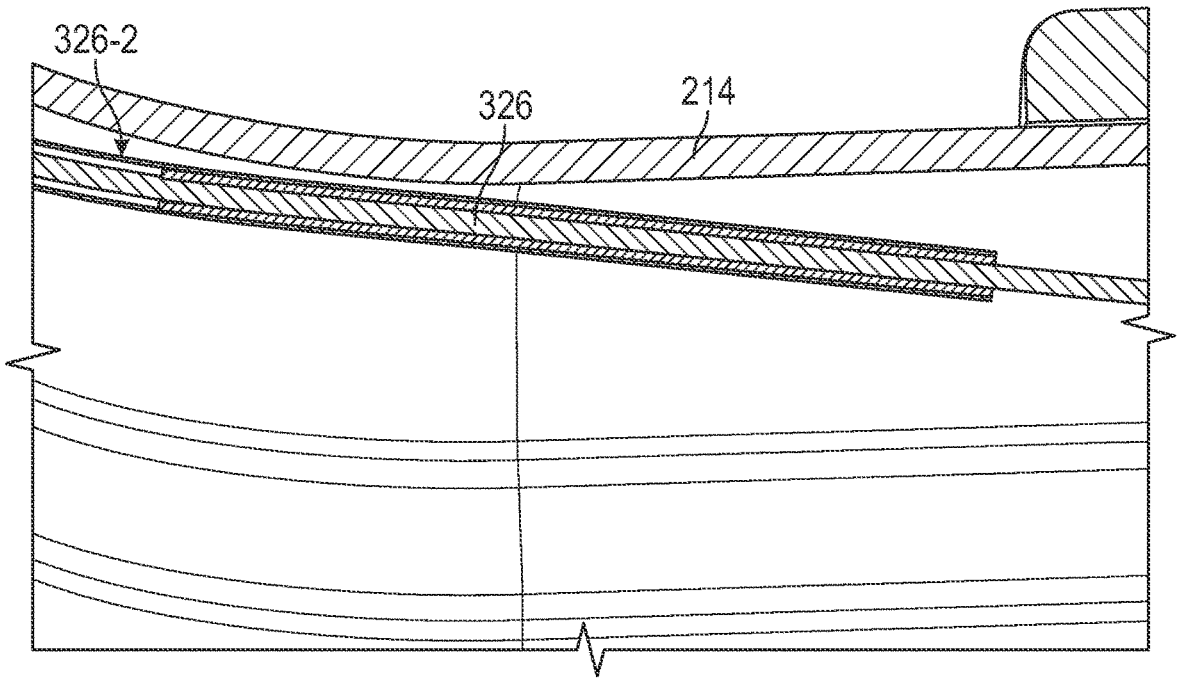
FIG. 21*b* is a magnified view of FIG. 21*a;*

Bent region 236 of pole 214 is shown in FIGS. 21*a*-21*b*. Here, cable 326 can include a protective and/or lubricating sheath 326-2 that allows the cable to smoothly rest against pole during activation of trigger 240.

Although assembly 210 is described with respect to container 224 only, it is contemplated by the present disclosure for assembly 210 to find equal use with a backpack.

Certain aspects of assembly 210 are described in more detail with reference to FIGS. 17 and 22-23. Pole 214 has a primary axis ($P_A$) that is defined through bottom-hand grip 218 and a secondary axis ($S_A$) that is defined through top-hand grip 216. In the illustrated embodiment, primary axis ($P_A$) and secondary axis ($S_A$) are configured so that bottom-hand grip 218 and top-hand grip 216 are offset from one another in a manner that improves conversion of back-and-forth motion input into the grips into a desired cleaning path at tool 212. Primary axis ($P_A$) and secondary axis ($S_A$) are, in some embodiments, substantially parallel to one another and, more preferably parallel to one another.

As used herein, the term "substantially" when used in combination with the term "parallel" shall mean that the axes are ±30 degrees of one another, more preferably ±20 degrees of one another, with ±10 degrees of one another being most preferred.

In an effort to reduce the effect the necessary forces input by the user when using grips 216, 218 to induce the desired path at tool 212, agent dispensing device 220—having in this instance container 224 secured thereto—has a tertiary axis ($T_A$) that is defined therethrough. Tertiary axis ($T_A$) is in some embodiments substantially parallel, and more preferably parallel, to both primary and secondary axes ($P_A$, $S_A$) and is offset from at least primary axis ($P_A$). In some embodiments, tertiary axis ($T_A$) offset from primary axis ($P_A$) but is coincident to secondary axis ($S_A$).

In other embodiments, tertiary axis ($T_A$) offset from both primary and secondary axes ($P_A$, $S_A$). As illustrated in FIG. 17, tertiary axis ($T_A$) is offset so as to have a position that is not between primary and secondary axes ($P_A$, $S_A$). Here, agent dispensing device 220 is illustrated and described as a rear facing reservoir system, tertiary axis ($T_A$) is offset so as to have a position that is not between primary and secondary axes ($P_A$, $S_A$) results in the axes having an order—within a plane defined there through—from front to back of $S_A$-$P_A$-$T_A$.

Of course, it is contemplated by the present disclosure for tertiary axis ($T_A$) is offset so as to have a position that is between primary and secondary axes ($P_A$, $S_A$). Stated another way, assembly 210 can be configured so that the axes have an order—within a plane defined there through—of $P_A$-$T_A$-$S_A$. The plane defined through axes ($P_A$, $S_A$, $T_A$) is preferably perpendicular to leading edge ($L_E$) of tool 212. Of course in other embodiments, the plane defined through axes ($P_A$, $S_A$, $T_A$) can have any desired angle with respect to leading edge ($L_E$) of tool 212.

It should be recognized that assembly 210 is described above with respect to FIG. 17 as having container 224 in a rear facing and bottommost position. Of course, it is contemplated by the present disclosure for assembly 210 to be configured so that container 224 can be in any desired position such as, but not limited to, either a front facing position or a rear facing and any one of a bottom position, a middle position, an upper middle position, and an upper most position.

As seen in FIG. 17 where bent region 236 is included in the upper section 230, the upper section includes both primary and secondary axes ($P_A$, $S_A$).

Without wishing to be bound by any particular theory, assembly 210 is believed to reduce wrist movement when cleaning. Referring now to FIGS. 22 and 23, an exemplary embodiment of a first cleaning path used with assembly 210 is shown in FIG. 22 and the forces input to the assembly to achieve this first path are shown in FIG. 23.

Here, assembly 210 is moved so that tool 212 moves in an s-shaped path in which leading edge ($L_E$) stays in front of the tool (or behind the tool if the operation were to be reversed). This path promotes capture of dirt or debris by tool 212 and prevents or mitigates the captured dirt or debris from being re-deposited or released throughout the cleaning path.

Figure 22:
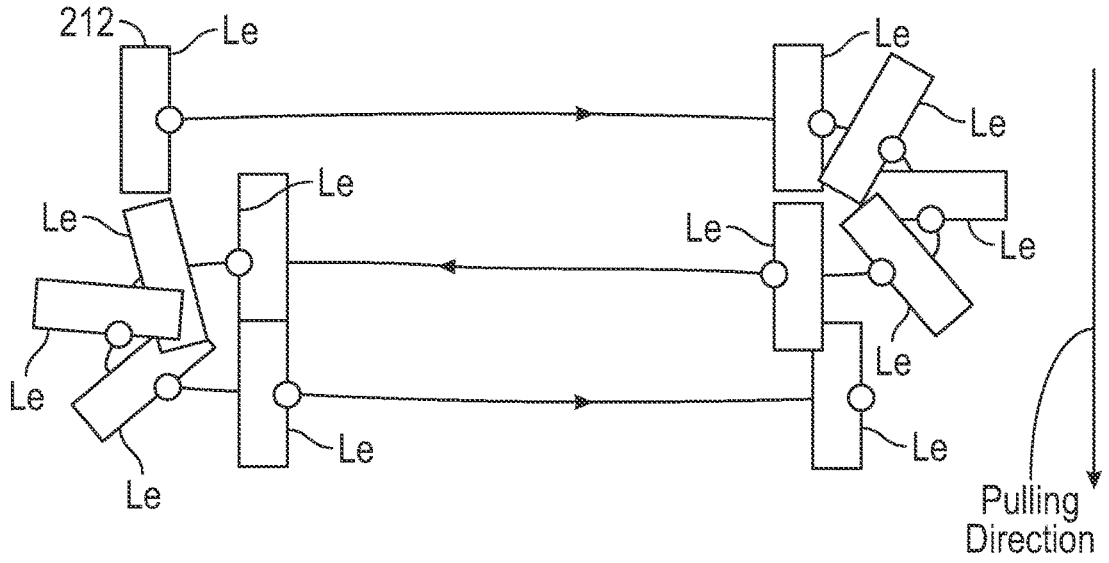
FIG. 22 illustrates an exemplary embodiment of a hard surface cleaning path of the assembly of FIG. 17.

It has been determined by the present disclosure that movement in the s-shaped path illustrated in FIG. 22 is accomplished using prior art assemblies, namely those having straight poles or poles with multiple bends or offsets, when repeated wrist movement is input to the assembly. Advantageously, assembly 210 is believed to avoid, eliminate, and/or at least mitigate such repeated wrist movement when moving tool 212 through the path of FIG. 22. Instead and with reference to FIG. 23, assembly 210 through the simple solution providing pole 214 with primary axis ($P_A$) defined by through bottom-hand rotatable grip 218 and secondary axis ($S_A$) defined through top-hand grip 216—where these axes are configured so that the grips are offset from one another surprisingly improves conversion of back-and-forth motion input into the grips into the desired s-path path at tool 212. Here, the user pulls assembly 210 in a pulling direction while applying or inputting linear back-and-forth movements to bottom-hand grip 218. The offset of primary and secondary axes ($P_A$, $S_A$) converts the linear back-and-forth movements input to rotating bottom-hand grip 218 to the s-shaped path at tool 212 and allows a rotational movement at top-hand grip 216.

Simply stated, it is believed that the simple combination of inputting the linear back-and-forth force to the bottom-hand grip 218 which rotates, while simultaneously pulling assembly 210 along the floor generates the s-shaped cleaning path of FIG. 22 with minimal wrist flexion, which allows the user to rely on the larger muscle groups to input the linear back-and-forth force instead of the smaller muscles of the wrist.

Assembly 210 further achieves the improved conversion of wrist reduced motion by a combination of, in some embodiments, top hand-grip 216 either spins freely or remains stationary and the grip slides smoothly within the hand of the end user while bottom-hand grip 218 rotates, with both grips encouraging proper hand placement and encouraging limited wrist movement through finger/hand placement and/or limited range of rotation required, which are described in more detail below.

As mentioned above, adjusting device 234 preferably is a non-rotational joint that ensures that the plane of the primary and secondary axes ($P_A$, $S_A$) remain substantially perpendicular to the leading edge ($L_E$) of the cleaning tool 212. Thus, adjusting device 234 is preferably configured allow adjustment to the length of pole 216 by adjusting the position of top and bottom sections 230, 232 with respect to one another while preventing rotation of sections 230, 232 with respect to one another—and, thus, can include non-circular cross-sections and/or pin-and-detent locking systems.

Figure 24:
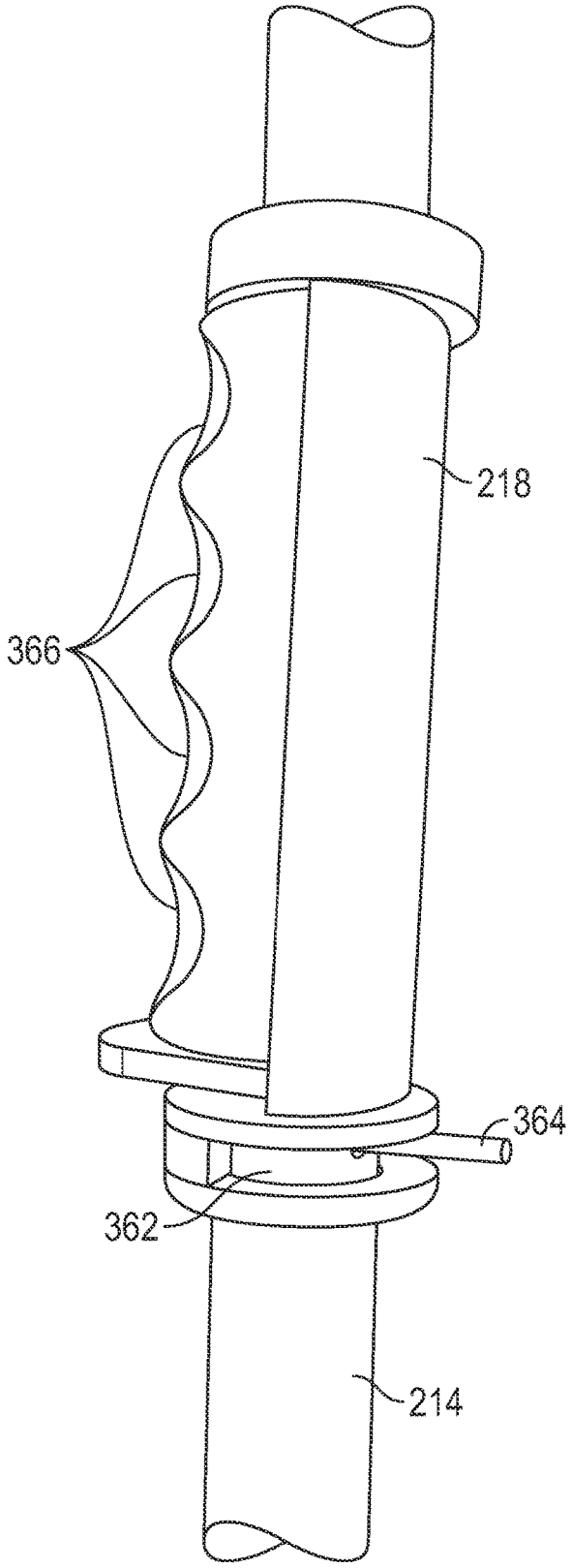
FIG. 24 is a first side view of an exemplary embodiment of a rotating bottom-hand grip of FIG. 17.
Figure 25:
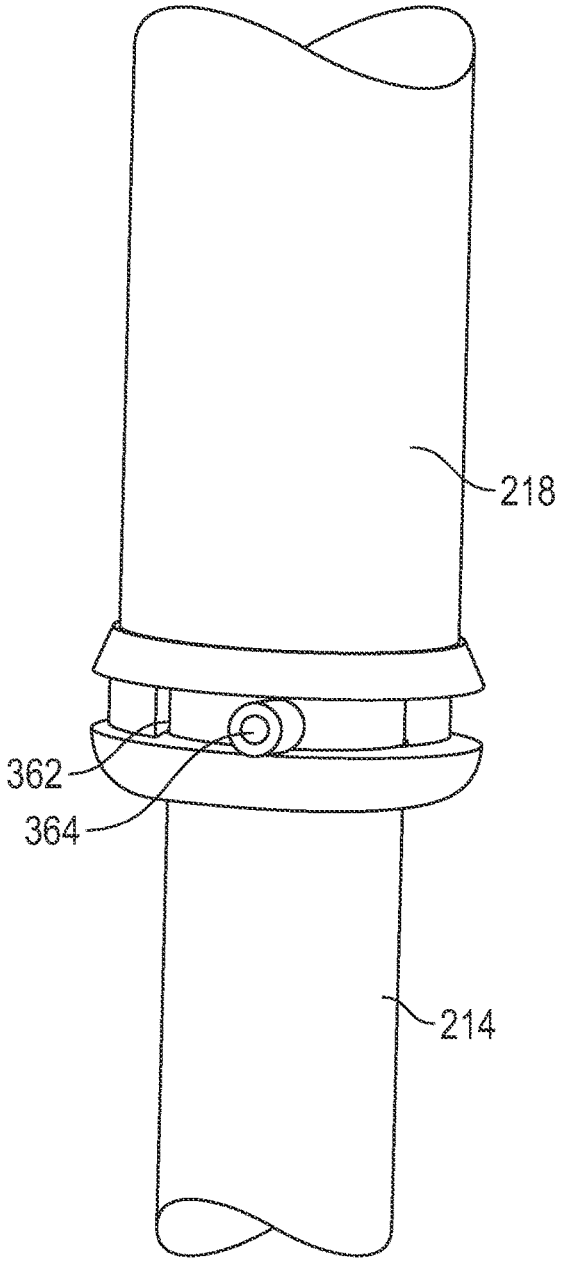
FIG. 25 is a second side view of the rotating bottom-hand grip of FIG. 17.

The rotation of bottom-hand grip 218 is shown in detail in FIGS. 24-25. A first side of rotating grip 218 is shown in FIG. 24 and a second side is shown in FIG. 25 with increased magnification for enhanced clarity.

Grip 218 includes an inner opening or diameter (not shown) that fits over an outer dimension or diameter (also not shown) of pole 214 in a manner that allows the grip to rotate with respect to the pole.

In the illustrated embodiment, grip 218 includes a slot 362 that receives a pin 364, which is positioned through pole 214. Slot 362 and pin 364 cooperate to maintain grip 218 in a desired position along the length of pole 214. Additionally, slot 362 can be dimensioned to define the extent of rotation of grip 218 about pole 214. In some embodiments, slot 362 and pin 364 can allow for 360 degrees of rotation. However, in the illustrated embodiment, slot 362 allows grip 218 to rotate about pole 214 by less than 360 degrees, with between about 140 and 240 degrees of rotation being preferred, and with about between 180 and 220 degrees being most preferred.

Although not shown, it is contemplated by the present disclosure for grip 218 to be configured so that slot 362 and pin 364 are not visible to the user.

Grip 218 can also include a plurality of finger receiving features 366. It has been found by the present disclosure that the combination of rotating grip 218—which is limited in its degree of rotation by slot 362 and pin 364—when combined with features 366 advantageously provide the user with a defined gripping orientation, which assists in promoting the user to induce the desired cleaning movement and proper orientation. Stated another way, since grip 218 can only rotate approximately 180 degrees and includes features 366 on only one side, assembly 210 is configured to guide the end user into holding the assembly in the desired manner.

Figure 23:
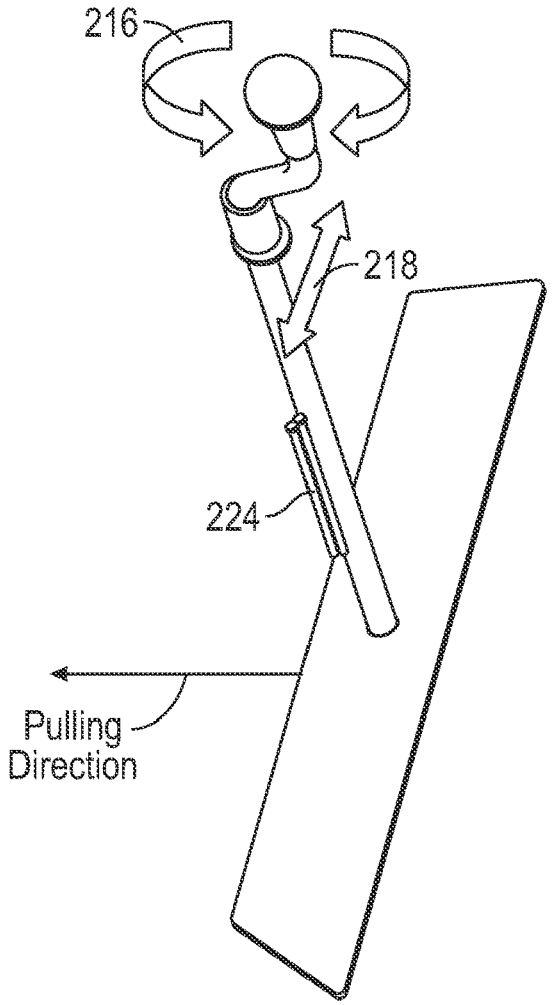
FIG. 23 illustrates an exemplary embodiment of the force inputs that provide the hard surface cleaning path of FIG. 22.

In some embodiments, assembly 210 is configured so that it is self-correcting with respect to the cleaning motion described with respect to FIGS. 22-23. It has been determined by the present disclosure that, in some embodiments, it is desired for container 224 to be at the leading edge ($L_E$) of tool 212 with respect to the pulling direction. However, at times, a user can inadvertently begin use of assembly 210 by moving the assembly in the back-and-forth motion but with container 224 at the trailing edge ($T_E$). Assembly 210 is advantageously configured to self-correct such that container 224 is at the leading edge ($L_E$). Specifically and without wishing to be bound by any particular theory, assembly 210—when both top and bottom hand grips 218, 220 rotate about pole 214 with lower friction than tool 212 imparts on the surface being cleaned—will automatically convert the back and forth motion of FIG. 22 when the top-hand grip is held in position and the bottom-hand grip is used to induce the back and forth motion while the assembly is moved in the cleaning direction such that, within one cycle of back and forth, container 224 will move from the trailing edge (TE) to the leading edge ($L_E$).

As can be appreciated from the above, assembly 210 is preferably configured to include trigger 240 at top-hand grip 216. However, it is contemplated by the present disclosure for assembly 210 to be configured so that trigger 240 is included at bottom-hand grip 218.

It is contemplated by the present disclosure for grips 216, 218 to be made of any desired material. For example, grips 216, 218 are made of plastics such as, but not limited to, polypropylene (PP) and/or acrylonitrile butadiene styrene (ABS) either with or without thermoplastic elastomers (TPE) gripping regions. Preferably, grips 216, 218 include TPE gripping regions when the grip rotates, where the TPE provides enhanced gripping, but lack TPE when the grip does not rotate, where the lack of TPE allows the grip to easily slide in the user's hand.

Although various attributes of assembly are described herein with respect to different embodiments, it is contemplated by the present disclosure for the assembly to include any of the attributes described herein in any desired combination.

It should also be noted that the terms "first", "second", "third", "upper", "lower", "front", "back", and the like may be used herein to modify various elements. These modifiers do not imply a spatial, sequential, or hierarchical order to the modified elements unless specifically stated.

While the present disclosure has been described with reference to one or more exemplary embodiments, it will be understood by those skilled in the art that various changes may be made and equivalents may be substituted for elements thereof without departing from the scope of the present disclosure. In addition, many modifications may be made to adapt a particular situation or material to the teachings of the disclosure without departing from the scope thereof. Therefore, it is intended that the present disclosure not be limited to the particular embodiment(s) disclosed as the best mode contemplated.

What is claimed is:

1. A hard surface cleaning and conditioning assembly, comprising:

a pole;

a tool depending from the pole; and a selectively lockable joint configured to connect the tool to the pole, wherein the selectively lockable joint has at least two axes of rotation, with a first axis normal to an axis through the pole and a second axis normal to the first axis and the axis through the pole, wherein the selectively lockable joint comprises:

a locking arm that is moveable in a direction along the axis through the pole; and an intermediate member positioned between the first axis and the second axis, the intermediate member having a locking opening and wherein the locking arm is movable to engage with the locking opening, wherein when the locking arm is engaged with the locking opening rotation is prevented about the second axis and allowed about the first axis, and wherein when the locking arm is disengaged with the locking opening rotation is allowed about both the first axis and the second axis.

2. The assembly of claim 1, further comprising a locking button configured to enable securing of the locking arm in the engaged position with the locking opening.

3. The assembly of claim 1, wherein the pole has a lower section and an upper section, the assembly further comprising an adjusting device securing the upper section and the lower section to one another in a telescoping manner.

4. The assembly of claim 3, wherein the pole further comprises a bent portion joining the lower and upper sections to one another, the lower section defining a primary axis and the upper section defining a secondary axis, wherein the primary and secondary axes are substantially parallel to one another and offset from one another.

5. The assembly of claim 4, further comprising a bottom-hand grip on the lower section, the bottom-hand grip being configured to rotate about the primary axis.

6. The assembly of claim 4, further comprising a top-hand grip on the upper section, the top-hand grip having a portion that includes the trigger, the portion being configured to rotate about the secondary axis.

7. The assembly of claim 4, wherein the upper section and the bent region are formed of one unitary member and the upper and lower sections are secured to one another by the adjusting device.

8. The assembly of claim 1, wherein the pole has a lower section and an upper section joined to one another by a bent portion, the lower section defining a primary axis and the upper section defining a secondary axis, the assembly further comprising: a fluid dispensing device depending from the lower section, the fluid dispensing device defining a tertiary axis, wherein the primary, secondary, and tertiary axes are substantially parallel to one another and offset from one another with the primary axis being positioned between the secondary and tertiary axes.

9. The assembly of claim 1, further comprising a container configured to contain a fluid, the container configured to releasably attach to the pole.

* * * * *